US009669851B2

(12) United States Patent
Cooper et al.

(10) Patent No.: US 9,669,851 B2
(45) Date of Patent: Jun. 6, 2017

(54) ROUTE EXAMINATION SYSTEM AND METHOD

(71) Applicant: General Electric Company, Schenectady, NY (US)

(72) Inventors: Jared Klineman Cooper, Melbourne, FL (US); Samuel William Golden, Melbourne, FL (US); Joseph Forrest Noffsinger, Grain Valley, MO (US); Ajith Kuttannair Kumar, Erie, PA (US); Yuri Alexeyevich Plotnikov, Niskayuna, NY (US); Jeffrey Michael Fries, Lee's Summit, MO (US); Steven Joseph Ehret, Erie, PA (US); Nicholas David Nagrodsky, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/657,233

(22) Filed: Mar. 13, 2015

(65) Prior Publication Data

US 2015/0183448 A1 Jul. 2, 2015

Related U.S. Application Data

(63) Continuation-in-part of application No. 14/527,246, filed on Oct. 29, 2014, which is a continuation-in-part (Continued)

(51) Int. Cl.

| | |
|---|---|
| ***B61L 25/02*** | (2006.01) |
| ***B61L 23/04*** | (2006.01) |
| ***B61L 3/10*** | (2006.01) |

(52) U.S. Cl.

CPC ..... *B61L 23/044* (2013.01); *B61L 3/10* (2013.01)

(58) Field of Classification Search

None

See application file for complete search history.

(56) References Cited

U.S. PATENT DOCUMENTS 2,104,601 A 1/1938 Young
2,104,652 A 1/1938 Inman
(Continued)

FOREIGN PATENT DOCUMENTS

AU 2007202928 A1 10/2007
AU 2010256020 A1 12/2011
(Continued)

OTHER PUBLICATIONS

Turner, Steven; "Feasibility of Locomotive-Mounted Broken Rail Detection", Final Report for High-Speed Rail IDEA Project 38; IDEA, Transportation Research Board of the National Academies; Jun. 2004.

(Continued)

*Primary Examiner* — Truc M Do
*Assistant Examiner* — Jess Whittington
(74) *Attorney, Agent, or Firm* — Global Patent Operation; John A. Kramer

(57) ABSTRACT

A route examination system and method automatically detect (with an identification unit onboard a vehicle having one or more processors) a location of a break in conductivity of a first route during movement of the vehicle along the first route. The system and method also identify (with the identification unit) one or more of a location of the vehicle on the first route or the first route from among several different routes based at least in part on the location of the break in the conductivity of the first route that is detected.

19 Claims, 14 Drawing Sheets

Related U.S. Application Data of application No. 14/016,310, filed on Sep. 3, 2013, now Pat. No. 8,914,171.

(60) Provisional application No. 61/729,188, filed on Nov. 21, 2012.

(56) References Cited

U.S. PATENT DOCUMENTS

| | | | |
|---|---|---|---|
| 2,111,513 | A | 3/1938 | Phinney |
| 2,148,005 | A | 2/1939 | Allen et al. |
| 2,233,932 | A | 3/1941 | Allen |
| 2,289,857 | A | 7/1942 | Allen |
| 2,293,926 | A | 8/1942 | Wallace |
| 2,366,802 | A | 1/1945 | Pflasterer |
| 2,601,634 | A | 6/1952 | Rivette |
| 2,783,369 | A | 2/1957 | Weber |
| 2,925,552 | A | 2/1960 | Cowan et al. |
| 2,927,711 | A | 3/1960 | Naggiar |
| 3,246,141 | A | 4/1966 | Ehrlich |
| 3,508,496 | A | 4/1970 | Larson |
| 3,519,805 | A | 7/1970 | Throne-Booth |
| 3,537,401 | A | 11/1970 | Metzner |
| 3,575,596 | A | 4/1971 | Schatzel |
| 3,650,216 | A | 3/1972 | Harwick et al. |
| 3,655,962 | A | 4/1972 | Koch |
| 3,718,040 | A | 2/1973 | Freeman et al. |
| 3,781,139 | A | 12/1973 | Lohse |
| 3,791,473 | A | 2/1974 | Rosen |
| 3,794,833 | A | 2/1974 | Blazek et al. |
| 3,805,056 | A | 4/1974 | Birkin |
| 3,813,885 | A | 6/1974 | Tabor |
| 3,865,042 | A | 2/1975 | DePaola et al. |
| 3,886,870 | A | 6/1975 | Pelabon |
| 3,937,432 | A | 2/1976 | Birkin |
| 3,948,314 | A | 4/1976 | Creswick et al. |
| 4,003,019 | A | 1/1977 | Tronel |
| 4,005,838 | A | 2/1977 | Grundy |
| 4,041,283 | A | 8/1977 | Mosier |
| 4,042,810 | A | 8/1977 | Mosher |
| 4,062,419 | A | 12/1977 | Kadota |
| 4,075,632 | A | 2/1978 | Baldwin et al. |
| 4,100,795 | A | 7/1978 | Panetti |
| 4,117,463 | A | 9/1978 | Norton |
| 4,136,432 | A | 1/1979 | Melley, Jr. |
| 4,159,088 | A | 6/1979 | Cosley |
| 4,181,278 | A | 1/1980 | Pascoe |
| 4,181,943 | A | 1/1980 | Mercer, Sr. et al. |
| 4,214,647 | A | 7/1980 | Lutts |
| 4,241,403 | A | 12/1980 | Schultz |
| 4,253,399 | A | 3/1981 | Spigarelli |
| 4,262,209 | A | 4/1981 | Berner |
| 4,279,395 | A | 7/1981 | Boggio et al. |
| 4,324,376 | A | 4/1982 | Kuhn |
| 4,344,364 | A | 8/1982 | Nickles et al. |
| 4,355,582 | A | 10/1982 | Germer |
| 4,360,873 | A | 11/1982 | Wilde et al. |
| 4,361,202 | A | 11/1982 | Minovitch |
| 4,401,035 | A | 8/1983 | Spigarelli et al. |
| 4,425,097 | A | 1/1984 | Owens |
| 4,524,745 | A | 6/1985 | Tominari et al. |
| 4,548,164 | A | 10/1985 | Ylonen et al. |
| 4,561,057 | A | 12/1985 | Haley, Jr. et al. |
| 4,565,548 | A | 1/1986 | Davis et al. |
| 4,582,280 | A | 4/1986 | Nichols et al. |
| 4,582,580 | A | 4/1986 | Goudal et al. |
| 4,602,335 | A | 7/1986 | Perlmutter |
| 4,644,705 | A | 2/1987 | Saccomani et al. |
| 4,663,713 | A | 5/1987 | Cornell et al. |
| 4,711,418 | A | 12/1987 | Aver, Jr. et al. |
| 4,718,351 | A | 1/1988 | Engle |
| 4,735,385 | A | 4/1988 | Nickles et al. |
| 4,773,590 | A | 9/1988 | Dash et al. |
| 4,794,548 | A | 12/1988 | Lynch et al. |
| 4,827,438 | A | 5/1989 | Nickles et al. |
| 4,843,575 | A | 6/1989 | Crane |
| 4,853,883 | A | 8/1989 | Nickles et al. |
| 4,932,614 | A | 6/1990 | Birkin |
| 4,944,474 | A | 7/1990 | Jones |
| 5,055,835 | A | 10/1991 | Sutton |
| 5,109,343 | A | 4/1992 | Budway |
| 5,129,605 | A | 7/1992 | Burns et al. |
| 5,133,645 | A | 7/1992 | Crowley et al. |
| 5,177,684 | A | 1/1993 | Harker et al. |
| 5,181,541 | A | 1/1993 | Bodenheimer |
| 5,187,945 | A | 2/1993 | Dixon |
| 5,197,438 | A | 3/1993 | Kumano et al. |
| 5,197,627 | A | 3/1993 | Disabato et al. |
| 5,201,294 | A | 4/1993 | Osuka |
| 5,230,613 | A | 7/1993 | Hilsbos et al. |
| 5,240,416 | A | 8/1993 | Bennington |
| 5,253,153 | A | 10/1993 | Mathews et al. |
| 5,261,366 | A | 11/1993 | Regueiro |
| 5,277,156 | A | 1/1994 | Osuka et al. |
| 5,313,924 | A | 5/1994 | Regueiro |
| 5,316,174 | A | 5/1994 | Schutz |
| 5,357,912 | A | 10/1994 | Barnes et al. |
| 5,363,787 | A | 11/1994 | Konopasek et al. |
| 5,365,902 | A | 11/1994 | Hsu |
| 5,388,034 | A | 2/1995 | Allen et al. |
| 5,394,851 | A | 3/1995 | Cryer et al. |
| 5,398,186 | A | 3/1995 | Nakhla |
| 5,398,894 | A | 3/1995 | Pascoe |
| 5,420,883 | A | 5/1995 | Swensen et al. |
| 5,433,182 | A | 7/1995 | Augustin et al. |
| 5,437,422 | A | 8/1995 | Newman |
| 5,441,027 | A | 8/1995 | Buchanon et al. |
| 5,459,666 | A | 10/1995 | Casper et al. |
| 5,460,013 | A | 10/1995 | Thomsen |
| 5,462,244 | A | 10/1995 | Van Der Hoek et al. |
| 5,487,002 | A | 1/1996 | Diller et al. |
| 5,487,516 | A | 1/1996 | Murata et al. |
| 5,492,099 | A | 2/1996 | Maddock |
| 5,533,695 | A | 7/1996 | Heggestad et al. |
| 5,565,874 | A | 10/1996 | Rode |
| 5,570,284 | A | 10/1996 | Roselli et al. |
| 5,574,649 | A | 11/1996 | Levy |
| 5,574,659 | A | 11/1996 | Delvers et al. |
| 5,583,769 | A | 12/1996 | Saitoh |
| 5,588,716 | A | 12/1996 | Stumpe |
| 5,600,558 | A | 2/1997 | Mearek et al. |
| 5,605,134 | A | 2/1997 | Martin |
| 5,618,179 | A | 4/1997 | Copperman et al. |
| 5,642,827 | A | 7/1997 | Madsen |
| 5,651,330 | A | 7/1997 | Jewett |
| RE35,590 | E | 8/1997 | Bezos et al. |
| 5,676,059 | A | 10/1997 | Alt |
| 5,681,015 | A | 10/1997 | Kull |
| 5,699,986 | A | 12/1997 | Welk |
| 5,713,540 | A | 2/1998 | Gerszberg et al. |
| 5,720,455 | A | 2/1998 | Kull et al. |
| 5,735,492 | A | 4/1998 | Pace |
| 5,738,311 | A | 4/1998 | Fernandez |
| 5,740,547 | A | 4/1998 | Kull et al. |
| 5,755,349 | A | 5/1998 | Brundle |
| 5,758,299 | A | 5/1998 | Sandborg et al. |
| 5,775,228 | A | 7/1998 | Lamba et al. |
| 5,785,392 | A | 7/1998 | Hart |
| 5,803,411 | A | 9/1998 | Ackerman et al. |
| 5,813,635 | A | 9/1998 | Fernandez |
| 5,817,934 | A | 10/1998 | Skantar |
| 5,820,226 | A | 10/1998 | Hart |
| 5,828,979 | A | 10/1998 | Polivka et al. |
| 5,832,895 | A | 11/1998 | Takahashi et al. |
| 5,833,325 | A | 11/1998 | Hart |
| 5,836,529 | A | 11/1998 | Gibbs |
| 5,856,802 | A | 1/1999 | Ura et al. |
| 5,913,170 | A | 6/1999 | Wortham |
| 5,927,822 | A | 7/1999 | Hart |
| 5,928,294 | A | 7/1999 | Zelinkovsky |
| 5,934,764 | A | 8/1999 | Dimsa et al. |
| 5,936,517 | A | 8/1999 | Yeh |
| 5,944,392 | A | 8/1999 | Tachihata et al. |
| 5,950,966 | A | 9/1999 | Hungate et al. |
| 5,950,967 | A | 9/1999 | Montgomery |

(56) References Cited

U.S. PATENT DOCUMENTS 5,957,571 A 9/1999 Koster et al.
5,969,643 A 10/1999 Curtis
5,978,718 A 11/1999 Kull
5,983,144 A 11/1999 Bonissone et al.
5,986,577 A 11/1999 Bezos
5,986,579 A 11/1999 Halvorson
5,995,737 A 11/1999 Bonissone et al.
5,995,881 A 11/1999 Kull
5,998,915 A 12/1999 Scholz et al.
6,005,494 A 12/1999 Schramm
6,016,791 A 1/2000 Thomas et al.
6,067,496 A 5/2000 Benoliel et al.
6,067,964 A 5/2000 Ruoff et al.
6,081,769 A 6/2000 Curtis
6,088,635 A 7/2000 Cox et al.
6,092,021 A 7/2000 Ehlbeck et al.
6,102,009 A 8/2000 Nishiyama
6,112,142 A 8/2000 Shockley et al.
6,114,901 A 9/2000 Singh et al.
6,114,974 A 9/2000 Halvorson
6,121,924 A 9/2000 Meek et al.
6,123,111 A 9/2000 Nathan et al.
6,125,311 A 9/2000 Lo
6,128,558 A 10/2000 Kernwein
6,129,025 A 10/2000 Minakami et al.
6,135,396 A 10/2000 Whitfield et al.
6,144,901 A 11/2000 Nickles et al.
6,158,416 A 12/2000 Chen et al.
6,158,822 A 12/2000 Shirai et al.
6,163,089 A 12/2000 Kull
6,163,755 A 12/2000 Peer et al.
6,179,252 B1 1/2001 Roop et al.
6,192,863 B1 2/2001 Takase
6,195,020 B1 2/2001 Brodeur, Sr. et al.
6,198,993 B1 3/2001 Higashi et al.
6,216,095 B1 4/2001 Glista
6,216,957 B1 4/2001 Turunen, Jr.
6,219,595 B1 4/2001 Nickles et al.
6,225,919 B1 5/2001 Lumbis et al.
6,230,668 B1 5/2001 Marsh et al.
6,243,694 B1 6/2001 Bonissone et al.
6,262,573 B1 7/2001 Wojnarowski et al.
6,263,265 B1 7/2001 Fera
6,263,266 B1 7/2001 Hawthorne
6,269,034 B1 7/2001 Shibuya
6,270,040 B1 8/2001 Katzer
6,275,165 B1 8/2001 Bezos
6,286,480 B1 9/2001 Chen et al.
6,295,816 B1 10/2001 Gallagher et al.
6,304,801 B1 10/2001 Doner
6,308,117 B1 10/2001 Ryland et al.
6,317,686 B1 11/2001 Ran
6,322,025 B1 11/2001 Colbert et al.
6,325,050 B1 12/2001 Gallagher et al.
6,332,106 B1 12/2001 Hawthorne et al.
6,349,702 B1 2/2002 Nishiyama
6,349,706 B1 2/2002 Hsu et al.
6,357,421 B1 3/2002 Pritchard
6,360,998 B1 3/2002 Halvorson et al.
6,363,331 B1 3/2002 Kyrtsos
6,377,215 B1 4/2002 Halvorson et al.
6,380,639 B1 4/2002 Soucy
6,404,129 B1 6/2002 Hendricx et al.
6,421,606 B1 7/2002 Asai et al.
6,427,114 B1 7/2002 Olsson
6,441,570 B1 8/2002 Grubba et al.
6,443,123 B1 9/2002 Aoki et al.
6,459,964 B1 10/2002 Vu et al.
6,459,965 B1 10/2002 Polivka et al.
6,484,074 B1 11/2002 Hazard et al.
6,487,478 B1 11/2002 Azzaro et al.
6,487,488 B1 11/2002 Peterson, Jr. et al.
6,490,523 B2 12/2002 Doner
6,493,627 B1 12/2002 Gallagher et al.
6,499,815 B1 12/2002 Daigle
6,501,393 B1 12/2002 Richards et al.
6,505,103 B1 1/2003 Howell et al.
6,520,124 B2 2/2003 Bohm, II
6,522,958 B1 2/2003 Dwyer et al.
6,523,787 B2 2/2003 Braband
6,533,223 B1 3/2003 Ireland
6,549,803 B1 4/2003 Raghavan et al.
6,557,526 B1 5/2003 Hoshino
6,564,172 B1 5/2003 Till
6,584,953 B2 7/2003 Yomogida
6,585,085 B1 7/2003 Kumar
6,591,263 B1 7/2003 Becker et al.
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,615,188 B1 9/2003 Breen et al.
6,631,322 B1 10/2003 Arthur et al.
6,647,328 B2 11/2003 Walker
6,665,609 B1 12/2003 Franke et al.
6,668,217 B1 12/2003 Franke et al.
6,676,089 B1 1/2004 Katzer
6,691,022 B2 2/2004 Takemura et al.
6,694,231 B1 2/2004 Rezk
6,698,913 B2 3/2004 Yamamoto
6,701,064 B1 3/2004 De Haan et al.
6,712,045 B1 3/2004 Mccarthy, Jr.
6,728,606 B2 4/2004 Kumar
6,728,625 B2 4/2004 Strubhar et al.
6,732,023 B2 5/2004 Sugita et al.
6,732,032 B1 5/2004 Banet et al.
6,742,392 B2 6/2004 Gilmore et al.
6,748,303 B2 6/2004 Hawthorne
6,748,313 B2 6/2004 Li et al.
6,763,291 B1 7/2004 Houpt et al.
6,782,044 B1 8/2004 Wright et al.
6,789,005 B2 9/2004 Hawthorne
6,799,096 B1 9/2004 Franke et al.
6,804,621 B1 10/2004 Pedanckar
6,810,312 B2 10/2004 Jammu et al.
6,812,888 B2 11/2004 Drury et al.
6,814,050 B2 11/2004 Kishibata et al.
6,814,060 B1 11/2004 Solomons et al.
6,823,844 B2 11/2004 Steinbrenner et al.
6,853,888 B2 2/2005 Kane et al.
6,853,890 B1 2/2005 Horst et al.
6,854,691 B2 2/2005 Kraeling et al.
6,863,246 B2 3/2005 Kane et al.
6,865,454 B2 3/2005 Kane et al.
6,893,262 B2 5/2005 Stockman
6,903,658 B2 6/2005 Kane et al.
6,904,110 B2 6/2005 Trans et al.
6,910,792 B2 6/2005 Takada et al.
6,915,191 B2 7/2005 Kane et al.
6,947,830 B1 9/2005 Froloff et al.
6,948,837 B2 9/2005 Suzuki
6,953,272 B2 10/2005 Hayakawa et al.
6,957,131 B2 10/2005 Kane et al.
6,973,947 B2 12/2005 Penaloza et al.
6,980,894 B1 12/2005 Gordon et al.
6,996,461 B2 2/2006 Kane et al.
7,031,823 B2 4/2006 Chatfield et al.
7,047,130 B2 5/2006 Watanabe et al.
7,051,693 B2 5/2006 Tetsuno et al.
7,072,757 B2 7/2006 Adams et al.
7,082,924 B1 8/2006 Ruedin
7,096,171 B2 8/2006 Hawthorne et al.
7,131,403 B1 11/2006 Banga et al.
7,140,477 B2 11/2006 Engle et al.
7,161,500 B2 1/2007 Alfredsson et al.
7,188,009 B2 3/2007 Hawthorne
7,200,536 B2 4/2007 Wynn
7,201,350 B2 4/2007 Sugita et al.
7,219,067 B1 5/2007 Mcmullen et al.
7,234,449 B2 6/2007 Casabianca et al.
7,263,647 B2 8/2007 Bryant et al.
7,290,807 B2 11/2007 Kumar
7,309,929 B2 12/2007 Donnelly et al.

(56) References Cited

U.S. PATENT DOCUMENTS 7,337,766 B2 3/2008 Nakayama et al.
7,387,029 B2 6/2008 Cunningham
7,389,694 B1 6/2008 Hay et al.
7,395,141 B1 7/2008 Seck et al.
7,416,262 B2 8/2008 Ring
7,497,201 B2 3/2009 Hollenbeck
7,509,193 B2 3/2009 Kustosch
7,523,893 B2 4/2009 Francis et al.
7,543,670 B2 6/2009 Tamai et al.
7,557,748 B1 7/2009 Zahm et al.
7,565,867 B2 7/2009 Donnelly et al.
7,667,611 B2 2/2010 Lindsey et al.
7,734,387 B1 6/2010 Young et al.
7,770,847 B1 8/2010 Severson
7,778,747 B2 8/2010 Hawkins et al.
7,783,397 B2 8/2010 Peltz et al.
7,811,089 B2 10/2010 Bond
7,895,135 B2 2/2011 Norris et al.
7,960,855 B2 6/2011 King et al.
8,030,871 B1 10/2011 Young et al.
8,068,975 B2 11/2011 Jensen et al.
8,126,601 B2 2/2012 Kapp et al.
8,150,568 B1 4/2012 Gray
8,154,227 B1 4/2012 Young et al.
8,155,811 B2 4/2012 Noffsinger et al.
8,157,218 B2 4/2012 Riley et al.
8,160,832 B2 4/2012 Luo et al.
8,195,364 B2 6/2012 Norris et al.
8,264,330 B2 9/2012 Yeldell et al.
8,266,092 B2 9/2012 Kuhn et al.
8,305,567 B2 11/2012 Hesser et al.
8,428,798 B2 4/2013 Kull
8,521,345 B2 8/2013 Cooper et al.
8,532,842 B2 9/2013 Smith et al.
8,626,366 B2 1/2014 Noffsinger et al.
8,645,047 B2 2/2014 Daum et al.
8,655,518 B2 2/2014 Cooper et al.
8,655,519 B2 2/2014 Cooper et al.
8,682,514 B2 3/2014 Falk et al.
8,888,052 B2 11/2014 Baldwin et al.
2001/0001131 A1 5/2001 Miller
2001/0019263 A1* 9/2001 Kwun ..... G01N 29/11 324/217
2001/0026321 A1 10/2001 Goto
2001/0047241 A1 11/2001 Khavakh et al.
2002/0010531 A1 1/2002 Hawthorne et al.
2002/0059075 A1 5/2002 Schick et al.
2002/0062819 A1 5/2002 Takahashi
2002/0065610 A1* 5/2002 Clark ..... B61D 15/00 702/35
2002/0065698 A1 5/2002 Schick et al.
2002/0072833 A1 6/2002 Gray
2002/0096081 A1 7/2002 Kraft
2002/0103585 A1 8/2002 Biess et al.
2002/0104779 A1 8/2002 Connor et al.
2002/0107618 A1 8/2002 Deguchi et al.
2002/0157901 A1 10/2002 Kast et al.
2002/0174653 A1 11/2002 Uzkan
2002/0188397 A1 12/2002 Biess et al.
2002/0195086 A1 12/2002 Beck et al.
2003/0000499 A1 1/2003 Doelker et al.
2003/0034423 A1 2/2003 Hess, Jr. et al.
2003/0055666 A1 3/2003 Roddy et al.
2003/0060968 A1 3/2003 MacPhail et al.
2003/0076221 A1 4/2003 Akiyama et al.
2003/0091017 A1 5/2003 Davenport et al.
2003/0104899 A1 6/2003 Keller
2003/0105561 A1 6/2003 Nickles et al.
2003/0107548 A1 6/2003 Eun et al.
2003/0120400 A1 6/2003 Ahmed Baig et al.
2003/0139909 A1 7/2003 Ozawa
2003/0158640 A1 8/2003 Pillar et al.
2003/0183729 A1 10/2003 Root et al.
2003/0187694 A1 10/2003 Rowen
2003/0213875 A1 11/2003 Hess, Jr. et al.
2003/0214417 A1 11/2003 Peltz et al.
2003/0222981 A1 12/2003 Kisak et al.
2003/0229097 A1 12/2003 Watkins et al.
2003/0229446 A1 12/2003 Boscamp et al.
2003/0233959 A1 12/2003 Kumar
2003/0236598 A1 12/2003 Villarreal Antelo et al.
2004/0010432 A1 1/2004 Matheson et al.
2004/0024515 A1 2/2004 Troupe et al.
2004/0024518 A1 2/2004 Boley et al.
2004/0025849 A1 2/2004 West et al.
2004/0026574 A1 2/2004 Seifert
2004/0034556 A1 2/2004 Matheson et al.
2004/0038831 A1 2/2004 Eadie
2004/0048620 A1 3/2004 Nakahara et al.
2004/0049339 A1 3/2004 Kober et al.
2004/0068359 A1 4/2004 Neiss et al.
2004/0073361 A1 4/2004 Tzamaloukas et al.
2004/0075280 A1 4/2004 Kumar et al.
2004/0098142 A1 5/2004 Warren et al.
2004/0107042 A1 6/2004 Seick
2004/0108814 A1 6/2004 Tsuda et al.
2004/0129289 A1 7/2004 Hafemann
2004/0129840 A1 7/2004 Horst
2004/0133315 A1 7/2004 Kumar et al.
2004/0143374 A1 7/2004 Horst et al.
2004/0153221 A1 8/2004 Kumar
2004/0167687 A1 8/2004 Kornick et al.
2004/0172175 A1 9/2004 Julich et al.
2004/0174121 A1 9/2004 Tsuda et al.
2004/0238693 A1 12/2004 Cole
2004/0243664 A1 12/2004 Horstemeyer
2004/0245410 A1 12/2004 Kisak et al.
2004/0249571 A1 12/2004 Blesener et al.
2005/0004723 A1 1/2005 Duggan et al.
2005/0007020 A1 1/2005 Tsuda et al.
2005/0045058 A1 3/2005 Donnelly et al.
2005/0055157 A1 3/2005 Scholl
2005/0055287 A1 3/2005 Schmidtberg et al.
2005/0065674 A1 3/2005 Houpt et al.
2005/0065711 A1 3/2005 Dahlgren et al.
2005/0076716 A1 4/2005 Turner
2005/0090978 A1 4/2005 Bathory et al.
2005/0096797 A1 5/2005 Matsubara et al.
2005/0099323 A1 5/2005 Hirose
2005/0107954 A1 5/2005 Nahla
2005/0109882 A1 5/2005 Armbruster et al.
2005/0120904 A1 6/2005 Kumar et al.
2005/0121005 A1 6/2005 Edwards
2005/0121971 A1 6/2005 Ring
2005/0171655 A1 8/2005 Flynn et al.
2005/0171657 A1 8/2005 Kumar
2005/0186325 A1 8/2005 Luangthep
2005/0188745 A1 9/2005 Staphanos et al.
2005/0189815 A1 9/2005 Bryant
2005/0189886 A1 9/2005 Donnelly et al.
2005/0192720 A1 9/2005 Christie et al.
2005/0196737 A1 9/2005 Mann
2005/0205719 A1 9/2005 Hendrickson et al.
2005/0210304 A1 9/2005 Hartung et al.
2005/0229604 A1 10/2005 Chen
2005/0251299 A1 11/2005 Donnelly et al.
2005/0253397 A1 11/2005 Kumar et al.
2005/0285552 A1 12/2005 Grubba et al.
2005/0288832 A1 12/2005 Smith et al.
2006/0005736 A1 1/2006 Kumar
2006/0025903 A1 2/2006 Kumar
2006/0030978 A1 2/2006 Rajaram
2006/0047379 A1 3/2006 Schullian et al.
2006/0055175 A1 3/2006 Grinblat
2006/0060345 A1 3/2006 Flik et al.
2006/0085103 A1 4/2006 Smith, Jr. et al.
2006/0085363 A1 4/2006 Cheng et al.
2006/0086546 A1 4/2006 Hu et al.
2006/0116789 A1 6/2006 Subramanian et al.
2006/0116795 A1 6/2006 Abe et al.
2006/0122737 A1 6/2006 Tani et al.
2006/0129289 A1 6/2006 Kumar et al.
2006/0138285 A1 6/2006 Oleski et al.
2006/0162973 A1 7/2006 Harris et al.

(56) References Cited

U.S. PATENT DOCUMENTS

2006/0178800 A1 8/2006 Chen et al.
2006/0187086 A1 8/2006 Quintos
2006/0212188 A1 9/2006 Kickbusch et al.
2006/0212189 A1 9/2006 Kickbusch et al.
2006/0219214 A1 10/2006 Okude et al.
2006/0225710 A1 10/2006 Taglialatela-Scafati et al.
2006/0231066 A1 10/2006 Demura et al.
2006/0235584 A1 10/2006 Fregene et al.
2006/0235604 A1 10/2006 Taglialatela-Scafati et al.
2006/0253233 A1 11/2006 Metzger
2006/0271291 A1 11/2006 Meyer
2006/0277906 A1 12/2006 Burk et al.
2006/0282199 A1 12/2006 Daum et al.
2007/0006831 A1 1/2007 Leone et al.
2007/0061053 A1 3/2007 Zeitzew
2007/0062476 A1 3/2007 Ota et al.
2007/0073466 A1 3/2007 Tamai et al.
2007/0078026 A1 4/2007 Holt et al.
2007/0093148 A1 4/2007 Gibbs et al.
2007/0108308 A1 5/2007 Keightley
2007/0112475 A1 5/2007 Koebler et al.
2007/0129852 A1 6/2007 Chen et al.
2007/0135988 A1 6/2007 Kidston et al.
2007/0137514 A1 6/2007 Kumar et al.
2007/0183039 A1 8/2007 Irvin
2007/0203203 A1 8/2007 Tao et al.
2007/0209619 A1 9/2007 Leone
2007/0219680 A1 9/2007 Kumar et al.
2007/0219681 A1 9/2007 Kumar et al.
2007/0219682 A1 9/2007 Kumar et al.
2007/0219683 A1 9/2007 Daum et al.
2007/0225878 A1 9/2007 Kumar et al.
2007/0233335 A1 10/2007 Kumar et al.
2007/0233364 A1 10/2007 Kumar
2007/0241237 A1 10/2007 Foy et al.
2007/0250225 A1 10/2007 Nickles et al.
2007/0250255 A1 10/2007 Matekunas et al.
2007/0260367 A1 11/2007 Wills et al.
2007/0260369 A1 11/2007 Philp et al.
2007/0261648 A1 11/2007 Reckels et al.
2007/0274158 A1 11/2007 Agam et al.
2008/0004721 A1 1/2008 Huff et al.
2008/0010571 A1 1/2008 Farnsworth et al.
2008/0041267 A1 2/2008 Denen et al.
2008/0065282 A1 3/2008 Daum et al.
2008/0091334 A1 4/2008 Carlson et al.
2008/0105791 A1* 5/2008 Karg ..... B61K 9/10 246/120
2008/0109124 A1 5/2008 Daum et al.
2008/0110249 A1 5/2008 Degeorge et al.
2008/0125924 A1 5/2008 Daum et al.
2008/0128563 A1 6/2008 Kumar et al.
2008/0147256 A1 6/2008 Liberatore
2008/0161984 A1 7/2008 Hrdlicka et al.
2008/0164078 A1 7/2008 Rhodes et al.
2008/0183345 A1 7/2008 Chandra et al.
2008/0183490 A1 7/2008 Martin et al.
2008/0201019 A1 8/2008 Kumar et al.
2008/0201028 A1 8/2008 Brooks et al.
2008/0201056 A1 8/2008 Moriya
2008/0208393 A1 8/2008 Schricker
2008/0312775 A1 12/2008 Kumar
2009/0044530 A1 2/2009 Gallagher et al.
2009/0063045 A1 3/2009 Figueroa et al.
2009/0076664 A1 3/2009 Mccabe et al.
2009/0078236 A1 3/2009 Gallagher et al.
2009/0140574 A1 6/2009 Gorman et al.
2009/0159046 A1 6/2009 Moriya
2009/0164104 A1 6/2009 Wermuth et al.
2009/0177345 A1 7/2009 Severinsky et al.
2009/0186325 A1 7/2009 Kumar
2009/0187291 A1 7/2009 Daum et al.
2009/0193899 A1* 8/2009 Panetta ..... G01N 29/07 73/622
2009/0198391 A1 8/2009 Kumar
2009/0205028 A1 8/2009 Smeets et al.
2009/0241909 A1 10/2009 Smith
2009/0248220 A1 10/2009 Ecton et al.
2009/0254239 A1 10/2009 Daum et al.
2009/0266943 A1 10/2009 Kumar et al.
2009/0299555 A1 12/2009 Houpt et al.
2009/0319092 A1 12/2009 Piche
2010/0023190 A1 1/2010 Kumar et al.
2010/0023240 A1 1/2010 Haskara et al.
2010/0049384 A1 2/2010 Kraeling et al.
2010/0049408 A1 2/2010 Abadie et al.
2010/0084916 A1 4/2010 Kumar et al.
2010/0114404 A1 5/2010 Donnelly
2010/0130124 A1 5/2010 Teeter et al.
2010/0131130 A1 5/2010 Kalyanam et al.
2010/0152998 A1 6/2010 Schwarzmann
2010/0174427 A1 7/2010 Sivasubramaniam et al.
2010/0235022 A1 9/2010 Siddappa et al.
2010/0262321 A1 10/2010 Daum et al.
2010/0318247 A1 12/2010 Kumar
2010/0332058 A1 12/2010 Kane et al.
2011/0029243 A1 2/2011 Gallagher et al.
2011/0035138 A1 2/2011 Kickbusch et al.
2011/0060486 A1 3/2011 Meltser et al.
2011/0093144 A1 4/2011 Goodermuth et al.
2011/0118899 A1 5/2011 Brooks et al.
2011/0257869 A1 10/2011 Kumar et al.
2011/0307113 A1 12/2011 Kumar et al.
2012/0022728 A1 1/2012 Hall et al.
2012/0108204 A1 5/2012 Schell et al.
2012/0108205 A1 5/2012 Schell et al.
2012/0108207 A1 5/2012 Schell et al.
2012/0135710 A1 5/2012 Schell et al.
2012/0197504 A1 8/2012 Sujan et al.
2012/0217351 A1 8/2012 Chadwick et al.
2012/0245766 A1 9/2012 Cooper et al.
2012/0245770 A1 9/2012 Yamamoto et al.
2012/0259531 A1 10/2012 Daum et al.
2012/0277940 A1 11/2012 Kumar et al.
2012/0290185 A1 11/2012 Cooper et al.
2012/0296545 A1 11/2012 Cooper et al.
2012/0316717 A1 12/2012 Daum et al.
2013/0015298 A1 1/2013 Cooper et al.
2013/0035811 A1 2/2013 Schroeck et al.
2013/0062474 A1 3/2013 Baldwin et al.
2013/0131898 A1 5/2013 Kumar et al.
2013/0131909 A1 5/2013 Cooper et al.
2013/0169037 A1 7/2013 Bieg et al.
2013/0171590 A1 7/2013 Kumar
2013/0173083 A1 7/2013 Cooper et al.
2013/0261837 A1 10/2013 Sharma et al.
2013/0261856 A1 10/2013 Sharma et al.
2013/0284859 A1* 10/2013 Polivka ..... B61L 27/0055 246/34 R
2013/0334373 A1 12/2013 Malone, Jr. et al.
2014/0094998 A1 4/2014 Cooper et al.
2014/0129154 A1* 5/2014 Cooper ..... B61L 3/121 702/34
2014/0138493 A1 5/2014 Noffsinger et al.
2014/0156123 A1 6/2014 Cooper et al.
2014/0207317 A1 7/2014 Noffsinger et al.
2014/0277824 A1* 9/2014 Kernwein ..... B61K 9/08 701/1
2014/0280899 A1 9/2014 Brewster, Jr. et al.
2015/0009331 A1 1/2015 Venkatraman
2015/0053827 A1 2/2015 Noffsinger et al.
2015/0183448 A1 7/2015 Cooper et al.

FOREIGN PATENT DOCUMENTS

CA 1065039 A 10/1979
CA 2192151 A1 8/1997
CA 2466540 A1 11/2004
CA 2627074 A1 5/2007
CH 642418 A5 4/1984
CN 1511744 A 7/2004
CN 1528631 A 9/2004
CN 1636814 A 7/2005
CN 1683914 A 10/2005

(56) References Cited

FOREIGN PATENT DOCUMENTS

| | | | | |
|---|---|---|---|---|
| CN | 1819942 | A | 8/2006 | |
| CN | 1906074 | A | 1/2007 | |
| CN | 1958363 | A | 5/2007 | |
| CN | 101351373 | A | 1/2009 | |
| CN | 101412377 | A | 4/2009 | |
| CN | 102556118 | | 6/2014 | |
| DE | 1605862 | A1 | 5/1971 | |
| DE | 129761 | A1 | 2/1978 | |
| DE | 208324 | A1 | 5/1984 | |
| DE | 3538165 | A1 | 4/1987 | |
| DE | 255132 | A1 | 3/1988 | |
| DE | 4225800 | C1 | 11/1993 | |
| DE | 19645426 | A1 | 5/1997 | |
| DE | 19654960 | A1 | 7/1998 | |
| DE | 19731643 | A1 | 9/1998 | |
| DE | 19726542 | A1 | 11/1998 | |
| DE | 19830053 | C1 | 11/1999 | |
| DE | 19826764 | A1 | 12/1999 | |
| DE | 19935349 | A1 | 2/2001 | |
| DE | 19935352 | A1 | 2/2001 | |
| DE | 19935353 | A1 | 2/2001 | |
| DE | 10045921 | A1 | 3/2002 | |
| DE | 10226143 | B4 | 2/2006 | |
| DE | 102005051077 | A1 | 4/2007 | |
| DE | 202010006811 | U1 | 7/2010 | |
| DE | 102010026433 | A1 | 1/2012 | |
| DE | 102010045234 | A1 | 3/2012 | |
| EP | 88716 | A2 | 9/1983 | |
| EP | 114633 | A1 | 8/1984 | |
| EP | 341826 | A2 | 11/1989 | |
| EP | 445047 | A1 | 9/1991 | |
| EP | 467377 | A2 | 1/1992 | |
| EP | 485978 | A1 | 5/1992 | |
| EP | 539885 | A2 | 5/1993 | |
| EP | 554983 | A1 | 8/1993 | |
| EP | 594226 | A2 | 4/1994 | |
| EP | 644098 | A2 | 3/1995 | |
| EP | 719690 | A2 | 7/1996 | |
| EP | 755840 | A1 | 1/1997 | |
| EP | 958987 | A2 | 11/1999 | |
| EP | 1034984 | A2 | 9/2000 | |
| EP | 1143140 | A1 | 10/2001 | |
| EP | 1253059 | A1 | 10/2002 | |
| EP | 1293948 | A2 | 3/2003 | |
| EP | 1297982 | A2 | 4/2003 | |
| EP | 1348854 | A1 | 10/2003 | |
| EP | 1466803 | A1 | 10/2004 | |
| EP | 1562321 | A2 | 8/2005 | |
| EP | 1564395 | A2 | 8/2005 | |
| EP | 1566533 | A1 | 8/2005 | |
| EP | 1697196 | A1 | 9/2006 | |
| EP | 1754644 | A1 | 2/2007 | |
| EP | 1816332 | A1 | 8/2007 | |
| FR | 2129215 | A5 | 10/1972 | |
| FR | 2558806 | A1 | 8/1985 | |
| FR | 2767770 | A1 | 3/1999 | |
| GB | 482625 | A | 4/1938 | |
| GB | 1321053 | A | 6/1973 | |
| GB | 1321054 | A | 6/1973 | |
| GB | 2188464 | A | 9/1987 | |
| GB | 2371121 | A | 7/2002 | |
| GB | 2414816 | A | 12/2005 | |
| JP | 52121192 | A | 10/1977 | |
| JP | 63268405 | A | 11/1988 | |
| JP | 11002558 | A | 4/1989 | |
| JP | 3213459 | A | 9/1991 | |
| JP | 532733 | A | 2/1993 | |
| JP | 561347 | A | 3/1993 | |
| JP | 577734 | A | 3/1993 | |
| JP | 5238392 | A | 9/1993 | |
| JP | 5278615 | A | 10/1993 | |
| JP | 6028153 | A | 2/1994 | |
| JP | 6108869 | A | 4/1994 | |
| JP | 6153327 | A | 5/1994 | |
| JP | 7132832 | A | 5/1995 | |
| JP | 8198102 | A | 8/1996 | |
| JP | 976913 | A | 3/1997 | |
| JP | 9193804 | A | 7/1997 | |
| JP | 9200910 | A | 7/1997 | |
| JP | 10274075 | A | 10/1998 | |
| JP | 2858529 | B2 | 2/1999 | |
| JP | 2001065360 | A | 3/2001 | |
| JP | 2002204507 | A | 7/2002 | |
| JP | 2002-294609 | * | 9/2002 | ..... E01B 35/00 |
| JP | 2002249049 | A | 9/2002 | |
| JP | 2003095109 | A | 4/2003 | |
| JP | 2004301080 | A | 10/2004 | |
| JP | 2004328993 | A | 11/2004 | |
| JP | 2005002802 | A | 1/2005 | |
| JP | 2006219051 | A | 8/2006 | |
| JP | 2006320139 | A | 11/2006 | |
| JP | 2006327551 | A | 12/2006 | |
| JP | 2008535871 | A | 9/2008 | |
| JP | 2009095094 | A | 4/2009 | |
| KZ | 386 | U | 8/2008 | |
| RU | 2115140 | C1 | 7/1998 | |
| RU | 2207279 | C1 | 6/2003 | |
| RU | 2213669 | C1 | 10/2003 | |
| RU | 2233011 | C2 | 7/2004 | |
| RU | 2237589 | C1 | 10/2004 | |
| RU | 2238860 | C1 | 10/2004 | |
| RU | 2238869 | C1 | 10/2004 | |
| RU | 2242392 | C2 | 12/2004 | |
| RU | 2265539 | C2 | 12/2005 | |
| RU | 2272731 | C2 | 3/2006 | |
| RU | 2273567 | C1 | 4/2006 | |
| RU | 2286279 | C2 | 10/2006 | |
| RU | 2299144 | C2 | 5/2007 | |
| RU | 2320498 | C1 | 3/2008 | |
| RU | 83221 | U1 | 5/2009 | |
| SU | 568241 | A1 | 12/1981 | |
| WO | 9003622 | A1 | 4/1990 | |
| WO | 9525053 | A1 | 9/1995 | |
| WO | 9606766 | A1 | 3/1996 | |
| WO | 9858829 | A1 | 12/1998 | |
| WO | 9914090 | A1 | 3/1999 | |
| WO | 9914093 | A1 | 3/1999 | |
| WO | 9960735 | A1 | 11/1999 | |
| WO | 0186139 | A1 | 11/2001 | |
| WO | 03097424 | A1 | 11/2003 | |
| WO | 2004023517 | A1 | 3/2004 | |
| WO | 2004039621 | A1 | 5/2004 | |
| WO | 2004051699 | A2 | 6/2004 | |
| WO | 2004051700 | A2 | 6/2004 | |
| WO | 2004052755 | A1 | 6/2004 | |
| WO | 2004059446 | A2 | 7/2004 | |
| WO | 2005028837 | A2 | 3/2005 | |
| WO | 2005061300 | A1 | 7/2005 | |
| WO | 2006049252 | A1 | 5/2006 | |
| WO | 2006133306 | A1 | 12/2006 | |
| WO | 2007027130 | A1 | 3/2007 | |
| WO | 2007091270 | A2 | 8/2007 | |
| WO | 2007111768 | A2 | 10/2007 | |
| WO | 2007116123 | A1 | 10/2007 | |
| WO | 2008065032 | A1 | 6/2008 | |
| WO | 2008073547 | A2 | 6/2008 | |
| WO | 2009092218 | A1 | 7/2009 | |
| WO | 2010039680 | A1 | 4/2010 | |
| WO | 2010139489 | A1 | 12/2010 | |
| WO | 2012041978 | A2 | 4/2012 | |
| WO | 2014193610 | A1 | 12/2014 | |
| ZA | 200101708 | B | 8/2001 | |

OTHER PUBLICATIONS

Shanthini, M., et al.; "Electromagnetic System for Railroad Track Crack Detection", British Journal of Science, vol. 4, Feb. 2012.

Dick, C., et al.; "Predicting the Occurrence of Broken Rails: A Quantitative Approach", Abstract.

http://ridgetopgroup.actonsoftware.com/acton/rif/2522; Ridgetop Group Announces New Products for Rail Safety Improvements; May 18, 2015; Ridgetop Group Inc.

(56) References Cited

OTHER PUBLICATIONS

U.S. Appl. No. 14/527,246, filed Oct. 29, 2014, Joseph Forrest Noffsinger.
U.S. Appl. No. 61/729,188, filed Nov. 21, 2012, Jared Klineman Cooper.
U.S. Appl. No. 14/679,217, filed Apr. 6, 2015, Joseph Forrest Noffsinger.
U.S. Appl. No. 14/841,209, filed Aug. 31, 2015, Yuri Alexander Plotnikov.
U.S. Appl. No. 15/047,083, filed Feb. 18, 2016, Brett Alexander Matthews.
U.S. Appl. No. 62/161,626, filed May 14, 2015, Joseph Forrest Noffsinger.
Dick et al., "Multivariate Statistical Model for Predicting Occurrence and Location of Broken Rails", Transportation Research Record: Journal of the Transportation Research Board, 1825(1), pp. 48-55, 2003.
Hou et al., "A Rail Damage Detection and Measurement System Using Neural Networks", Computational Intelligence for Measurement Systems and Applications, 2004. CIMSA, pp. 4-9, Jul. 14-16, 2004.
Brawner et al., "Magnetometer Sensor Feasibility for Railroad and Highway Equipment Detection", Innovations Deserving Exploratory Analysis Programs, HSR IDEA Program Final Report; pp. 1-27, Jun. 24, 2006.
Chen et al., "Fault Detection and Diagnosis for Railway Track Circuits Using Neuro-Fuzzy Systems", ScienceDirect Control Engineering Practice, pp. 585-596, May 2008.
Ho, T.K. et al., "Signature Analysis on Wheel-Rail Interaction for Rail Defect Detection", Railway Condition Monitoring, 4th IET International Conference On, pp. 1-6, Jun. 2008.
Schafer II, D. H. "Effect of Train Length on Railroad Accidents and a Quantitative Analysis of Factors Affecting Broken Rails", Thesis, University of Illinois at Urbana-Champaign 2008.
Patra et al., "Availability Analysis of Railway Track Circuit", Proceedings of the Institution of Mechanical Engineers, Part F: Journal of Rail and Rapid Transit, vol. 224 No. 3, pp. 169-177, May 1, 2010.
Kun-Peng et al., "Design of transmission system of real-time broken rail detection", Journal of Railway Science and Engineering, Jan. 2013.
Zhang et al., "Train Detection by Magnetic Field Sensing", Sensors and Materials, vol. 25, Issue No. 6, Feb. 4, pp. 423-436, 2013.
Maldonado et al., "Autonomous Broken Rail Detection Technology for Use on Revenue Service Trains", U.S. Department of Transportation, Federal Railroad Administration, Dec. 2014.
PCT Search Report and Written Opinion issued in connection with Related PCT Application No. PCT/US2013/053124 on Jul. 4, 2014.
PCT Invitation to Pay Additional Fees issued in connection with Related PCT/US2013/053124 on Apr. 2, 2014.
Unofficial English translation of Notice of Allowance issued in connection with related RU Application No. 2008110502 on Jul. 3, 2012.
Final Rejection towards related U.S. Appl. No. 12/365,359 dated Jul. 16, 2012.
Unofficial English translation of Office Action issued in connection with related JP Application No. 2009-540343 on Jul. 17, 2012.
Office Action issued in connection with related JP Application No. 2009-541431 dated on Aug. 14, 2012.
Office Action issued in connection with related AU Application No. 2008322623 dated on Aug. 15, 2012.
Unofficial English translation of Office Action issued in connection with related JP Application No. 2009-540341 on Sep. 11, 2012.
Unofficial English translation of Office Action issued in connection with related CN Application No. 200980112545.9 on Sep. 11, 2012.
Non-Final Rejection towards related U.S. Appl. No. 12/052,816 dated Sep. 12, 2012.
Final Rejection towards related U.S. Appl. No. 12/484,278 dated Sep. 20, 2012.
Non-Final Rejection towards related U.S. Appl. No. 12/556,334 dated Sep. 27, 2012.
Unofficial English translation of Office Action issued in connection with related JP Application No. 2009-540342 on Oct. 2, 2012.
Notice of Allowance issued in connection with related U.S. Appl. No. 11/608,066 dated Oct. 4, 2012.
Non-Final Rejection towards related U.S. Appl. No. 10/736,089 dated Oct. 5, 2012.
Non-Final Rejection towards related U.S. Appl. No. 11/669,364 dated Oct. 17, 2012.
Final Rejection towards related U.S. Appl. No. 12/052,000 dated Oct. 24, 2012.
Unofficial English translation of Office Action issued in connection with related CN Application No. 200780001185.6 on Oct. 29, 2012.
Unofficial English translation of Office Action issued in connection with related CN Application No. 201010584148.6 on Oct. 30, 2012.
Final Rejection towards related U.S. Appl. No. 12/027,408 dated Oct. 31, 2012.
Unofficial English translation of Notice of Allowance issued in connection with related RU Application No. 2008125850 on Oct. 31, 2012.
Non-Final Rejection towards related U.S. Appl. No. 12/061,486 dated Nov. 2, 2012.
Non-Final Rejection towards related U.S. Appl. No. 13/529,783 dated Nov. 7, 2012.
Unofficial English translation of Office Action issued in connection with related CN Application No. 201010584140.X on Nov. 21, 2012.
Notice of Allowance issued in connection with related U.S. Appl. No. 12/484,278 dated Nov. 27, 2012.
Unofficial English translation of Notice of Allowance issued in connection with related RU Application No. 2008108985 on Dec. 4, 2012.
Notice of Allowance issued in connection with related AU Application No. 2007289022 dated Dec. 5, 2012.
Office Action issued in connection with related AU Application No. 2010260419 on Dec. 6, 2012.
Non-Final Rejection towards related U.S. Appl. No. 13/595,474 dated Dec. 11, 2012.
Non-Final Rejection towards related U.S. Appl. No. 12/573,141 dated Dec. 19, 2012.
Unofficial English translation of Notice of Allowance issued in connection with related RU Application No. 2007126476 on Dec. 21, 2012.
Unofficial English translation of Office Action issued in connection with related CN Application No. 200880108755.6 on Dec. 26, 2012.
Non-Final Rejection towards related U.S. Appl. No. 12/270,160 dated Dec. 31, 2012.
Unofficial English translation of Office Action issued in connection with related JP Application No. 2009-530500 on Jan. 8, 2013.
Notice of Allowance issued in connection with related AU Application No. 2007294585 dated Jan. 8, 2013.
Unofficial English translation of Office Action issued in connection with related JP Application No. 2009-540344 on Jan. 22, 2013.
Office Action issued in connection with related MX Application No. MX/a/2008/003359 dated on Jan. 30, 2013.
Final Rejection towards related U.S. Appl. No. 12/061,444 dated Jan. 31, 2013.
International Invitation to Pay Additional Fees issued in connection with related PCT Application No. PCT/US2012/044367 dated Feb. 1, 2013.
Final Rejection towards related U.S. Appl. No. 12/052,816 dated Feb. 5, 2013.
Notice of Allowance issued in connection with related AU Application No. 2007294587 dated Feb. 7, 2013.
Office Action issued in connection with related AU Application No. 2007253963 on Mar. 12, 2011.
Final Rejection towards related U.S. Appl. No. 11/622,136 dated Mar. 13, 2013.
Non-Final Rejection towards related U.S. Appl. No. 13/175,284 dated Mar. 18, 2013.

(56) References Cited

OTHER PUBLICATIONS

Unofficial English translation of Office Action issued in connection with related MX Application No. MX/a/2012/007335 on Mar. 21, 2013.
Office Action issued in connection with related AU Application No. 2010292820 on Mar. 26, 2011.
Office Action issued in connection with related AU Application No. 2007289020 dated on Mar. 27, 2013.
Notice of Allowance issued in connection with related U.S. Appl. No. 13/529,783 dated Mar. 29, 2013.
Notice of Allowance issued in connection with related JP Application No. 2009-541431 dated Apr. 2, 2013.
Notice of Allowance issued in connection with related U.S. Appl. No. 12/556,334 dated Apr. 3, 2013.
Non-Final Rejection towards related U.S. Appl. No. 13/587,966 dated Apr. 5, 2013.
International Search Report and Written Opinion issued in connection with related PCT Application No. PCT/US2012/044367 dated Apr. 9, 2013.
Final Rejection towards related U.S. Appl. No. 11/831,492 dated Apr. 9, 2013.
Non-Final Rejection towards related U.S. Appl. No. 12/365,359 dated Apr. 11, 2013.
Office Action issued in connection with related IN Application No. 3115/DELNP/06 dated on Apr. 16, 2013.
Office Action issued in connection with related AU Application No. 2013202194 on Apr. 17, 2013.
Non-Final Rejection towards related U.S. Appl. No. 12/027,408 dated Apr. 23, 2013.
Unofficial English translation of Office Action issued in connection with related JP Application No. 2009-540343 on Apr. 23, 2013.
Non-Final Rejection towards related U.S. Appl. No. 13/778,428 dated May 8, 2013.
Unofficial English translation of Office Action issued in connection with related JP Application No. 2012-034736 on May 14, 2013.
Notice of Allowance issued in connection with related U.S. Appl. No. 12/605,498 dated May 21, 2013.
Non-Final Rejection towards related U.S. Appl. No. 13/171,712 dated May 22, 2013.
Unofficial English translation of Notice of Allowance issued in connection with related RU Application No. 2008109249 on May 29, 2013.
Office Action issued in connection with related CN Application No. 200780001338.7 dated on Jun. 5, 2013.
Non-Final Rejection towards related U.S. Appl. No. 11/385,354 dated Jun. 17, 2013.
Unofficial English translation of Office Action issued in connection with related JP Application No. 2009-540342 on Jun. 25, 2013.
Unofficial English translation of Office Action issued in connection with related JP Application No. 2009-540341 on Jul. 2, 2013.
Notice of Allowance issued in connection with related U.S. Appl. No. 13/175,284 dated Jul. 8, 2013.
Non-Final Rejection towards related U.S. Appl. No. 12/061,444 dated Aug. 1, 2013.
Non-Final Rejection towards related U.S. Appl. No. 11/831,492 dated Aug. 6, 2013.
Final Rejection towards related U.S. Appl. No. 13/595,474 dated Aug. 14, 2013.
Non-Final Rejection towards related U.S. Appl. No. 13/739,133 dated Aug. 28, 2013.
Non-Final Rejection towards related U.S. Appl. No. 13/488,652 dated Sep. 9, 2013.
Non-Final Rejection towards related U.S. Appl. No. 11/750,716 dated Sep. 10, 2013.
Non-Final Rejection towards related U.S. Appl. No. 13/344,331 dated Sep. 11, 2013.
Non-Final Rejection towards related U.S. Appl. No. 11/622,136 dated Sep. 12, 2013.
European Search Report and Written Opinion issued in connection with related EP Application No. 11187313.9 dated Oct. 22, 2013.
Office Action issued in connection with related AU Application No. 2009225776 dated on Oct. 22, 2013.
European Search Report and Written Opinion issued in connection with related EP Application No. 11187312.1 dated Oct. 23, 2013.
Notice of Allowance issued in connection with related U.S. Appl. No. 11/831,492 dated Oct. 31, 2011.
Final Rejection towards related U.S. Appl. No. 12/270,160 dated Oct. 31, 2013.
Final Rejection towards related U.S. Appl. No. 11/385,354 dated Nov. 5, 2011.
Notice of Allowance issued in connection with related AU Application No. 2010260419 dated Nov. 25, 2013.
Notice of Allowance issued in connection with related U.S. Appl. No. 13/739,133 dated Dec. 11, 2013.
Non-Final Rejection towards related U.S. Appl. No. 13/954,096 dated Dec. 24, 2013.
Office Action issued in connection with related EP Application No. 07716804.5 on Jan. 21, 2014.
Notice of Allowance issued in connection with related U.S. Appl. No. 13/344,331 dated Jan. 23, 2014.
Notice of Allowance issued in connection with related U.S. Appl. No. 12/365,359 dated Jan. 28, 2014.
International Search Report and Written Opinion issued in connection with related PCT Application No. PCT/US2013/054300 dated Feb. 10, 2014.
Non-Final Rejection towards related U.S. Appl. No. 13/778,428 dated Feb. 25, 2014.
Notice of Allowance issued in connection with related AU Application No. 2007289020 dated Mar. 3, 2014.
Non-Final Rejection towards related U.S. Appl. No. 13/653,440 dated Mar. 19, 2014.
Notice of Allowance issued in connection with related U.S. Appl. No. 11/622,136 dated Mar. 27, 2014.
Non-Final Rejection towards related U.S. Appl. No. 13/840,656 dated Apr. 16, 2014.
Unofficial English translation of Office Action issued in connection with related CN Application No. 201210161080.X on Apr. 29, 2014.
Non-Final Rejection towards related U.S. Appl. No. 13/171,712 dated May 8, 2014.
Office Action issued in connection with related CN Application No. 201210258349.6 dated on May 23, 2014.
Knight, "10-4, Good Computer:Automated System Lets Trucks Convoy as One", MIT Technology Review, May 28, 2014.
Unofficial English translation of Office Action issued in connection with related CN Application No. 201080027403.5 on Jun. 13, 2014.
International Search Report and Written Opinion issued in connection with related PCT Application No. PCT/US2013/053128 dated Jun. 23, 2014.
Office Action issued in connection with related AU Application No. 2012261786 dated on Jun. 26, 2014.
Notice of Allowance issued in connection with related U.S. Appl. No. 13/545,271 dated Jun. 26, 2014.
Non-Final Rejection towards related U.S. Appl. No. 12/052,816 dated May 11, 2011.
Unofficial English translation of Office Action issued in connection with related RU Application No. 2010115501 on May 26, 2011.
Non-Final Rejection towards related U.S. Appl. No. 12/061,462 dated Jun. 7, 2011.
Final Rejection towards related U.S. Appl. No. 11/621,221 dated Jun. 22, 2011.
Office Action issued in connection with related AU Application No. 2007253963 dated on Jun. 29, 2011.
Office Action issued in connection with related CN Application No. 200880116895.8 on Jul. 8, 2011.
Office Action issued in connection with related AU Application No. 2007294587 dated on Jul. 8, 2011.
Unofficial English translation of Office Action issued in connection with related MX Application No. Mx/a/2008/003361 on Jul. 13, 2011.
Non-Final Rejection towards related U.S. Appl. No. 12/052,000 dated Jul. 14, 2011.
Non-Final Rejection towards related U.S. Appl. No. 12/047,427 dated Jul. 18, 2011.

(56) References Cited

OTHER PUBLICATIONS

Non-Final Rejection towards related U.S. Appl. No. 12/052,790 dated Aug. 1, 2011.
Unofficial English translation of Office Action issued in connection with related RU Application No. 2008109009 on Aug. 23, 2011.
Final Rejection towards related U.S. Appl. No. 11/385,354 dated Aug. 26, 2011.
Non-Final Rejection towards related U.S. Appl. No. 12/027,408 dated Sep. 13, 2011.
Office Action issued in connection with related AU Application No. 2007294585 dated on Sep. 19, 2011.
Office Action issued in connection with related AU Application No. 2007289021 dated on Sep. 22, 2011.
International Search Report and Written Opinion issued in connection with related PCT Application No. PCT/US2010/045402 dated Sep. 26, 2011.
Non-Final Rejection towards related U.S. Appl. No. 12/270,160 dated Sep. 28, 2011.
Office Action issued in connection with related AU Application No. 2008302642 on Sep. 29, 2011.
Unofficial English translation of Office Action issued in connection with related RU Application No. 2008125850 on Sep. 29, 2011.
Non-Final Rejection towards related U.S. Appl. No. 12/365,359 dated Oct. 6, 2011.
Non-Final Rejection towards related U.S. Appl. No. 12/128,249 dated Oct. 11, 2011.
Unofficial English translation of Office Action issued in connection with related JP Application No. 2009-511134 on Oct. 25, 2011.
Unofficial English translation of Office Action issued in connection with related RU Application No. 2008108985 on Oct. 26, 2011.
Office Action issued in connection with related AU Application No. 2007289022 dated on Oct. 26, 2011.
Unofficial English translation of Office Action issued in connection with related RU Application No. 2008109249 on Oct. 27, 2011.
Unofficial English translation of Office Action issued in connection with related RU Application No. 2008108972 on Oct. 28, 2011.
Unofficial English translation of Office Action issued in connection with related MX Application No. 2007/010174 on Nov. 11, 2011.
Notice of Allowance issued in connection with related AU Application No. 2007333518 dated Nov. 14, 2011.
Final Rejection towards related U.S. Appl. No. 12/061,486 dated Nov. 16, 2011.
Final Rejection towards related U.S. Appl. No. 11/608,257 dated Dec. 2, 2011.
Office Action issued in connection with related CN Application No. 200710306676.3 on Dec. 19, 2011.
Office Action issued in connection with related CN Application No. 200980112545.9 dated on Dec. 29, 2011.
Notice of Allowance issued in connection with related U.S. Appl. No. 12/047,427 dated Dec. 30, 2011.
Pan et al., "Full process control strategy of fuel based on water-coal ratio of ultra supercritical units", Electronics, Communications and Control (ICECC), IEEE International Conference, Guangzhou, China, pp. 3750-3753, 2011.
Non-Final Rejection towards U.S. Appl. No. 12/126,858 dated Jan. 18, 2012.
Office Action issued in connection with related RU Application No. 2008124977 dated on Jan. 20, 2012.
Non-Final Rejection towards related U.S. Appl. No. 12/061,444 dated Jan. 31, 2012.
Non-Final Rejection towards related U.S. Appl. No. 11/622,136 dated Feb. 27, 2012.
Office Action issued in connection with related CN Application No. 200980119041.X dated on Feb. 29, 2012.
Unofficial English translation of Office Action issued in connection with related JP Application No. 2009-530500 on Apr. 3, 2012.
Non-Final Rejection towards related U.S. Appl. No. 12/061,486 dated Apr. 4, 2012.
Final Rejection towards related U.S. Appl. No. 12/270,160 dated Apr. 4, 2012.
Non-Final Rejection towards related U.S. Appl. No. 12/484,278 dated Apr. 5, 2012.
Notice of Allowance issued in connection with related AU Application No. 2008302642 dated May 10, 2012.
Final Rejection towards related U.S. Appl. No. 12/128,249 dated May 15, 2012.
Notice of Allowance issued in connection with related RU Application No. 2008108972 dated May 16, 2012.
Notice of Allowance issued in connection with related U.S. Appl. No. 12/052,790 dated Jun. 13, 2012.
Notice of Allowance issued in connection with related U.S. Appl. No. 12/126,858 dated Jun. 18, 2012.
Unofficial English translation of Notice of Allowance issued in connection with related RU Application No. 2008124977 on Jun. 22, 2012.
European Search Report and Written Opinion issued in connection with related EP Application No. 16170151.1 dated Oct. 21, 2016.
Notice of Allowance issued in connection with related U.S. Appl. No. 14/679,217 dated Oct. 24, 2016.
Office Action issued in connection with related IN Application No. 1184/CHENP/2008 dated on Oct. 27, 2016.
Notice of Allowance issued in connection with related U.S. Appl. No. 14/457,304 dated Oct. 28, 2016.
Office Action issued in connection with related IN Application No. 1181/CHENP/2008 on Nov. 1, 2016.
Office Action issued in connection with related IN Application No. 1182/CHENP/2008 dated on Nov. 4, 2016.
Unofficial English translation of Office Action issued in connection with related CN Application No. 201210356915.7 on Dec. 2, 2016.
Office Action issued in connection with related AU Application No. 2015207963 on Dec. 13, 2016.
Notice of Allowance issued in connection with related JP Application No. 2009-501417 dated Jul. 15, 2014.
Notice of Allowance issued in connection with related U.S. Appl. No. 13/595,474 dated Aug. 5, 2014.
Non-Final Rejection towards related U.S. Appl. No. 12/573,141 dated Aug. 29, 2014.
Final Rejection towards related U.S. Appl. No. 13/778,428 dated Sep. 9, 2014.
Non-Final Rejection towards related U.S. Appl. No. 13/618,970 dated Sep. 9, 2014.
Non-Final Rejection towards related U.S. Appl. No. 14/095,373 dated Sep. 16, 2014.
Non-Final Rejection towards related U.S. Appl. No. 13/565,571 dated Oct. 2, 2014.
Unofficial English translation of Notice of allowance issued in connection with related KZ Application No. 2013/1558.1 on Nov. 6, 2014.
Notice of Allowance issued in connection with related U.S. Appl. No. 13/618,970 dated Nov. 19, 2014.
Notice of Allowance issued in connection with related AU Application No. 2010292820 dated Nov. 19, 2014.
Non-Final Rejection towards related U.S. Appl. No. 13/591,561 dated Feb. 13, 2015.
Final Rejection towards related U.S. Appl. No. 12/573,141 dated Mar. 10, 2015.
Non-Final Rejection towards related U.S. Appl. No. 13/171,712 dated Mar. 10, 2015.
Non-Final Rejection towards related U.S. Appl. No. 14/489,126 dated Apr. 9, 2015.
Non-Final Rejection towards related U.S. Appl. No. 11/669,364 dated Apr. 23, 2015.
Notice of Allowance issued in connection with related U.S. Appl. No. 13/653,440 dated Apr. 30, 2015.
Office Action issued in connection with related AU Application No. 2013206474 dated on May 6, 2015.
Final Rejection towards related U.S. Appl. No. 13/591,561 dated Jun. 11, 2015.
Office Action issued in connection with related JP Application No. 2012-034736 dated on Jun. 16, 2015.
Non-Final Rejection towards related U.S. Appl. No. 14/491,339 dated Jun. 17, 2015.

(56) References Cited

OTHER PUBLICATIONS

Non-Final Rejection towards related U.S. Appl. No. 14/221,624 dated Jun. 19, 2015.
Notice of Allowance issued in connection with related U.S. Appl. No. 14/489,126 dated Jun. 24, 2015.
Notice of Allowance issued in connection with related U.S. Appl. No. 11/669,364 dated Sep. 17, 2015.
Non-Final Rejection towards related U.S. Appl. No. 13/939,326 dated Oct. 9, 2015.
Office Action issued in connection with related EP Application No. 11187312.1 on Oct. 15, 2015.
Office Action issued in connection with related EP Application No. 11187313.9 on Oct. 15, 2015.
Non-Final Rejection towards related U.S. Appl. No. 14/457,304 dated Oct. 22, 2015.
Sperry, "Sperry B-Scan Single Rail Walking Sticks", Informational pamphlet, Oct. 26, 2015.
Non-Final Rejection towards related U.S. Appl. No. 14/696,124 dated Dec. 23, 2015.
Eurasia Search Report and Written Opinion issued in connection with related EA Application No. 201591274 lated Jan. 21, 2016.
Unofficial English translation of Office Action issued in connection with related CN Application No. 201380071077.1 on Feb. 6, 2016.
Office Action issued in connection with related IN Application No. 4662/DELNP/2007 dated on Feb. 29, 2016.
Office Action issued in connection with related AU Application No. 2015200168 on Mar. 2, 2016.
Notice of Allowance issued in connection with related U.S. Appl. No. 13/591,561 dated Mar. 3, 2016.
Unofficial English translation of Office Action issued in connection with related RU Application No. 2012124894 on Mar. 9, 2016.
Unofficial English translation of Office Action issued in connection with related CN Application No. 201310220043.6 on Mar. 14, 2016.
Office Action issued in connection with related CN Application No. 201210356915.7 dated on Mar. 23, 2016.
Eurasia Search Report and Written Opinion issued in connection with related EA Application No. 201591504 dated Apr. 6, 2016.
Final Rejection towards related U.S. Appl. No. 14/679,217 dated Apr. 15, 2016.
Office Action issued in connection with related AU Application No. 2015205877 on Apr. 15, 2016.
Non-Final Rejection towards related U.S. Appl. No. 14/457,304 dated May 5, 2016.
Non-Final Rejection towards related U.S. Appl. No. 14/637,513 dated May 19, 2016.
Office Action issued in connection with related EP Application No. 08832181.5 on Jun. 14, 2016.
International Search Report and Written Opinion issued in connection with related PCT Application No. PCT/US2016/021925 dated Jun. 23, 2016.
Non-Final Rejection towards related U.S. Appl. No. 14/933,659 dated Jun. 30, 2016.
Office Action issued in connection with related AU Application No. 2013216630 on Aug. 4, 2016.
Unofficial English translation of Notice of Allowance issued in connection with related RU Application No. 2012124894 on Aug. 5, 2016.
Office Action issued in connection with related AU Application No. 2013299945 on Aug. 8, 2016.
International Search Report and Written Opinion issued in connection with related PCT Application No. PCT/US2016/031444 dated Aug. 24, 2016.
Office Action issued in connection with related AU Application No. 2013299501 on Oct. 7, 2016.
Ghanbari et al., "Artificial Neural Networks and regression approaches comparison for forecasting Iran's annual electricity load", Power Engineering, Energy and Electrical Devices, Powering, pp. 675-679, Mar. 18-20, 2009.
Unofficial English translation of Office Action issued in connection with related CN Application No. 200480040639.7 on Apr. 17, 2009.
International Invitation to Pay Additional Fees issued in connection with related PCT Application No. PCT/US2009/031740 dated Apr. 17, 2009.
International Search Report and Written Opinion issued in connection with related PCT Application No. PCT/US2009/031740 dated Jun. 15, 2009.
Office Action issued in connection with related CA Application No. 2454739 dated on Jul. 20, 2009.
International Search Report and Written Opinion issued in connection with related PCT Application No. PCT/US2009/045004 dated Aug. 13, 2009.
International Search Report and Written Opinion issued in connection with related PCT Application No. PCT/US2009/032933 dated Nov. 3, 2009.
Unofficial English translation of Office Action issued in connection with related MX Application No. 2007/010174 on Nov. 6, 2009.
Office Action issued in connection with related EP Application No. 07814412.8 on Dec. 3, 2009.
Non-Final Rejection towards related U.S. Appl. No. 11/622,136 dated Dec. 31, 2009.
Xin-Yu et al., "The Research on the Mechanism of Limiting Speed Pick-Up and Set-Out Train on Railway Transportation Capacity Loss", Second International Conference on Intelligent Computation Technology and Automation, Changsha, China, vol. No. 3, pp. 830-833, 2009.
Non-Final Rejection towards related U.S. Appl. No. 11/671,533 dated Mar. 2, 2010.
Office Action issued in connection with related EP Application No. 07716804.5 dated on Mar. 17, 2010.
International Invitation to Pay Additional Fees issued in connection with related PCT Application No. PCT/US2009/037293 dated Mar. 18, 2010.
Non-Final Rejection towards related U.S. Appl. No. 12/052,782 dated Mar. 26, 2010.
Non-Final Rejection towards related U.S. Appl. No. 11/385,354 dated Apr. 19, 2010.
International Search Report and Written Opinion issued in connection with related PCT Application No. PCT/US2009/037293 dated May 10, 2010.
Unofficial English translation of Office Action issued in connection with related MX Application No. 2007/010174 on Jul. 9, 2010.
Office Action issued in connection with related AU Application No. 2007333518 on Aug. 9, 2010.
Unofficial English translation of Office Action issued in connection with related CN Application No. 200780001338.7 on Aug. 12, 2010.
International Search Report and Written Opinion issued in connection with related PCT Application No. PCT/US2010/035058 dated Aug. 20, 2010.
Unofficial English translation of Office Action issued in connection with related CN Application No. 200780001327.9 on Aug. 26, 2010.
Non-Final Rejection towards related U.S. Appl. No. 10/736,089 dated Sep. 2, 2010.
Non-Final Rejection towards related U.S. Appl. No. 11/669,364 dated Sep. 23, 2010.
Unofficial English translation of Office Action issued in connection with related MX Application No. 2008/003822 on Sep. 24, 2010.
Unofficial English translation of Office Action issued in connection with related CN Application No. 200780001166.3 on Sep. 30, 2010.
Office Action issued in connection with related CN Application No. 200780001444.5 dated on Sep. 30, 2010.
Office Action issued in connection with related CN Application No. 200780001185.6 dated on Oct. 27, 2010.
Non-Final Rejection towards related U.S. Appl. No. 11/621,221 dated Nov. 19, 2010.
Non-Final Rejection towards related U.S. Appl. No. 11/750,716 dated Dec. 17, 2010.
Non-Final Rejection towards related U.S. Appl. No. 11/385,354 dated Dec. 29, 2010.
Xiaogang et al., "The Research and Application of 1089 t/h Circulating Fluidized Bed Unit Coordinate Control System", International Conference on E-Product E-Service and E-Entertainment (ICEEE), China, 2010.

(56) References Cited

OTHER PUBLICATIONS

Xun et al., "The analysis of GSM-R redundant network and reliability models on high-speed railway", International conference on Electronics and Information Engineering (ICEIE), Beijing, China, vol. No. 2, pp. V2-154-V2-158, 2010.
Non-Final Rejection towards related U.S. Appl. No. 11/608,066 dated Jan. 19, 2011.
International Search Report and Written Opinion issued in connection with related PCT Application No. PCT/US2010/048856 dated Feb. 8, 2011.
Notice of Allowance issued in connection with related U.S. Appl. No. 11/671,533 dated Feb. 14, 2011.
International Invitation to Pay Additional Fees issued in connection with related PCT Application No. PCT/US2010/047251 dated Mar. 4, 2011.
Unofficial English translation of Office Action issued in connection with related MX Application No. 2008/003822 on Mar. 7, 2011.
Unofficial English translation of Office Action issued in connection with related RU Application No. 2008110502 on Mar. 10, 2011.
Non-Final Rejection towards related U.S. Appl. No. 11/765,443 dated Mar. 16, 2011.
Office Action issued in connection with related AU Application No. 2007202928 dated on Mar. 29, 2011.
Non-Final Rejection towards related U.S. Appl. No. 12/061,486 dated Apr. 1, 2011.
Unofficial English translation of Office Action issued in connection with related MX Application No. MX/a/2008/003365 on Apr. 7, 2011.
Office Action issued in connection with related RU Application No. 2008108972 on Apr. 8, 2011.
Unofficial English translation of Office Action issued in connection with related RU Application No. 2007126476 on Apr. 11, 2011.
Office Action issued in connection with related MX Application No. 2008/0003821 dated on Apr. 18, 2011.
Unofficial English translation of Office Action issued in connection with related CN Application No. 200780001345.7 on Apr. 20, 2011.
International Search Report and Written Opinion issued in connection with related PCT Application No. PCT/US2010/047251 dated Apr. 26, 2011.
Non-Final Rejection towards related U.S. Appl. No. 12/045,633 dated Apr. 28, 2011.
Non-Final Rejection towards related U.S. Appl. No. 11/831,492 dated May 3, 2011.
Krevitt, "Remote Maintenance Techniques Proposed for the 200-BEV Accelerator", IEEE Transactions on Nuclear Science, vol. No. 14, Issue No. 3, pp. 997-1003, Jun. 1967.
Kiersztyn et al., "Evaluation of Locomotive Cable Insulation Life Under Varying Temperature Loading", IEEE Transactions on Industry Applications, vol. No. IA-21, Issue No. 4, pp. 882-888, Jul./Aug. 1985.
Hoyt et al., "Assessing the effects of several variables on freight train fuel consumption and performance using a train performance simulator", Transportation Research, vol. No. 24A, Issue No. 2, pp. 99-112, Jan. 1, 1990.
Hooper, "Reducing Rail Costs through Innovative Methods", Railway Track and Structures, pp. 14-17, Jul. 1993.
Grizzle et al., "Improved Cylinder Air Charge Estimation for Transient Air Fuel Ratio Control", Proceedings of the American Control Conference, Maryland, vol. No. 2, pp. 1568-1573, Jun. 29, 1994.
Grabs, "Konflikterkennung Und—Losung Fur Dispositive Aufgaben in Betriebszentralen", vol. No. 87, Issue No. 7/08, pp. 254-258, Jul. 1, 1995.
Chiang et al., "Cycle Detection in Repair-Based Railway Scheduling System," Robotics and Automation, IEEE International Conference on Minneapolis, New York, USA, vol. No. 3, pp. 2517-2522, Apr. 22, 1996.
Bonissone et al., "Genetic algorithms for automated tuning of fuzzy controllers: A transportation application", Proceedings of the Fifth IEEE International Conference on Fuzzy Systems, Schenectady, NY, USA, vol. No. 1, pp. 674-680, 1996.
Cheng, "Hybrid Simulation for Resolving Resource Conflicts in Train Traffic Rescheduling", Computers in Industry, vol. No. 35, Issue No. 3, pp. 233-246, Apr. 1, 1998.
Razouqi et al., Rynsord: A Novel, Decentralized Algorithm for Railway Networks with 'Soft Reservation,' VTC, 48th IEEE Ottawa, Canada, New York, USA, pp. 2585-2589, vol. No. 3, May 18-21, 1998.
Ehsani et al., "Application of electrically peaking hybrid (ELPH) propulsion system to a full-size passenger car with simulated design verification", IEEE Transactions on Vehicular Technology, vol. No. 48, Issue No. 6, pp. 1779-1787, Nov. 1999.
Cheng et al., "Algorithms on Optimal Driving Strategies for Train Control Problem", Proceedings of the 3rd World Congress on Intelligent Control and Automation, pp. 3523-3527, Jun. 28-Jul. 2, 2000.
He et al., "On-line Parameter Identification for Freight Train Systems", Aug. 29, 2000.
Franke et al., "An algorithm for the optimal control of the driving of trains", Proceedings of the 39th IEEE Conference on Decision and Control, Sydney Australia, pp. 2123-2127, Dec. 2000.
Coleman, "A System for long haul Optimal Driver Advice", Session 5b: Capacity Planning & Train Scheduling, pp. 5.61-5.69, 2003.
Doe, "21st Century Locomotive Technology-Quarterly Technical Status Report 6", Report No. DOE-AL68284-TSR06, pp. 1-6, Apr. to Jun. 2004.
Bosch, "Technology explained: the Common Rail diesel injection system", May 2004.
Salasoo, "Heavy vehicle systems optimization program: FY 2004 Annual Report" Section VIII.A. "21st Century Locomotive Technology" pp. 156-163 2004.
International Search Report and Written Opinion issued in connection with related PCT Application No. US2004/020910 dated Dec. 2, 2004.
Doe, "21st Century Locomotive Technology, Quarterly Technical Status Report 11", Report No. DOE-AL68284-TSR11, pp. 1-8, Jul. 2005 to Sep. 2005.
Chan et al., "Trip Optimizer System Description (Rev. 1.1)", Trip Optimizer for Freight Trains Functional Description, pp. 1-24, Nov. 16, 2005.
Non-Final Rejection towards related U.S. Appl. No. 10/736,089 dated Feb. 13, 2006.
Ditmeyer, "Network Centric Railroading Utilizing Intelligent Railroad Systems", World Bank Transport Forum Rail Transport for Development, pp. 1-21, Mar. 31, 2006.
King, "DOE heavy vehicle systems optimization (peer review): 21st Century Locomotive Technology", pp. 20, Apr. 2006.
Non-Final Rejection towards related U.S. Appl. No. 11/385,354 dated May 23, 2007.
International Invitation to Pay Additional Fees issued in connection with related PCT Application No. PCT/US2007/001428 dated Jun. 25, 2007.
International Invitation to Pay Additional Fees issued in connection with related PCT Application No. PCT/US2007/066697 dated Sep. 21, 2007.
International Search Report and Written Opinion issued in connection with related PCT Application No. PCT/US2007/066697 dated Dec. 3, 2007.
International Search Report and Written Opinion issued in connection with related PCT Application No. PCT/US2006/032893 dated Feb. 20, 2008.
International Search Report and Written Opinion issued in connection with related PCT Application No. PCT/US2007/001428 dated Feb. 25, 2008.
International Invitation to Pay Additional Fees issued in connection with related PCT Application No. PCT/US2007/078001 dated Mar. 13, 2008.
International Invitation to Pay Additional Fees issued in connection with related PCT Application No. PCT/US2007/078016 dated Mar. 20, 2008.

(56) References Cited

OTHER PUBLICATIONS

International Invitation to Pay Additional Fees issued in connection with related PCT Application No. PCT/US2007/076699 dated Mar. 20, 2008.
International Invitation to Pay Additional Fees issued in connection with related PCT Application No. PCT/US2007/078026 dated Apr. 8, 2008.
International Invitation to Pay Additional Fees issued in connection with related PCT Application No. PCT/US2007/078340 dated Apr. 8, 2008.
International Search Report and Written Opinion issued in connection with related PCT Application No. PCT/US2007/076699 dated Jun. 17, 2008.
International Search Report and Written Opinion issued in connection with related PCT Application No. PCT/US2007/078001 dated Jun. 17, 2008.
International Search Report and Written Opinion issued in connection with related PCT Application No. PCT/US2007/078016 dated Jun. 17, 2008.
International Search Report and Written Opinion issued in connection with related PCT Application No. PCT/US2007/078340 dated Jun. 18, 2008.
Non-Final Rejection towards related U.S. Appl. No. 11/858,345 dated Jun. 20, 2008.
International Search Report and Written Opinion issued in connection with related PCT Application No. PCT/US2007/078026 dated Jul. 7, 2008.
International Search Report and Written Opinion issued in connection with related PCT Application No. PCT/US2008/063193 dated Aug. 21, 2008.
International Search Report and Written Opinion issued in connection with related PCT Application No. PCT/US2007/001428 dated Sep. 12, 2008.
International Search Report and Written Opinion issued in connection with related PCT Application No. PCT/US2007/078118 dated Oct. 7, 2008.
Non-Final Rejection towards related U.S. Appl. No. 11/858,345 dated Nov. 19, 2008.
Final Rejection towards related U.S. Appl. No. 10/736,089 dated Dec. 12, 2008.
Unofficial English translation of Notice of Allowance issued in connection with related RU Application No. 2006125429 on Dec. 22, 2008.
International Search Report and Written Opinion issued in connection with related PCT Application No. PCT/US2008/071958 dated Dec. 30, 2008.
International Search Report and Written Opinion issued in connection with related PCT Application No. PCT/US2008/083526 dated Feb. 2, 2009.
Non-Final Rejection towards related U.S. Appl. No. 11/858,345 dated Mar. 6, 2009.

* cited by examiner

ROUTE EXAMINATION SYSTEM AND METHOD

CROSS-REFERENCE TO RELATED APPLICATIONS

This application is a continuation-in-part of and claims priority to U.S. application Ser. No. 14/527,246, filed 29 Oct. 2014 (the "'246 application"), which is a continuation-in-part of and claims priority to U.S. application Ser. No. 14/016,310, filed 3 Sep. 2013 (the "'310 application"), now U.S. Pat. No. 8,914,171 issued 16 Dec. 2014, which claims priority to U.S. Provisional Application No. 61/729,188, filed 21 Nov. 2012 (the "'188 application"). The entire disclosures of the '188 application, the '310 application, and the '246 application are incorporated herein by reference.

FIELD

Embodiments of the subject matter disclosed herein relate to examining routes traveled by vehicles.

BACKGROUND

Routes that are traveled by vehicles may become damaged over time with extended use. For example, tracks on which rail vehicles travel may become damaged and/or broken. A variety of known systems are used to examine rail tracks to identify where the damaged and/or broken portions of the track are located. For example, some systems use cameras, lasers, and the like, to optically detect breaks and damage to the tracks. The cameras and lasers may be mounted on the rail vehicles, but the accuracy of the cameras and lasers may be limited by the speed at which the rail vehicles move during inspection of the route. As a result, the cameras and lasers may not be able to be used during regular operation (e.g., travel) of the rail vehicles in revenue service.

Other systems use ultrasonic transducers that are placed at or near the tracks to ultrasonically inspect the tracks. These systems may require very slow movement of the transducers relative to the tracks in order to detect damage to the track. When a suspect location is found by an ultrasonic inspection vehicle, a follow-up manual inspection may be required for confirmation of defects using transducers that are manually positioned and moved along the track and/or are moved along the track by a relatively slower moving inspection vehicle. Inspections of the track can take a considerable amount of time, during which the inspected section of the route may be unusable by regular route traffic.

Other systems use human inspectors who move along the track to inspect for broken and/or damaged sections of track. This manual inspection is slow and prone to errors.

Other systems use wayside devices that send electric signals through the tracks. If the signals are not received by other wayside devices, then a circuit that includes the track is identified as being open and the track is considered to be broken. These systems are limited at least in that the wayside devices are immobile. As a result, the systems cannot inspect large spans of track and/or a large number of devices must be installed in order to inspect the large spans of track. These systems are also limited at least in that a single circuit could stretch for multiple miles. As a result, if the track is identified as being open and is considered broken, it is difficult and time-consuming to locate the exact location of the break within the long circuit. For example, a maintainer must patrol the length of the circuit to locate the problem.

These systems are also limited at least in that other track features, such as highway (e.g., hard wire) crossing shunts, wide band (e.g., capacitors) crossing shunts, narrow band (e.g., tuned) crossing shunts, switches, insulated joints, and turnouts (e.g., track switches) may emulate the signal response expected from a broken rail and provide a false alarm. For example, scrap metal on the track, crossing shunts, etc., may short the rails together, preventing the current from traversing the length of the circuit, indicating that the circuit is open. Additionally, insulated joints and/or turnouts may include intentional conductive breaks that create an open circuit. In response, the system may identify a potentially broken section of track, and a person or machine may be dispatched to patrol the circuit to locate the break, even if the detected break is a false alarm (e.g., not a break in the track). A need remains to reduce the probability of false alarms to make route maintenance more efficient.

Some vehicles travel with the aid of positioning systems, such as global positioning system (GPS) receivers. These systems can locate where the vehicles are positioned along a route. Some routes, such as rail tracks, may be positioned relatively close together. These routes may be sufficiently close to one another that the positioning system of a vehicle is unable to determine which of two or more routes that the vehicle is located on. As a result, the positioning system may be unable to correctly identify which of several routes that the vehicle is traveling along.

BRIEF DESCRIPTION

In one embodiment, a method (e.g., for examining a route) includes automatically detecting (with an identification unit onboard a vehicle having one or more processors) a location of a break in conductivity of a first route during movement of the vehicle along the first route and identifying (with the identification unit) one or more of a location of the vehicle on the first route or the first route from among several different routes based at least in part on the location of the break in the conductivity of the first route that is detected.

In another embodiment, a system (e.g., a route examination system) includes an identification unit having one or more processors configured to detect a location of a break in conductivity of a first route from onboard a vehicle during movement of the vehicle along the first route. The identification unit also is configured to identify one or more of a location of the vehicle on the first route or the first route from among several different routes based at least in part on the location of the break in the conductivity of the first route that is detected.

In another embodiment, a system (e.g., a route examination system) includes a detection unit and an identification unit. The detection unit can be configured to be disposed onboard a vehicle system and to detect a change in an electrical characteristic of a first route being traveled upon by the vehicle system. The identification unit can be configured to be disposed onboard the vehicle system and to identify one or more of the first route from among several different routes or where the vehicle system is located along the first route based at least in part on the change in the electrical characteristic that is detected.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
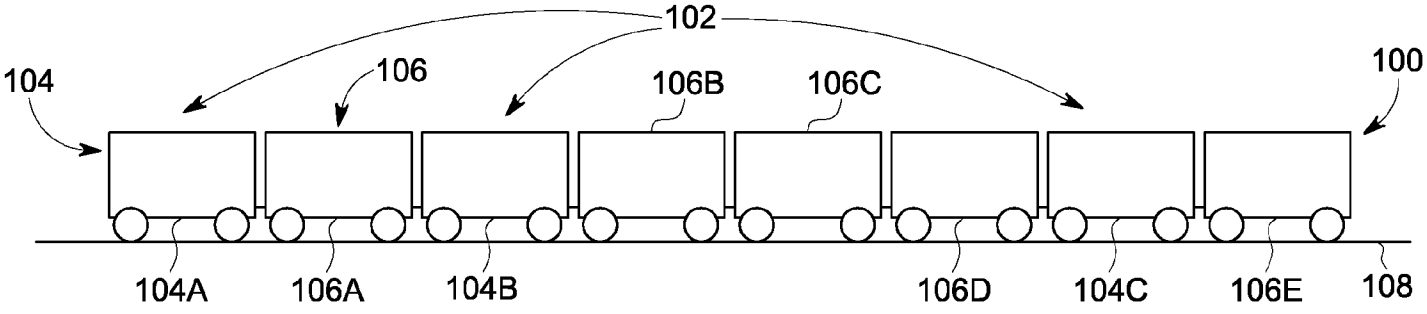
FIG. 1 is a schematic illustration of a vehicle system that includes an embodiment of a route examination.

Some embodiments of the subject matter described herein relate to methods and systems for examining a route being traveled by a vehicle in order to identify the route being traveled by the vehicle system. The vehicle optionally may be referred to as a vehicle system, or a vehicle system may include two or more vehicles traveling together. A route examination system onboard the vehicle or vehicle system may examine the route by injecting an electrical signal into the route from the vehicle system as the vehicle system travels along the route. The route can form part of a conductive circuit with the signal being at least partially conducted through conductive segments of the route that form part of the circuit. The examination can monitor an electrical characteristic of the route (e.g., voltage, resistance, current, resistivity, or the like) responsive to injecting the signal into the route. Based at least in part on the electrical characteristic, the examination can determine if the injected signal was or was not conducted through the route. If the injected signal was not conducted through the route or a relatively small portion of the signal was conducted, then the examination may identify an open circuit. This open circuit can indicate a break in the route (e.g., damage to a conductive portion of the route that opens the circuit) and/or the presence of an insulated joint between conductive segments of the route. For example, rails of a track may be formed from elongated conductive segments joined together by insulated, non-conducting bodies (referred to as insulated joints). The injected signal may not be able to be conducted between conductive segments joined together by the insulated joint. As a result, the open circuit detected by the examination may indicate the presence of an insulated joint in the circuit formed at least in part by the route. The examination may identify locations of the insulated joints in the route and, based on known, designated locations of the insulated joints, determine which route of several different routes that the vehicle or vehicle system is traveling along.

One or more other embodiments described herein relate to methods and systems for examining a route being traveled upon by a vehicle or vehicle system in order to identify potential sections of the route that are damaged or broken. In an embodiment, the vehicle system may examine the route by injecting an electrical signal into the route from a first vehicle in the vehicle system as the vehicle system travels along the route and monitoring the route at another, second vehicle that also is in the vehicle system. Detection of the signal at the second vehicle and/or detection of changes in the signal at the second vehicle may indicate a potentially damaged (e.g., broken or partially broken) section of the route between the first and second vehicles. In an embodiment, the route may be a track of a rail vehicle system and the first and second vehicle may be used to identify a broken or partially broken section of one or more rails of the track. The electrical signal that is injected into the route may be powered by an onboard energy storage device, such as one or more batteries, and/or an off-board energy source, such as a catenary and/or electrified rail of the route. When the damaged section of the route is identified, one or more responsive actions may be initiated. For example, the vehicle system may automatically slow down or stop. As another example, a warning signal may be communicated (e.g., transmitted or broadcast) to one or more other vehicle systems to warn the other vehicle systems of the damaged section of the route, to one or more wayside devices disposed at or near the route so that the wayside devices can communicate the warning signals to one or more other vehicle systems. In another example, the warning signal may be communicated to an off-board facility that can arrange for the repair and/or further examination of the damaged section of the route.

The terms "vehicle" or "vehicle system" as used herein can be defined as a mobile machine that transports at least one of a person, people, or a cargo. For instance, a vehicle or vehicle system can be, but is not limited to being, a rail car, an intermodal container, a locomotive, a marine vessel, mining equipment, construction equipment, an automobile, and the like. A "vehicle system" includes two or more vehicles that are interconnected with each other to travel along a route. For example, a vehicle system can include two or more vehicles that are directly connected to each other (e.g., by a coupler) or that are indirectly connected with each other (e.g., by one or more other vehicles and couplers). A vehicle system can be referred to as a consist, such as a rail vehicle consist.

"Software" or "computer program" as used herein includes, but is not limited to, one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, an application, instructions stored in a memory, part of an operating system or other type of executable instructions. "Computer" or "processing element" or "computer device" as used herein includes, but is not limited to, any programmed or programmable electronic device that can store, retrieve, and process data. "Non-transitory computer-readable media" include, but are not limited to, a CD-ROM, a removable flash memory card, a hard disk drive, a magnetic tape, and a floppy disk. "Computer memory", as used herein, refers to a storage device configured to store digital data or information which can be retrieved by a computer or processing element. "Controller," "unit," and/or "module," as used herein, can to the logic circuitry and/or processing elements and associated software or program involved in controlling an energy storage system. The terms "signal", "data", and "information" may be used interchangeably herein and may refer to digital or analog forms.

FIG. 1 is a schematic illustration of a vehicle system 100 that includes an embodiment of a route examination system 102. The vehicle system 100 includes several vehicles 104, 106 that are mechanically connected with each other to travel along a route 108. The vehicles 104 (e.g., the vehicles 104A-C) represent propulsion-generating vehicles, such as vehicles that generate tractive effort or power in order to propel the vehicle system 100 along the route 108. In an embodiment, the vehicles 104 can represent rail vehicles such as locomotives. The vehicles 106 (e.g., the vehicles 106A-E) represent non-propulsion generating vehicles, such as vehicles that do not generate tractive effort or power. In an embodiment, the vehicles 106 can represent rail cars. Alternatively, the vehicles 104, 106 may represent other types of vehicles. In another embodiment, one or more of the individual vehicles 104 and/or 106 represent a group of vehicles, such as a consist of locomotives or other vehicles.

The route 108 can be a body, surface, or medium on which the vehicle system 100 travels. In an embodiment, the route 108 can include or represent a body that is capable of conveying a signal between vehicles in the vehicle system 100, such as a conductive body capable of conveying an electrical signal (e.g., a direct current, alternating current, radio frequency, or other signal).

The examination system 102 can be distributed between or among two or more vehicles 104, 106 of the vehicle system 100. For example, the examination system 102 may include two or more components that operate to identify potentially damaged sections of the route 108, with at least one component disposed on each of two different vehicles 104, 106 in the same vehicle system 100. In the illustrated embodiment, the examination system 102 is distributed between or among two different vehicles 104. For example, the examination system 102 has components disposed onboard at least two of the propulsion-generating vehicles 104A, 104B, 104C. Additionally or alternatively, the examination system 102 may include components disposed onboard at least one of the non-propulsion generating vehicles 106. For example, the examination system 102 may be located onboard two or more propulsion-generating vehicles 104, two or more non-propulsion generating vehicles 106, or at least one propulsion-generating vehicle 104 and at least one non-propulsion generating vehicle 106.

Alternatively, the examination system 102 may be distributed among three or more vehicles 104, 106. Additionally or alternatively, the examination system 102 may be distributed between one or more vehicles 104 and one or more vehicles 106, and is not limited to being disposed onboard a single type of vehicle 104 or 106. As described below, in another embodiment, the examination system 102 may be distributed between a vehicle in the vehicle system and an off-board monitoring location, such as a wayside device. Alternatively, the examination system 102 may be disposed onboard a single vehicle of the vehicle system.

In operation, the vehicle system 100 travels along the route 108. A first vehicle 104 electrically injects an examination signal into the route 108. For example, the first vehicle 104A may apply a direct current, alternating current, radio frequency signal, or the like, to the route 108 as an examination signal. The examination signal propagates through or along the route 108. A second vehicle 104B or 104C may monitor one or more electrical characteristics of the route 108 when the examination signal is injected into the route 108.

In operation, during travel of the vehicle system 100 along the route 108, the examination system 102 electrically injects an examination signal into the route 108 at a first vehicle 104 or 106 (e.g., beneath the footprint of the first vehicle 104 or 106). For example, an onboard or off-board power source may be controlled to apply a direct current, alternating current, RF signal, or the like, to a track of the route 108. The examination system 102 monitors electrical characteristics of the route 108 at a second vehicle 104 or 106 of the same vehicle system 100 (e.g., beneath the footprint of the second vehicle 104 or 106) in order to determine if the examination signal is detected in the route 108. For example, the voltage, current, resistance, impedance, or other electrical characteristic of the route 108 may be monitored at the second vehicle 104, 106 in order to determine if the examination signal is detected and/or if the examination signal has been altered. If the portion of the route 108 between the first and second vehicles conducts the examination signal to the second vehicle, then the examination signal may be detected by the examination system 102. The examination system 102 may determine that the route 108 (e.g., the portion of the route 108 through which the examination signal propagated) is intact and/or not damaged.

On the other hand, if the portion of the route 108 between the first and second vehicles does not conduct the examination signal to the second vehicle (e.g., such that the examination signal is not detected in the route 108 at the second vehicle), then the examination signal may not be detected by the examination system 102. The examination system 102 may determine that the route 108 (e.g., the portion of the route 108 disposed between the first and second vehicles during the time period that the examination signal is expected or calculated to propagate through the route 108) is not intact and/or is damaged. For example, the examination system 102 may determine that the portion of a track between the first and second vehicles is broken such that a continuous conductive pathway for propagation of the examination signal does not exist. The examination system 102 can identify this section of the route as being a potentially damaged section of the route 108. In routes 108 that are segmented (e.g., such as rail tracks that may have gaps), the examination system 102 may transmit and attempt to detect multiple examination signals in order to prevent false detection of a broken portion of the route 108.

Because the examination signal may propagate relatively quickly through the route 108 (e.g., faster than a speed at which the vehicle system 100 moves), the route 108 can be examined using the examination signal when the vehicle system 100 is moving, such as transporting cargo or otherwise operating at or above a non-zero, minimum speed limit of the route 108.

Additionally or alternatively, the examination system 102 may detect one or more changes in the examination signal at the second vehicle. The examination signal may propagate through the route 108 from the first vehicle to the second vehicle. But, due to damaged portions of the route 108 between the first and second vehicles, one or more signal characteristics of the examination signal may have changed. For example, the signal-to-noise ratio, intensity, power, or the like, of the examination signal may be known or designated when injected into the route 108 at the first vehicle. One or more of these signal characteristics may change (e.g., deteriorate or decrease) during propagation through a mechanically damaged or deteriorated portion of the route 108, even though the examination signal is received (e.g., detected) at the second vehicle. The signal characteristics can be monitored upon receipt of the examination signal at the second vehicle. Based on changes in one or more of the signal characteristics, the examination system 102 may identify the portion of the route 108 that is disposed between the first and second vehicles as being a potentially damaged portion of the route 108. For example, if the signal-to-noise ratio, intensity, power, or the like, of the examination signal decreases below a designated threshold and/or decreases by more than a designated threshold decrease, then the examination system 102 may identify the section of the route 108 as being potentially damaged.

In response to identifying a section of the route 108 as being damaged or damaged, the examination system 102 may initiate one or more responsive actions. For example, the examination system 102 can automatically slow down or stop movement of the vehicle system 100. The examination system 102 can automatically issue a warning signal to one or more other vehicle systems traveling nearby of the damaged section of the route 108 and where the damaged section of the route 108 is located. The examination system 102 may automatically communicate a warning signal to a stationary wayside device located at or near the route 108 that notifies the device of the potentially damaged section of the route 108 and the location of the potentially damaged section. The stationary wayside device can then communicate a signal to one or more other vehicle systems traveling nearby of the potentially damaged section of the route 108 and where the potentially damaged section of the route 108 is located. The examination system 102 may automatically issue an inspection signal to an off-board facility, such as a repair facility, that notifies the facility of the potentially damaged section of the route 108 and the location of the section. The facility may then send one or more inspectors to check and/or repair the route 108 at the potentially damaged section. Alternatively, the examination system 102 may notify an operator of the potentially damaged section of the route 108 and the operator may then manually initiate one or more responsive actions.

Figure 2:
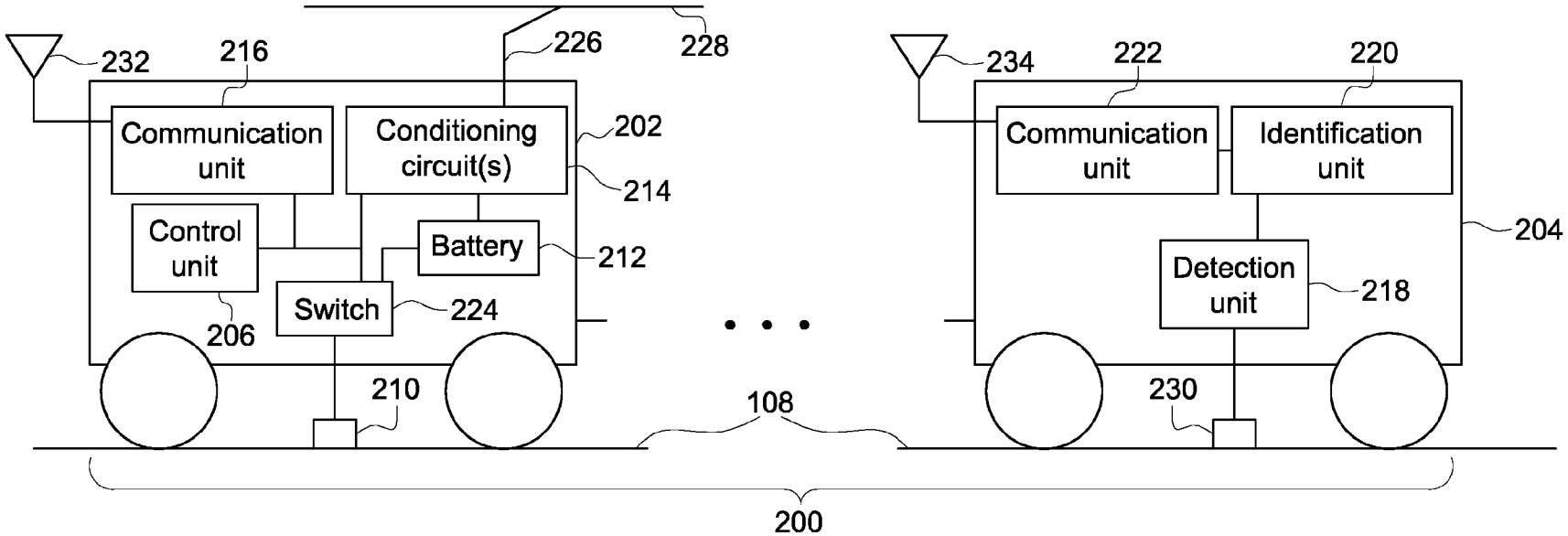
FIG. 2 is a schematic illustration of an embodiment of an examination.

FIG. 2 is a schematic illustration of an embodiment of an examination system 200. The examination system 200 may represent the examination unit 102 shown in FIG. 1. The examination system 200 is distributed between a first vehicle 202 and a second vehicle 204 in the same vehicle system. The vehicles 202, 204 may represent vehicles 104 and/or 106 of the vehicle system 100 shown in FIG. 1. In an embodiment, the vehicles 202, 204 represent two of the vehicles 104, such as the vehicle 104A and the vehicle 104B, the vehicle 104B and the vehicle 104C, or the vehicle 104A and the vehicle 104C. Alternatively, one or more of the vehicles 202, 204 may represent at least one of the vehicles 106. In another embodiment, the examination system 200 may be distributed among three or more of the vehicles 104 and/or 106.

The examination system 200 includes several components described below that are disposed onboard the vehicles 202, 204. For example, the illustrated embodiment of the examination system 200 includes a control unit 206, an application device 210, an onboard power source 212 ("Battery" in FIG. 2), one or more conditioning circuits 214, a communication unit 216, and one or more switches 224 disposed onboard the first vehicle 202. The examination system 200 also includes a detection unit 218, an identification unit 220, a detection device 230, and a communication unit 222 disposed onboard the second vehicle 204. Alternatively, one or more of the control unit 206, application device 210, power source 212, conditioning circuits 214, communication unit 216, and/or switch 224 may be disposed onboard the second vehicle 204 and/or another vehicle in the same vehicle system, and/or one or more of the detection unit 218, identification unit 220, detection device 230, and communication unit 222 may be disposed onboard the first vehicle 202 and/or another vehicle in the same vehicle system.

The control unit 206 controls supply of electric current to the application device 210. The control unit 206 can include hardware circuitry that includes and/or is connected with one or more processors, controllers, or other electronic logic-based devices. In an embodiment, the application device 210 includes one or more conductive bodies that engage the route 108 as the vehicle system that includes the vehicle 202 travels along the route 108. For example, the application device 210 can include a conductive shoe, brush, or other body that slides along an upper and/or side surface of a track such that a conductive pathway is created that extends through the application device 210 and the track. Additionally or alternatively, the application device 210 can include a conductive portion of a wheel of the first vehicle 202, such as the conductive outer periphery or circumference of the wheel that engages the route 108 as the first vehicle 202 travels along the route 108. In another embodiment, the application device 210 may be inductively coupled with the route 108 without engaging or touching the route 108 or any component that engages the route 108.

The application device 210 is conductively coupled with the switch 224, which can represent one or more devices that control the flow of electric current from the onboard power source 212 and/or the conditioning circuits 214. The switch 224 can be controlled by the control unit 206 so that the control unit 206 can turn on or off the flow of electric current through the application device 210 to the route 108. In an embodiment, the switch 224 also can be controlled by the control unit 206 to vary one or more waveforms and/or waveform characteristics (e.g., phase, frequency, amplitude, and the like) of the current that is applied to the route 108 by the application device 210.

The onboard power source 212 represents one or more devices capable of storing electric energy, such as one or more batteries, capacitors, flywheels, and the like. Additionally or alternatively, the power source 212 may represent one or more devices capable of generating electric current, such as an alternator, generator, photovoltaic device, gas turbine, or the like. The power source 212 is coupled with the switch 224 so that the control unit 206 can control when the electric energy stored in the power source 212 and/or the electric current generated by the power source 212 is conveyed as electric current (e.g., direct current, alternating current, an RF signal, or the like) to the route 108 via the application device 210.

The conditioning circuit 214 represents one or more circuits and electric components that change characteristics of electric current. For example, the conditioning circuit 214 may include one or more inverters, converters, transformers, batteries, capacitors, resistors, inductors, and the like. In the illustrated embodiment, the conditioning circuit 214 is coupled with a connecting assembly 226 that is configured to receive electric current from an off-board source. For example, the connecting assembly 226 may include a pantograph that engages an electrified conductive pathway 228 (e.g., a catenary) extending along the route 108 such that the electric current from the catenary 228 is conveyed via the connecting assembly 226 to the conditioning circuit 214. Additionally or alternatively, the electrified conductive pathway 228 may represent an electrified portion of the route 108 (e.g., an electrified rail) and the connecting assembly 226 may include a conductive shoe, brush, portion of a wheel, or other body that engages the electrified portion of the route 108. Electric current is conveyed from the electrified portion of the route 108 through the connecting assembly 226 and to the conditioning circuit 214.

The electric current that is conveyed to the conditioning circuit 214 from the power source 212 and/or the off-board source (e.g., via the connecting assembly 226) can be altered by the conditioning circuit 214. For example, the conditioning circuit 214 can change the voltage, current, frequency, phase, magnitude, intensity, waveform, and the like, of the current that is received from the power source 212 and/or the connecting assembly 226. The modified current can be the examination signal that is electrically injected into the route 108 by the application device 210. Additionally or alternatively, the control unit 206 can form the examination signal by controlling the switch 224. For example, the examination signal can be formed by turning the switch 224 on to allow current to flow from the conditioning circuit 214 and/or the power source 212 to the application device 210.

In an embodiment, the control unit 206 may control the conditioning circuit 214 to form the examination signal. For example, the control unit 206 may control the conditioning circuit 214 to change the voltage, current, frequency, phase, magnitude, intensity, waveform, and the like, of the current that is received from the power source 212 and/or the connecting assembly 226 to form the examination signal. The examination signal optionally may be a waveform that includes multiple frequencies. The examination signal may include multiple harmonics or overtones. The examination signal may be a square wave or the like.

The examination signal is conducted through the application device 210 to the route 108, and is electrically injected into a conductive portion of the route 108. For example, the examination signal may be conducted into a conductive track of the route 108. In another embodiment, the application device 210 may not directly engage (e.g., touch) the route 108, but may be wirelessly coupled with the route 108 in order to electrically inject the examination signal into the route 108 (e.g., via induction).

The conductive portion of the route 108 that extends between the first and second vehicles 202, 204 during travel of the vehicle system may form a track circuit through which the examination signal may be conducted. The first vehicle 202 can be coupled (e.g., coupled physically, coupled wirelessly, among others) to the track circuit by the application device 210. The power source (e.g., the onboard power source 212 and/or the off-board electrified conductive pathway 228) can transfer power (e.g., the examination signal) through the track circuit toward the second vehicle 204.

By way of example and not limitation, the first vehicle 202 can be coupled to a track of the route 108, and the track can be the track circuit that extends and conductively couples one or more components of the examination system 200 on the first vehicle 202 with one or more components of the examination system 200 on the second vehicle 204.

In an embodiment, the control unit 206 includes or represents a manager component. Such a manager component can be configured to activate a transmission of electric current into the route 108 via the application device 210. In another instance, the manager component can activate or deactivate a transfer of the portion of power from the onboard and/or off-board power source to the application device 210, such as by controlling the switch and/or conditioning circuit. Moreover, the manager component can adjust parameter(s) associated with the portion of power that is transferred to the route 108. For instance, the manager component can adjust an amount of power transferred, a frequency at which the power is transferred (e.g., a pulsed power delivery, AC power, among others), a duration of time the portion of power is transferred, among others. Such parameter(s) can be adjusted by the manager component based on at least one of a geographic location of the vehicle or the device or an identification of the device (e.g., type, location, make, model, among others).

The manager component can leverage a geographic location of the vehicle or the device in order to adjust a parameter for the portion of power that can be transferred to the device from the power source. For instance, the amount of power transferred can be adjusted by the manager component based on the device power input. By way of example and not limitation, the portion of power transferred can meet or be below the device power input in order to reduce risk of damage to the device. In another example, the geographic location of the vehicle and/or the device can be utilized to identify a particular device and, in turn, a power input for such device. The geographic location of the vehicle and/or the device can be ascertained by a location on a track circuit, identification of the track circuit, Global Positioning Service (GPS), among others.

The detection unit 218 disposed onboard the second vehicle 204 as shown in FIG. 2 monitors the route 108 to attempt to detect the examination signal that is injected into the route 108 by the first vehicle 202. The detection unit 218 can include hardware circuitry that includes and/or is connected with one or more processors, controllers, or other electronic logic-based devices. The detection unit 218 is coupled with the detection device 230. In an embodiment, the detection device 230 includes one or more conductive bodies that engage the route 108 as the vehicle system that includes the vehicle 204 travels along the route 108. For example, the detection device 230 can include a conductive shoe, brush, or other body that slides along an upper and/or side surface of a track such that a conductive pathway is created that extends through the detection device 230 and the track. Additionally or alternatively, the detection device 230 can include a conductive portion of a wheel of the second vehicle 204, such as the conductive outer periphery or circumference of the wheel that engages the route 108 as the second vehicle 204 travels along the route 108. In another embodiment, the detection device 230 may be inductively coupled with the route 108 without engaging or touching the route 108 or any component that engages the route 108.

The detection unit 218 monitors one or more electrical characteristics of the route 108 using the detection device 230. For example, the voltage of a direct current conducted by the route 108 may be detected by monitoring the voltage conducted along the route 108 to the detection device 230. In another example, the current (e.g., frequency, amps, phases, or the like) of an alternating current or RF signal being conducted by the route 108 may be detected by monitoring the current conducted along the route 108 to the detection device 230. As another example, the signal-to-noise ratio of a signal being conducted by the detection device 230 from the route 108 may be detected by the detection unit 218 examining the signal conducted by the detection device 230 (e.g., a received signal) and comparing the received signal to a designated signal. For example, the examination signal that is injected into the route 108 using the application device 210 may include a designated signal or portion of a designated signal. The detection unit 218 may compare the received signal that is conducted from the route 108 into the detection device 230 with this designated signal in order to measure a signal-to-noise ratio of the received signal.

The detection unit 218 determines one or more electrical characteristics of the signal that is received (e.g., picked up) by the detection device 230 from the route 108 and reports the characteristics of the received signal to the identification unit 220. The one or more electrical characteristics may include voltage, current, frequency, phase, phase shift or difference, modulation, intensity, embedded signature, and the like. If no signal is received by the detection device 230, then the detection unit 218 may report the absence of such a signal to the identification unit 220. For example, if the detection unit 218 does not detect at least a designated voltage, designated current, or the like, as being received by the detection device 230, then the detection unit 218 may not detect any received signal. Alternatively or additionally, the detection unit 218 may communicate the detection of a signal that is received by the detection device 230 only upon detection of the signal by the detection device 230.

In an embodiment, the detection unit 218 may determine the characteristics of the signals received by the detection device 230 in response to a notification received from the control unit 206 in the first vehicle 202. For example, when the control unit 206 is to cause the application device 210 to inject the examination signal into the route 108, the control unit 206 may direct the communication unit 216 to transmit a notification signal to the detection device 230 via the communication unit 222 of the second vehicle 204. The communication units 216, 222 may include respective antennas 232, 234 and associated circuitry for wirelessly communicating signals between the vehicles 202, 204, and/or with off-board locations. The communication unit 216 may wirelessly transmit a notification to the detection unit 218 that instructs the detection unit 218 as to when the examination signal is to be input into the route 108. Additionally or alternatively, the communication units 216, 222 may be connected via one or more wires, cables, and the like, such as a multiple unit (MU) cable, train line, or other conductive pathway(s), to allow communication between the communication units 216, 222.

The detection unit 218 may begin monitoring signals received by the detection device 230. For example, the detection unit 218 may not begin or resume monitoring the received signals of the detection device 230 unless or until the detection unit 218 is instructed that the control unit 206 is causing the injection of the examination signal into the route 108. Alternatively or additionally, the detection unit 218 may periodically monitor the detection device 230 for received signals and/or may monitor the detection device 230 for received signals upon being manually prompted by an operator of the examination system 200.

The identification unit 220 receives the characteristics of the received signal from the detection unit 218 and determines if the characteristics indicate receipt of all or a portion of the examination signal injected into the route 108 by the first vehicle 202. The identification unit 220 includes hardware circuitry that includes and/or is connected with one or more processors, controllers, or other electronic logic-based devices. Although the detection unit 218 and the identification unit 220 are shown as separate units, the detection unit 218 and the identification unit 220 may refer to the same unit. For example, the detection unit 218 and the identification unit 220 may be a single hardware component disposed onboard the second vehicle 204 and/or may share one or more of the same processors.

The identification unit 220 examines the characteristics and determines if the characteristics indicate that the section of the route 108 disposed between the first vehicle 202 and the second vehicle 204 is damaged or at least partially damaged. For example, if the application device 210 injected the examination signal into a track of the route 108 and one or more characteristics (e.g., voltage, current, frequency, intensity, signal-to-noise ratio, and the like) of the examination signal are not detected by the detection unit 218, then, the identification unit 220 may determine that the section of the track that was disposed between the vehicles 202, 204 is broken or otherwise damaged such that the track cannot conduct the examination signal. Additionally or alternatively, the identification unit 220 can examine the signal-to-noise ratio of the signal detected by the detection unit 218 and determine if the section of the route 108 between the vehicles 202, 204 is potentially broken or damaged. For example, the identification unit 220 may identify this section of the route 108 as being broken or damaged if the signal-to-noise ratio of one or more (or at least a designated amount) of the received signals is less than a designated ratio.

The identification unit 220 may include or be communicatively coupled (e.g., by one or more wired and/or wireless connections that allow communication) with a location determining unit that can determine the location of the vehicle 204 and/or vehicle system. For example, the location determining unit may include a GPS unit or other device that can determine where the first vehicle and/or second vehicle are located along the route 108. The distance between the first vehicle 202 and the second vehicle 204 along the length of the vehicle system may be known to the identification unit 220, such as by inputting the distance into the identification unit 220 using one or more input devices and/or via the communication unit 222.

The identification unit 220 can identify which section of the route 108 is potentially damaged based on the location of the first vehicle 202 and/or the second vehicle 204 during transmission of the examination signal through the route 108. For example, the identification unit 220 can identify the section of the route 108 that is within a designated distance of the vehicle system, the first vehicle 202, and/or the second vehicle 204 as the potentially damaged section when the identification unit 220 determines that the examination signal is not received or at least has a decreased signal-to-noise ratio.

Additionally or alternatively, the identification unit 220 can identify which section of the route 108 is potentially damaged based on the locations of the first vehicle 202 and the second vehicle 204 during transmission of the examination signal through the route 108, the direction of travel of the vehicle system that includes the vehicles 202, 204, the speed of the vehicle system, and/or a speed of propagation of the examination signal through the route 108. The speed of propagation of the examination signal may be a designated speed that is based on one or more of the material(s) from which the route 108 is formed, the type of examination signal that is injected into the route 108, and the like. In an embodiment, the identification unit 220 may be notified when the examination signal is injected into the route 108 via the notification provided by the control unit 206. The identification unit 220 can then determine which portion of the route 108 is disposed between the first vehicle 202 and the second vehicle 204 as the vehicle system moves along the route 108 during the time period that corresponds to when the examination signal is expected to be propagating through the route 108 between the vehicles 202, 204 as the vehicles 202, 204 move. This portion of the route 108 may be the section of potentially damaged route that is identified.

One or more responsive actions may be initiated when the potentially damaged section of the route 108 is identified. For example, in response to identifying the potentially damaged portion of the route 108, the identification unit 220 may notify the control unit 206 via the communication units 222, 216. The control unit 206 and/or the identification unit 220 can automatically slow down or stop movement of the vehicle system. For example, the control unit 206 and/or identification unit 220 can be communicatively coupled with one or more propulsion systems (e.g., engines, alternators/generators, motors, and the like) of one or more of the propulsion-generating vehicles in the vehicle system. The control unit 206 and/or identification unit 220 may automatically direct the propulsion systems to slow down and/or stop.

Figure 3:
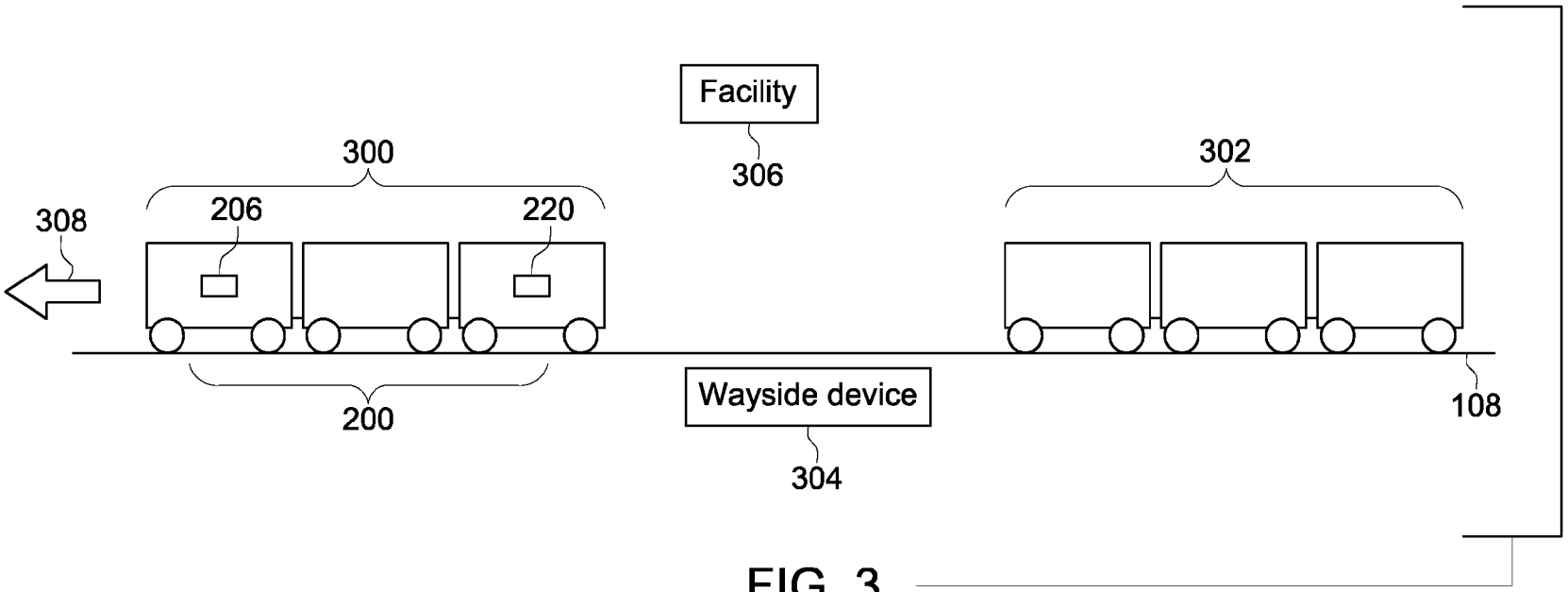
FIG. 3 illustrates a schematic diagram of an embodiment of plural vehicle systems traveling along the route.

With continued reference to FIG. 2, FIG. 3 illustrates a schematic diagram of an embodiment of plural vehicle systems 300, 302 traveling along the route 108. One or more of the vehicle systems 300, 302 may represent the vehicle system 100 shown in FIG. 1 that includes the route examination system 200. For example, at least a first vehicle system 300 traveling along the route 108 in a first direction 308 may include the examination system 200. The second vehicle system 302 may be following the first vehicle system 300 on the route 108, but spaced apart and separated from the first vehicle system 300.

In addition or as an alternate to the responsive actions that may be taken when a potentially damaged section of the route 108 is identified, the examination system 200 onboard the first vehicle system 300 may automatically notify the second vehicle system 302. The control unit 206 and/or the identification unit 220 may wirelessly communicate (e.g., transmit or broadcast) a warning signal to the second vehicle system 302. The warning signal may notify the second vehicle system 302 of the location of the potentially damaged section of the route 108 before the second vehicle system 302 arrives at the potentially damaged section. The second vehicle system 302 may be able to slow down, stop, or move to another route to avoid traveling over the potentially damaged section.

Additionally or alternatively, the control unit 206 and/or identification unit 220 may communicate a warning signal to a stationary wayside device 304 in response to identifying a section of the route 108 as being potentially damaged. The device 304 can be, for instance, wayside equipment, an electrical device, a client asset, a defect detection device, a device utilized with Positive Train Control (PTC), a signal system component(s), a device utilized with Automated Equipment Identification (AEI), among others. In one example, the device 304 can be a device utilized with AEI. AEI is an automated equipment identification mechanism that can aggregate data related to equipment for the vehicle. By way of example and not limitation, AEI can utilize passive radio frequency technology in which a tag (e.g., passive tag) is associated with the vehicle and a reader/receiver receives data from the tag when in geographic proximity thereto. The AEI device can be a reader or receiver that collects or stores data from a passive tag, a data store that stores data related to passive tag information received from a vehicle, an antenna that facilitates communication between the vehicle and a passive tag, among others. Such an AEI device may store an indication of where the potentially damaged section of the route 108 is located so that the second vehicle system 302 may obtain this indication when the second vehicle system 302 reads information from the AEI device.

In another example, the device 304 can be a signaling device for the vehicle. For instance, the device 304 can provide visual and/or audible warnings to provide warning to other entities such as other vehicle systems (e.g., the vehicle system 302) of the potentially damaged section of the route 108. The signaling devices can be, but not limited to, a light, a motorized gate arm (e.g., motorized motion in a vertical plane), an audible warning device, among others.

In another example, the device 304 can be utilized with PTC. PTC can refer to communication-based/processor-based vehicle control technology that provides a system capable of reliably and functionally preventing collisions between vehicle systems, over speed derailments, incursions into established work zone limits, and the movement of a vehicle system through a route switch in the improper position. PTC systems can perform other additional specified functions. Such a PTC device 304 can provide warnings to the second vehicle system 204 that cause the second vehicle system 204 to automatically slow and/or stop, among other responsive actions, when the second vehicle system 204 approaches the location of the potentially damaged section of the route 108.

In another example, the wayside device 304 can act as a beacon or other transmitting or broadcasting device other than a PTC device that communicates warnings to other vehicles or vehicle systems traveling on the route 108 of the identified section of the route 108 that is potentially damaged.

The control unit 206 and/or identification unit 220 may communicate a repair signal to an off-board facility 306 in response to identifying a section of the route 108 as being potentially damaged. The facility 306 can represent a location, such as a dispatch or repair center, which is located off-board of the vehicle systems 202, 204. The repair signal may include or represent a request for further inspection and/or repair of the route 108 at the potentially damaged section. Upon receipt of the repair signal, the facility 306 may dispatch one or more persons and/or equipment to the location of the potentially damaged section of the route 108 in order to inspect and/or repair the route 108 at the location.

Additionally or alternatively, the control unit 206 and/or identification unit 220 may notify an operator of the vehicle system of the potentially damaged section of the route 108 and suggest the operator initiate one or more of the responsive actions described herein.

In another embodiment, the examination system 200 may identify the potentially damaged section of the route 108 using the wayside device 304. For example, the detection device 230, the detection unit 218, and the communication unit 222 may be located at or included in the wayside device 304. The control unit 206 on the vehicle system may determine when the vehicle system is within a designated distance of the wayside device 304 based on an input or known location of the wayside device 304 and the monitored location of the vehicle system (e.g., from data obtained from a location determination unit). Upon traveling within a designated distance of the wayside device 304, the control unit 206 may cause the examination signal to be injected into the route 108. The wayside device 304 can monitor one or more electrical characteristics of the route 108 similar to the second vehicle 204 described above. If the electrical characteristics indicate that the section of the route 108 between the vehicle system and the wayside device 304 is damaged or broken, the wayside device 304 can initiate one or more responsive actions, such as by directing the vehicle system to automatically slow down and/or stop, warning other vehicle systems traveling on the route 108, requesting inspection and/or repair of the potentially damaged section of the route 108, and the like.

Figure 5:
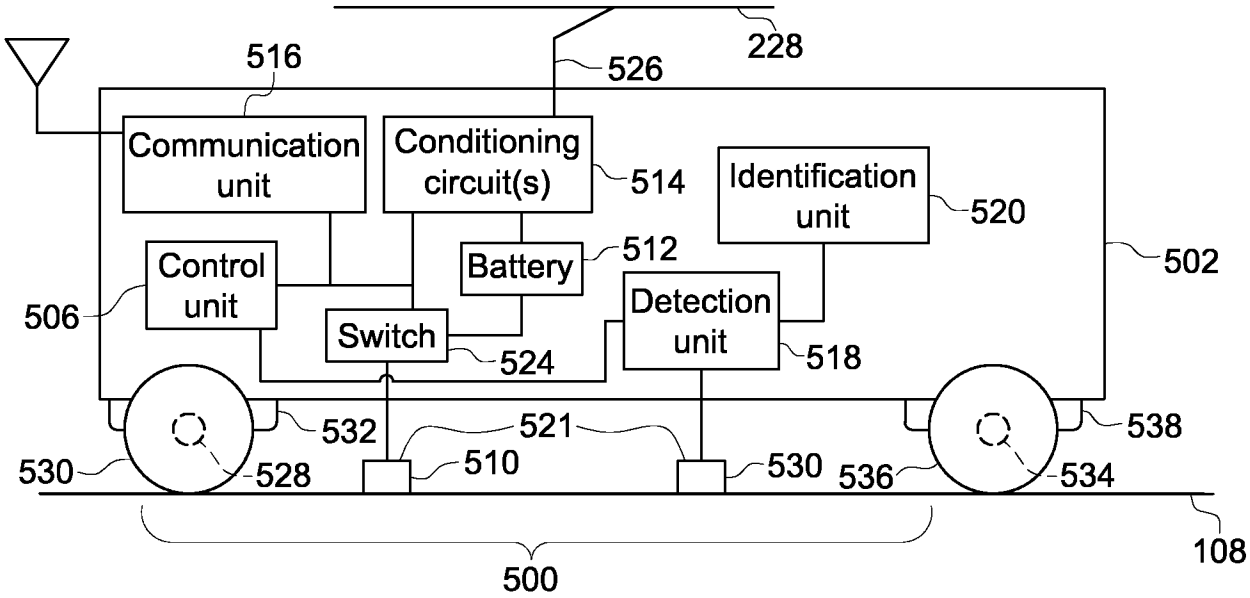
FIG. 5 is a schematic illustration of an embodiment of an examination system.

FIG. 5 is a schematic illustration of an embodiment of an examination system 500. The examination system 500 may represent the examination system 102 shown in FIG. 1. In contrast to the examination system 200 shown in FIG. 2, the examination system 500 is disposed within a single vehicle 502 in a vehicle system that may include one or more additional vehicles mechanically coupled with the vehicle 502. The vehicle 502 may represent a vehicle 104 and/or 106 of the vehicle system 100 shown in FIG. 1.

The examination system 500 includes an identification unit 520 and a signal communication system 521. The identification unit 520 may be similar to or represent the identification unit 220 shown in FIG. 2. The signal communication system 521 includes at least one application device and at least one detection device and/or unit. In the illustrated embodiment, the signal communication system 521 includes one application device 510 and one detection device 530. The application device 510 and the detection device 530 may be similar to or represent the application device 210 and the detection device 230, respectively (both shown in FIG. 2). The application device 510 and the detection device 530 may be a pair of transmit and receive coils in different, discrete housings that are spaced apart from each other, as shown in FIG. 5. Alternatively, the application device 510 and the detection device 530 may be a pair of transmit and receive coils held in a common housing. In another alternative embodiment, the application device 510 and the detection device 530 include a same coil, where the coil is configured to inject at least one examination signal into the route 108 and is also configured to monitor one or more electrical characteristics of the route 108 in response to the injection of the at least one examination signal.

In other embodiments shown and described below, the signal communication system 521 may include two or more application devices and/or two or more detection devices or units. Although not indicated in FIG. 5, in addition to the application device 510 and the detection device 530, the signal communication system 521 may further include one or more switches 524 (which may be similar to or represent the switches 224 shown in FIG. 2), a control unit 506 (which may be similar to or represent the control unit 206 shown in FIG. 2), one or more conditioning circuits 514 (which may be similar to or represent the circuits 214 shown in FIG. 2), an onboard power source 512 ("Battery" in FIG. 5, which may be similar to or represent the power source 212 shown in FIG. 2), and/or one or more detection units 518 (which may be similar to or represent the detection unit 218 shown in FIG. 2). The illustrated embodiment of the examination system 500 may further include a communication unit 516 (which may be similar to or represent the communication unit 216 shown in FIG. 2). As shown in FIG. 5, these components of the examination system 500 are disposed onboard a single vehicle 502 of a vehicle system, although one or more of the components may be disposed onboard a different vehicle of the vehicle system from other components of the examination system 500. As described above, the control unit 506 controls supply of electric current to the application device 510 that engages or is inductively coupled with the route 108 as the vehicle 502 travels along the route 108. The application device 510 is conductively coupled with the switch 524 that is controlled by the control unit 506 so that the control unit 506 can turn on or off the flow of electric current through the application device 510 to the route 108. The power source 512 is coupled with the switch 524 so that the control unit 506 can control when the electric energy stored in the power source 512 and/or the electric current generated by the power source 512 is conveyed as electric current to the route 108 via the application device 510.

The conditioning circuit 514 may be coupled with a connecting assembly 526 that is similar to or represents the connecting assembly 226 shown in FIG. 2. The connecting assembly 526 receives electric current from an off-board source, such as the electrified conductive pathway 228. Electric current can be conveyed from the electrified portion of the route 108 through the connecting assembly 526 and to the conditioning circuit 514.

The electric current that is conveyed to the conditioning circuit 514 from the power source 512 and/or the off-board source can be altered by the conditioning circuit 514. The modified current can be the examination signal that is electrically injected into the route 108 by the application device 510. Optionally, the control unit 506 can form the examination signal by controlling the switch 524, as described above. Optionally, the control unit 506 may control the conditioning circuit 514 to form the examination signal, also as described above.

The examination signal is conducted through the application device 510 to the route 108, and is electrically injected into a conductive portion of the route 108. The conductive portion of the route 108 that extends between the application device 510 and the detection device 530 of the vehicle 502 during travel may form a track circuit through which the examination signal may be conducted.

The control unit 506 may include or represent a manager component. Such a manager component can be configured to activate a transmission of electric current into the route 108 via the application device 510. In another instance, the manager component can activate or deactivate a transfer of the portion of power from the onboard and/or off-board power source to the application device 510, such as by controlling the switch and/or conditioning circuit. Moreover, the manager component can adjust parameter(s) associated with the portion of power that is transferred to the route 108.

The detection unit 518 monitors the route 108 to attempt to detect the examination signal that is injected into the route 108 by the application device 510. In one aspect, the detection unit 518 may follow behind the application device 510 along a direction of travel of the vehicle 502. The detection unit 518 is coupled with the detection device 530 that engages or is inductively coupled with the route 108, as described above.

The detection unit 518 monitors one or more electrical characteristics of the route 108 using the detection device 530. The detection unit 518 may compare the received signal that is conducted from the route 108 into the detection device 530 with this designated signal in order to measure a signal-to-noise ratio of the received signal. The detection unit 518 determines one or more electrical characteristics of the signal by the detection device 530 from the route 108 and reports the characteristics of the received signal to the identification unit 520. If no signal is received by the detection device 530, then the detection unit 518 may report the absence of such a signal to the identification unit 520. In an embodiment, the detection unit 518 may determine the characteristics of the signals received by the detection device 530 in response to a notification received from the control unit 506, as described above.

The detection unit 518 may begin monitoring signals received by the detection device 530. For example, the detection unit 518 may not begin or resume monitoring the received signals of the detection device 530 unless or until the detection unit 518 is instructed that the control unit 506 is causing the injection of the examination signal into the route 108. Alternatively or additionally, the detection unit 518 may periodically monitor the detection device 530 for received signals and/or may monitor the detection device 530 for received signals upon being manually prompted by an operator of the examination system 500.

In one aspect, the application device 510 includes a first axle 528 and/or a first wheel 530 that is connected to the axle 528 of the vehicle 502. The axle 528 and wheel 530 may be connected to a first truck 532 of the vehicle 502. The application device 510 may be conductively coupled with the route 108 (e.g., by directly engaging the route 108) to inject the examination signal into the route 108 via the axle 528 and the wheel 530, or via the wheel 530 alone. The detection device 530 may include a second axle 534 and/or a second wheel 536 that is connected to the axle 534 of the vehicle 502. The axle 534 and wheel 536 may be connected to a second truck 538 of the vehicle 502. The detection device 530 may monitor the electrical characteristics of the route 108 via the axle 534 and the wheel 536, or via the wheel 536 alone. Optionally, the axle 534 and/or wheel 536 may inject the signal while the other axle 528 and/or wheel 530 monitors the electrical characteristics.

The identification unit 520 receives the one or more characteristics of the received signal from the detection unit 518 and determines if the characteristics indicate receipt of all or a portion of the examination signal injected into the route 108 by the application device 510. The identification unit 520 interprets the one or more characteristics monitored by the detection unit 518 to determine a state of the route. The identification unit 520 examines the characteristics and determines if the characteristics indicate that a test section of the route 108 disposed between the application device 510 and the detection device 530 is in a non-damaged state, is in a damaged or at least partially damaged state, or is in a non-damaged state that indicates the presence of an electrical short, as described below.

The identification unit 520 may include or be communicatively coupled with a location determining unit that can determine the location of the vehicle 502. The distance between the application device 510 and the detection device 530 along the length of the vehicle 502 may be known to the identification unit 520, such as by inputting the distance into the identification unit 520 using one or more input devices and/or via the communication unit 516.

The identification unit 520 can identify which section of the route 108 is potentially damaged based on the location of the vehicle 502 during transmission of the examination signal through the route 108, the direction of travel of the vehicle 502, the speed of the vehicle 502, and/or a speed of propagation of the examination signal through the route 108, as described above.

One or more responsive actions may be initiated when the potentially damaged section of the route 108 is identified. For example, in response to identifying the potentially damaged portion of the route 108, the identification unit 520 may notify the control unit 506. The control unit 506 and/or the identification unit 520 can automatically slow down or stop movement of the vehicle 502 and/or the vehicle system that includes the vehicle 502. For example, the control unit 506 and/or identification unit 520 can be communicatively coupled with one or more propulsion systems (e.g., engines, alternators/generators, motors, and the like) of one or more of the propulsion-generating vehicles in the vehicle system. The control unit 506 and/or identification unit 520 may automatically direct the propulsion systems to slow down and/or stop.

Figure 4:
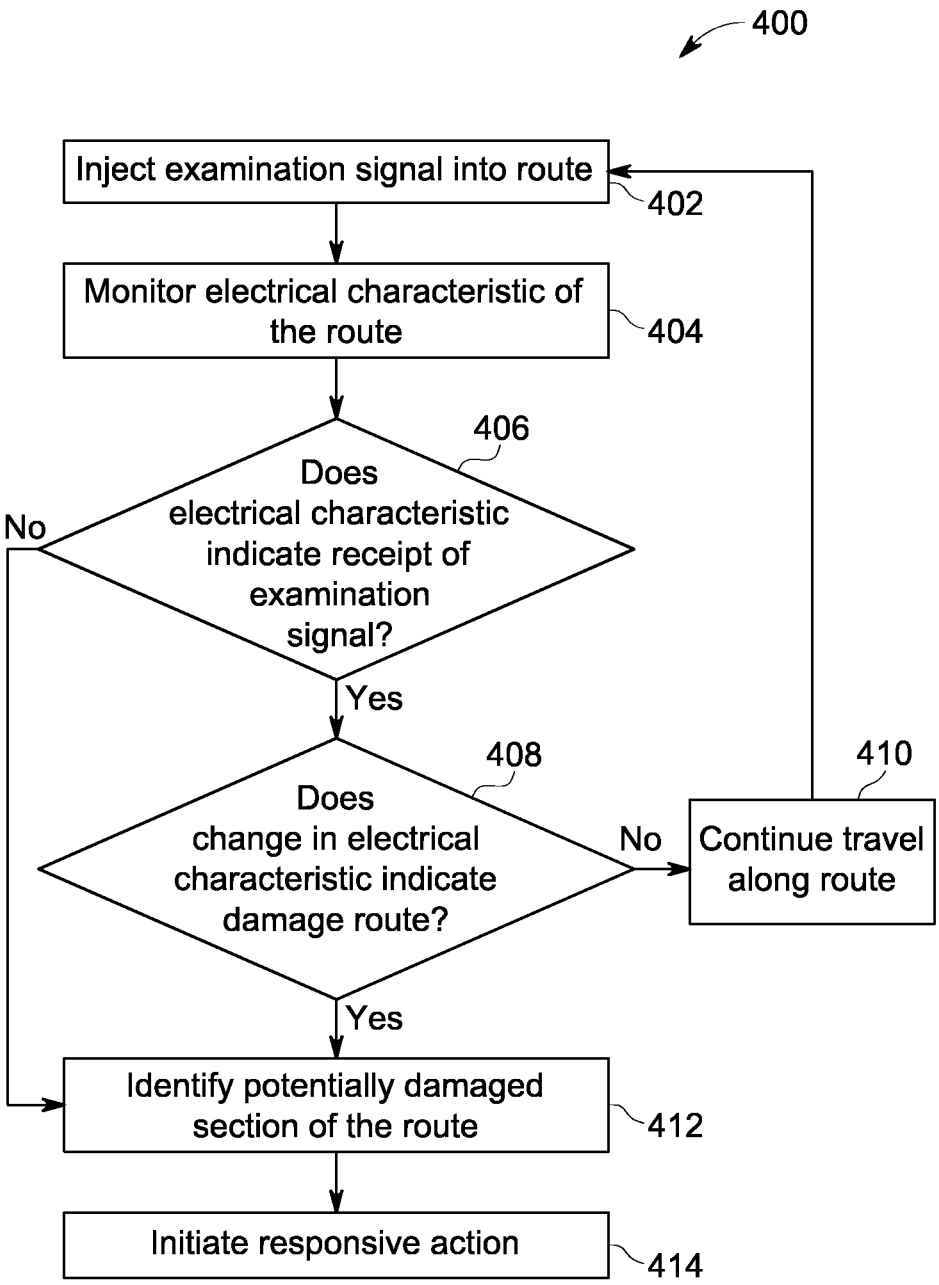
FIG. 4 is a flowchart of an embodiment of a method for examining a route being traveled by a vehicle system from onboard the vehicle system.

FIG. 4 is a flowchart of an embodiment of a method 400 for examining a route being traveled by a vehicle system from onboard the vehicle system. The method 400 may be used in conjunction with one or more embodiments of the vehicle systems and/or examinations described herein. Alternatively, the method 400 may be implemented with another system.

At 402, an examination signal is injected into the route being traveled by the vehicle system at a first vehicle. For example, a direct current, alternating current, RF signal, or another signal may be conductively and/or inductively injected into a conductive portion of the route 108, such as a track of the route 108.

At 404, one or more electrical characteristics of the route are monitored at another, second vehicle in the same vehicle system. For example, the route 108 may be monitored to determine if any voltage or current is being conducted by the route 108.

At 406, a determination is made as to whether the one or more monitored electrical characteristics indicate receipt of the examination signal. For example, if a direct current, alternating current, or RF signal is detected in the route 108, then the detected current or signal may indicate that the examination signal is conducted through the route 108 from the first vehicle to the second vehicle in the same vehicle system. As a result, the route 108 may be substantially intact between the first and second vehicles. Optionally, the examination signal may be conducted through the route 108 between components joined to the same vehicle. As a result, the route 108 may be substantially intact between the components of the same vehicle. Flow of the method 400 may proceed to 408. On the other hand, if no direct current, alternating current, or RF signal is detected in the route 108, then the absence of the current or signal may indicate that the examination signal is not conducted through the route 108 from the first vehicle to the second vehicle in the same vehicle system or between components of the same vehicle. As a result, the route 108 may be broken between the first and second vehicles, or between the components of the same vehicle. Flow of the method 400 may then proceed to 412.

At 408, a determination is made as to whether a change in the one or more monitored electrical characteristics indicates damage to the route. For example, a change in the examination signal between when the signal was injected into the route 108 and when the examination signal is detected may be determined. This change may reflect a decrease in voltage, a decrease in current, a change in frequency and/or phase, a decrease in a signal-to-noise ratio, or the like. The change can indicate that the examination signal was conducted through the route 108, but that damage to the route 108 may have altered the signal. For example, if the change in voltage, current, frequency, phase, signal-to-noise ratio, or the like, of the injected examination signal to the detected examination signal exceeds a designated threshold amount (or if the monitored characteristic decreased below a designated threshold), then the change may indicate damage to the route 108, but not a complete break in the route 108. As a result, flow of the method 400 can proceed to 412.

On the other hand, if the change in voltage, amps, frequency, phase, signal-to-noise ratio, or the like, of the injected examination signal to the detected examination signal does not exceed the designated threshold amount (and/or if the monitored characteristic does not decrease below a designated threshold), then the change may not indicate damage to the route 108. As a result, flow of the method 400 can proceed to 410.

At 410, the test section of the route that is between the first and second vehicles in the vehicle system or between the components of the same vehicle is not identified as potentially damaged, and the vehicle system may continue to travel along the route. Additionally examination signals may be injected into the route at other locations as the vehicle system moves along the route.

At 412, the section of the route that is or was disposed between the first and second vehicles, or between the components of the same vehicle, is identified as a potentially damaged section of the route. For example, due to the failure of the examination signal to be detected and/or the change in the examination signal that is detected, the route may be broken and/or damaged between the first vehicle and the second vehicle, or between the components of the same vehicle.

At 414, one or more responsive actions may be initiated in response to identifying the potentially damaged section of the route. As described above, these actions can include, but are not limited to, automatically and/or manually slowing or stopping movement of the vehicle system, warning other vehicle systems about the potentially damaged section of the route, notifying wayside devices of the potentially damaged section of the route, requesting inspection and/or repair of the potentially damaged section of the route, and the like.

In one or more embodiments, a route examination and method may be used to identify electrical shorts, or short circuits, on a route. The identification of short circuits may allow for the differentiation of a short circuit on a non-damaged section of the route from a broken or deteriorated track on a damaged section of the route. The differentiation of short circuits from open circuits caused by various types of damage to the route provides identification of false alarms. Detecting a false alarm preserves the time and costs associated with attempting to locate and repair a section of the route that is not actually damaged. For example, referring to the method 400 above at 408, a change in the monitored electrical characteristics may indicate that the test section of the route includes an electrical short that short circuits the two tracks together. For example, an increase in the amplitude of monitored voltage or current and/or a phase shift may indicate the presence of an electrical short. The electrical short provides a circuit path between the two tracks, which effectively reduces the circuit path of the propagating examination signal between the point of injection and the place of detection, which results in an increased voltage and/or current and/or the phase shift.

Figure 6:
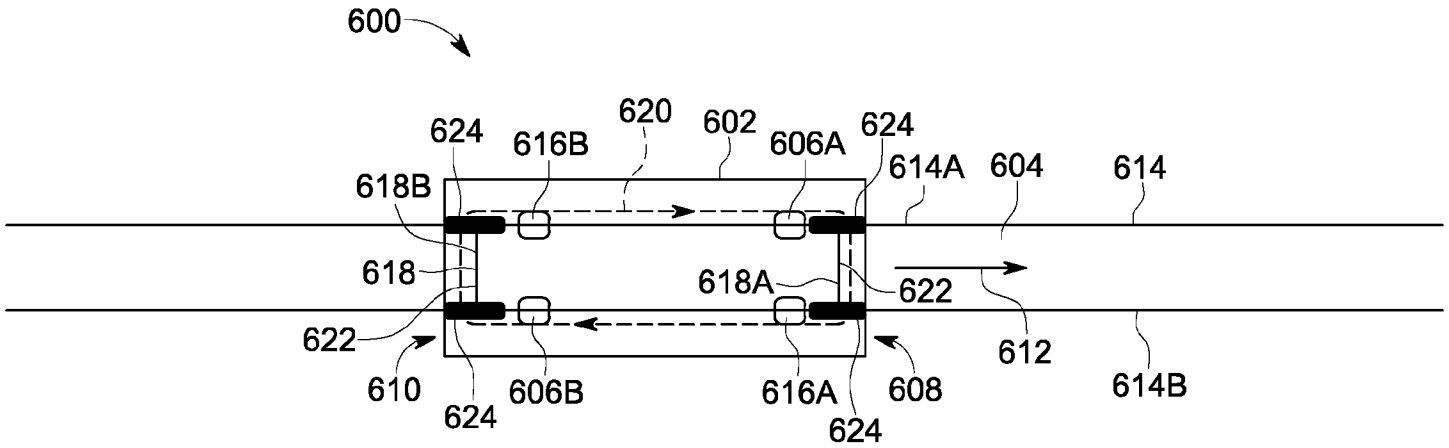
FIG. 6 is a schematic illustration of an embodiment of an examination system on a vehicle of a vehicle system traveling along a route.

FIG. 6 is a schematic illustration of an embodiment of an examination system 600 on a vehicle 602 of a vehicle system (not shown) traveling along a route 604. The examination system 600 may represent the examination system 102 shown in FIG. 1 and/or the examination system 200 shown in FIG. 2. In contrast to the examination system 200, the examination system 600 is disposed within a single vehicle 602. The vehicle 602 may represent at least one of the vehicles 104, 106 of the vehicle system 100 shown in FIG. 1. FIG. 6 may be a top-down view looking at least partially through the vehicle 602. The examination system 600 may be utilized to identify short circuits and breaks on a route, such as a railway track, for example. The vehicle 602 may be one of multiple vehicles of the vehicle system, so the vehicle 602 may be referred to herein as a first vehicle 602.

The vehicle 602 includes multiple transmitters or application devices 606 disposed onboard the vehicle 602. The application devices 606 may be positioned at spaced apart locations along the length of the vehicle 602. For example, a first application device 606A may be located closer to a front end 608 of the vehicle 602 relative to a second application device 606B located closer to a rear end 610 of the vehicle 602. The designations of "front" and "rear" may be based on the direction of travel 612 of the vehicle 602 along the route 604.

The route 604 includes conductive tracks 614 in parallel, and the application devices 606 are configured to be conductively and/or inductively coupled with at least one conductive track 614 along the route 604. For example, the conductive tracks 614 may be rails in a railway context. In an embodiment, the first application device 606A is configured to be conductively and/or inductively coupled with a first conductive track 614A, and the second application device 606B is configured to be conductively and/or inductively coupled with a second conductive track 614B. As such, the application devices 606 may be disposed on the vehicle 602 diagonally from each other. The application devices 606 are utilized to electrically inject at least one examination signal into the route. For example, the first application device 606A may be used to inject a first examination signal into the first conductive track 614A of the route 604. Likewise, the second application device 606B may be used to inject a second examination signal into the second conductive track 614B of the route 604.

The vehicle 602 also includes multiple receiver coils or detection units 616 disposed onboard the vehicle 602. The detection unit 616 can include hardware circuitry that includes and/or is connected with one or more processors, controllers, or other electronic logic-based devices. The detection units 616 are positioned at spaced apart locations along the length of the vehicle 602. For example, a first detection unit 616A may be located towards the front end 608 of the vehicle 602 relative to a second detection unit 616B located closer to the rear end 610 of the vehicle 602. The detection units 616 are configured to monitor one or more electrical characteristics of the route 604 along the conductive tracks 614 in response to the examination signals being injected into the route 604. The electrical characteristics that are monitored may include a current, a phase shift, a modulation, a frequency, a voltage, amperes, conductivity, impedance, and the like. For example, the first detection unit 616A may be configured to monitor one or more electrical characteristics of the route 604 along the second track 614B, and the second detection unit 616B may be configured to monitor one or more electrical characteristics of the route 604 along the first track 614A. As such, the detection units 616 may be disposed on the vehicle 602 diagonally from each other. In an embodiment, each of the application devices 606A, 606B and the detection units 616A, 616B may define individual corners of a test section of the vehicle 602. Optionally, the application devices 606 and/or the detection units 616 may be staggered in location along the length and/or width of the vehicle 602. Optionally, the application device 606A and detection unit 616A and/or the application device 606B and detection unit 616B may be disposed along the same track 614. The application devices 606 and/or detection units 616 may be disposed on the vehicle 602 at other locations in other embodiments.

In an embodiment, two of the conductive tracks 614 (e.g., tracks 614A and 614B) may be conductively and/or inductively coupled to each other through multiple shunts 618 along the length of the vehicle 602. For example, the vehicle 602 may include two shunts 618, with one shunt 618A located closer to the front 608 of the vehicle 602 relative to the other shunt 618B. In an embodiment, the shunts 618 are conductive and together with the tracks 614 define an electrically conductive test loop 620. The conductive test loop 620 represents a track circuit or circuit path along the conductive tracks 614 between the shunts 618. The test loop 620 moves along the tracks 614 as the vehicle 602 travels along the route 604 in the direction 612. Therefore, the section of the conductive tracks 614 defining part of the conductive test loop 620 changes as the vehicle 602 progresses on a trip along the route 604.

In an embodiment, the application devices 606 and the detection units 616 are in electrical contact with the conductive test loop 620. For example, the application device 606A may be in electrical contact with track 614A and/or shunt 618A; the application device 606B may be in electrical contact with track 614B and/or shunt 618B; the detection unit 616A may be in electrical contact with track 614B and/or shunt 618A; and the detection unit 616B may be in electrical contact with track 614A and/or shunt 618B.

The two shunts 618A, 618B may be first and second trucks disposed on a rail vehicle. Each truck 618 includes an axle 622 interconnecting two wheels 624. Each wheel 624 contacts a respective one of the tracks 614. The wheels 624 and the axle 622 of each of the trucks 618 are configured to electrically connect (e.g., short) the two tracks 614A, 614B to define respective ends of the conductive test loop 620. For example, the injected first and second examination signals may circulate the conductive test loop 620 along the length of a section of the first track 614A, through the wheels 624 and axle 622 of the shunt 618A to the second track 614B, along a section of the second track 614B, and across the shunt 618B, returning to the first track 614A.

In an embodiment, alternating current transmitted from the vehicle 602 is injected into the route 604 at two or more points through the tracks 614 and received at different locations on the vehicle 602. For example, the first and second application devices 606A, 606B may be used to inject the first and second examination signals into respective first and second tracks 614A, 614B. One or more electrical characteristics in response to the injected examination signals may be received at the first and second detection units 616A, 616B. Each examination signal may have a unique identifier so the signals can be distinguished from each other at the detection units 616. For example, the unique identifier of the first examination signal may have a base frequency, a phase, a modulation, an embedded signature, and/or the like, that differs from the unique identifier of the second examination signal.

In an embodiment, the examination system 600 may be used to more precisely locate faults on track circuits in railway signaling systems, and to differentiate between track features. For example, the system 600 may be used to distinguish broken tracks (e.g., rails) versus crossing shunt devices, non-insulated switches, scrap metal connected across the tracks 614A and 614B, and other situations or devices that might produce an electrical short (e.g., short circuit) when a current is applied to the conductive tracks 614 along the route 604. In typical track circuits looking for damaged sections of routes, an electrical short may appear as similar to a break, creating a false alarm. The examination system 600 also may be configured to distinguish breaks in the route due to damage from intentional, non-damaged "breaks" in the route, such as insulated joints and turnouts (e.g., track switches), which simulate actual breaks but do not short the conductive test loop 620 when traversed by a vehicle system having the examination system 600.

In an embodiment, when there is no break or short circuit on the route 604 and the tracks 614 are electrically contiguous, the injected examination signals circulate the length of the test loop 620 and are received by all detection units 616 present on the test loop 620. Therefore, both detection units 616A and 616B receive both the first and second examination signals when there is no electrical break or electrical short on the route 604 within the section of the route 604 defining the test loop 620.

As discussed further below, when the vehicle 602 passes over an electrical short (e.g., a device or a condition of a section of the route 604 that causes a short circuit when a current is applied along the section of the route 604), two additional conductive current loops or conductive short loops are formed. The two additional conductive short loops have electrical characteristics that are unique to a short circuit (e.g., as opposed to electrical characteristics of an open circuit caused by a break in a track 614). For example, the electrical characteristics of the current circulating the first conductive short loop may have an amplitude that is an inverse derivative of the amplitude of the second additional current loop as the electrical short is traversed by the vehicle 602. In addition, the amplitude of the current along the original conductive test loop 620 spanning the periphery of the test section diminishes considerably while the vehicle 602 traverses the electrical short. All of the one or more electrical characteristics in the original and additional current loops may be received and/or monitored by the detection units 616. Sensing the two additional short loops may provide a clear differentiator to identify that the loss of current in the original test loop is the result of a short circuit and not an electrical break in the track 614. Analysis of the electrical characteristics of the additional short loops relative to the vehicle motion and/or location may provide more precision in locating the short circuit within the span of the test section.

In an alternative embodiment, the examination system 600 includes the two spaced-apart detection units 616A, 616B defining a test section of the route 604 there between, but only includes one of the application devices 606A, 606B, such as only the first application device 606A. The detection units 616A, 616B are each configured to monitor one or more electrical characteristics of at least one of the conductive tracks 614A, 614B proximate to the respective detection unit 616A, 616B in response to at least one examination signal being electrically injected into at least one of the conductive tracks 614A, 614B by the application device 606A. In another alternative embodiment, the examination system 600 includes the two spaced-apart detection units 616A, 616B, but does not include either of the application devices 606A, 606B. For example, the examination signal may be derived from an inherent electrical current of a traction motor (not shown) of the vehicle 602 (or another vehicle of the vehicle system). The examination signal may be injected into at least one of the conductive tracks 614A, 614B via a conductive and/or inductive electrical connection between the traction motor and the one or both conductive tracks 614A, 614B, such as a conductive connection through the wheels 624. In other embodiments, the examination signal may be derived from electrical currents of other motors of the vehicle 602 or may be an electrical current injected into the tracks 614 from a wayside device.

Regardless of whether the examination system 600 includes one application device or no application devices, the identification unit 520 (shown in FIG. 5) is configured to examine the one or more electrical characteristics monitored by each of the first and second detection units 616A, 616B in order to determine a status of the test section of the route 604 based on whether the one or more electrical characteristics indicate that the examination signal is received by both the first and second detection units 616A, 616B, neither of the first or second detection units 616A, 616B, or only one of the first or second detection units 616A, 616B. The status of the test section may be potentially damaged, neither damaged nor includes an electrical short, or not damaged and includes an electrical short. The status of the test section is potentially damaged when neither of the first or second detection units 616A, 616B receive the examination signal, indicating an open circuit loop 620. The status of the test section is neither damaged nor includes an electrical short when both of the first and second detection units 616A, 616B receive the examination signal, indicating a closed circuit loop 620. The status of the test section is not damaged and includes an electrical short when only one of the first or second detection units 616A, 616B receive the examination signal, indicating one open sub-loop and one closed sub-loop within the loop 620.

In an alternative embodiment, the vehicle 602 includes the two spaced-apart application devices 606A, 606B defining a test section of the route 604 there between, but only includes one of the detection units 616A, 616B, such as only the first detection unit 616A. The first and second application devices 606A, 606B are configured to electrically inject the first and second examination signals, respectively, into the corresponding conductive tracks 614A, 614B that the application devices 606A, 606B are coupled to. The detection unit 616A is configured to monitor one or more electrical characteristics of at least one of the conductive tracks 614A, 614B in response to the first and second examination signals being injected into the tracks 614.

In this embodiment, the identification unit 520 (shown in FIG. 5) is configured to examine the one or more electrical characteristics monitored by the detection unit 616A in order to determine a status of the test section of the route 604 based on whether the one or more electrical characteristics indicate receipt by the detection unit 616A of both of the first and second examination signals, neither of the first or second examination signals, or only one of the first or second examination signals. The status of the test section is potentially damaged when the one or more electrical characteristics indicate receipt by the detection unit 616A of neither the first nor the second examination signals, indicating an open circuit loop 620. The status of the test section is neither damaged nor includes an electrical short when the one or more electrical characteristics indicate receipt by the detection unit 616A of both the first and second examination signals, indicating a closed circuit loop 620. The status of the test section is not damaged and includes an electrical short when the one or more electrical characteristics indicate receipt by the detection unit 616A of only one of the first or second examination signals, indicating one open circuit sub-loop and one closed circuit sub-loop within the loop 620.

Additionally, or alternatively, the identification unit 520 may be configured to determine that the test section of the route 604 includes an electrical short by detecting a change in a phase difference between the first and second examination signals. For example, the identification unit 520 may compare a detected phase difference between the first and second examination signals that is detected by the detection unit 616A to a known phase difference between the first and second examination signals. The known phase difference may be a phase difference between the examination signals upon injecting the signals into the route 604 or may be a detected phase difference between the examination signals along sections of the route that are known to be not damaged and free of electrical shorts. Thus, if the one of more electrical characteristics monitored by the detection unit 616A indicate that the phase difference between the first and second examination signals is similar to the known phase difference, such that the change in phase difference is negligible or within a threshold value that compensates for variations due to noise, etc., then the status of the test section of route 604 may be non-damaged and free of an electrical short. If the detected phase difference varies from the known phase difference by more than the designated threshold value (such that the change in phase difference exceeds the designated threshold), the status of the test section of route 604 may be non-damaged and includes an electrical short. If the test section of the route 604 is potentially damaged, the one or more monitored electrical characteristics may indicate that the examination signals were not received by the detection unit 616A, so phase difference between the first and second examination signals is not detected.

In another alternative embodiment, the vehicle 602 includes one application device, such as the application device 606A, and one detection unit, such as the detection unit 616A. The application device 606A is disposed proximate to the detection unit 616A. For example, the application device 606A and the detection unit 616A may be located on opposite tracks 614A, 614B at similar positions along the length of the vehicle 602 between the two shunts 618, as shown in FIG. 6, or may be located on the same track 614A or 614B proximate to each other. The application device 606A is configured to electrically inject at least one examination signal into the tracks 614, and the detection unit 616A is configured to monitor one or more electrical characteristics of the tracks 614 in response to the at least one examination signal being injected into the conductive test loop 620.

In this embodiment, the identification unit 520 (shown in FIG. 5) is configured to examine the one or more electrical characteristics monitored by the detection unit 616A to determine a status of a test section of the route 604 that extends between the shunts 618. The identification unit 520 is configured to determine that the status of the test section is potentially damaged when the one or more electrical characteristics indicate that the at least one examination signal is not received by the detection unit 616A. The status of the test section is neither damaged nor includes an electrical short when the one or more electrical characteristics indicate that the at least one examination signal is received by the detection unit 616A. The status of the test section is not damaged and does include an electrical short when the one or more electrical characteristics indicate at least one of a phase shift in the at least one examination signal or an increased amplitude of the at least one examination signal. The amplitude may be increased over a base line amplitude that is detected or measured when the status of the test section is not damaged and does not include an electrical short. The increased amplitude may gradually increase from the base line amplitude, such as when the detection unit 616A and application device 606A of the signal communication system 521 (shown in FIG. 5) move towards the electrical short in the route 604, and may gradually decrease towards the base line amplitude, such as when the detection unit 616A and application device 606A of the signal communication system 521 move away from the electrical short.

Figure 7:
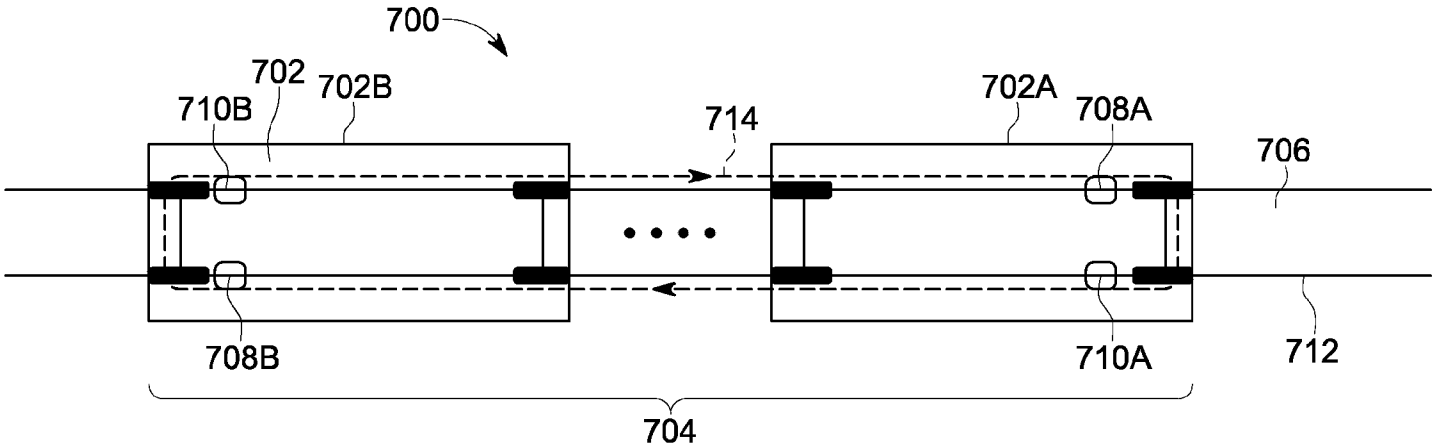
FIG. 7 is a schematic illustration of an embodiment of an examination system disposed on multiple vehicles of a vehicle system traveling along a route.

FIG. 7 is a schematic illustration of an embodiment of an examination system 700 disposed on multiple vehicles 702 of a vehicle system 704 traveling along a route 706. The examination system 700 may represent the examination system 600 shown in FIG. 6. In contrast to the examination system 600 shown in FIG. 6, the examination system 700 is disposed on multiple vehicles 702 in the vehicle system 704, where the vehicles 702 are mechanically coupled together.

In an embodiment, the examination system 700 includes a first application device 708A configured to be disposed on a first vehicle 702A of the vehicle system 702, and a second application device 708B configured to be disposed on a second vehicle 702B of the vehicle system 702. The application devices 708A, 708B may be conductively and/or inductively coupled with different conductive tracks 712, such that the application devices 708A, 708B are disposed diagonally along the vehicle system 704. The first and second vehicles 702A and 702B may be directly coupled, or may be indirectly coupled, having one or more additional vehicles coupled in between the vehicles 702A, 702B. Optionally the vehicles 702A, 702B may each be either one of the vehicles 104 or 106 shown in FIG. 1. Optionally, the second vehicle 702B may trail the first vehicle 702A during travel of the vehicle system 704 along the route 706.

The examination system 700 also includes a first detection unit 710A configured to be disposed on the first vehicle 702A of the vehicle system 702, and a second detection unit 710B configured to be disposed on the second vehicle 702B of the vehicle system 702. The first and second detection units 710A, 710B may be configured to monitor electrical characteristics of the route 706 along different conductive tracks 712, such that the detection units 710 are oriented diagonally along the vehicle system 704. The location of the first application device 708A and/or first detection unit 710A along the length of the first vehicle 702A is optional, as well as the location of the second application device 708B and/or second detection unit 710B along the length of the second vehicle 702B. However, the location of the application devices 708A, 708B affects the length of a current loop that defines a test loop 714. For example, the test loop 714 spans a greater length of the route 706 than the test loop 620 shown in FIG. 6. Increasing the length of the test loop 714 may increase the amount of signal loss as the electrical examination signals are diverted along alternative conductive paths, which diminishes the capability of the detection units 710 to receive the electrical characteristics. Optionally, the application devices 708 and detection units 710 may be disposed on adjacent vehicles 702 and proximate to the coupling mechanism that couples the adjacent vehicles, such that the defined conductive test loop 714 may be smaller in length than the conductive test loop 620 disposed on the single vehicle 602 (shown in FIG. 6).

Figure 8:
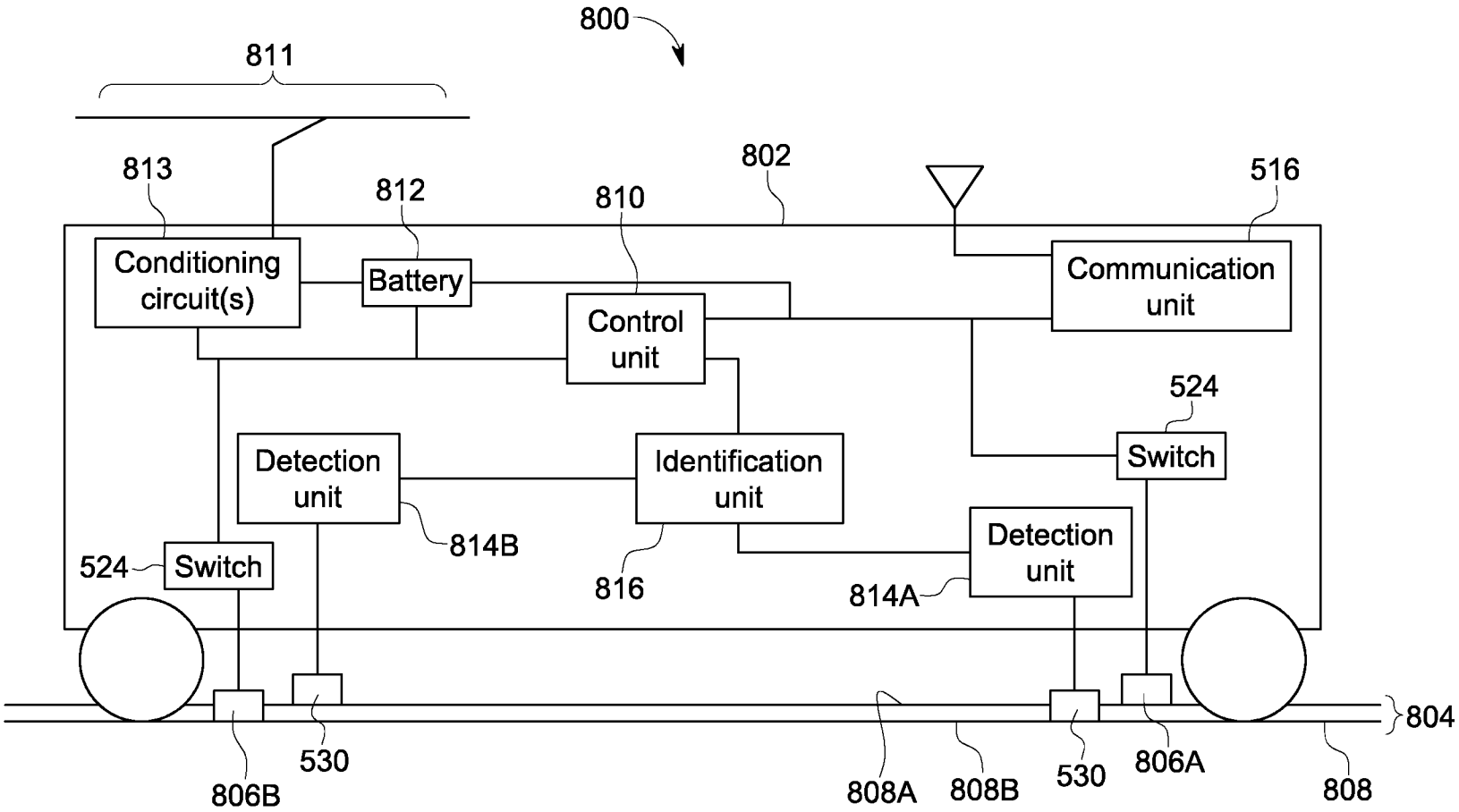
FIG. 8 is a schematic diagram of an embodiment of an examination system on a vehicle of a vehicle system on a route.

FIG. 8 is a schematic diagram of an embodiment of an examination system 800 on a vehicle 802 of a vehicle system (not shown) on a route 804. The examination system 800 may represent the examination system 102 shown in FIG. 1 and/or the examination system 200 shown in FIG. 2. In contrast to the examination system 200, the examination system 800 is disposed within a single vehicle 802. The vehicle 802 may represent at least one of the vehicles 104, 106 shown in FIG. 1.

The vehicle 802 includes a first application device 806A that is conductively and/or inductively coupled to a first conductive track 808A of the route 804, and a second application device 806B that is conductively and/or inductively coupled to a second conductive track 808B. A control unit 810 is configured to control supply of electric current from a power source 811 (e.g., battery 812 and/or conditioning circuits 813) to the first and second application devices 806A, 806B in order to electrically inject examination signals into the conductive tracks 808. For example, the control unit 810 may control the application of a first examination signal into the first conductive track 808A via the first application device 806A and the application of a second examination signal into the second conductive track 808B via the second application device 806B. The control unit 810 can include hardware circuitry that includes and/or is connected with one or more processors, controllers, or other electronic logic-based devices.

The control unit 810 is configured to control application of at least one of a designated direct current, a designated alternating current, or a designated radio frequency signal of each of the first and second examination signals from the power source 811 to the conductive tracks 808 of the route 804. For example, the power source 811 may be an onboard energy storage device 812 (e.g., battery) and the control unit 810 may be configured to inject the first and second examination signals into the route 804 by controlling when electric current is conducted from the onboard energy storage device 812 to the first and second application devices 806A and 806B. Alternatively or in addition, the power source 811 may be an off-board energy storage device 813 (e.g., catenary and conditioning circuits) and the control unit 810 is configured to inject the first and second examination signals into the conductive tracks 808 by controlling when electric current is conducted from the off-board energy storage device 813 to the first and second application devices 806A and 806B.

The vehicle 802 also includes a first detection unit 814A disposed onboard the vehicle 802 that is configured to monitor one or more electrical characteristics of the second conductive track 808B of the route 804, and a second detection unit 814B disposed onboard the vehicle 802 that is configured to monitor one or more electrical characteristics of the first conductive track 808A. An identification unit 816 is disposed onboard the vehicle 802. The identification unit 816 is configured to examine the one or more electrical characteristics of the conductive tracks 808 monitored by the detection units 814A, 814B in order to determine whether a section of the route 804 traversed by the vehicle 802 is potentially damaged based on the one or more electrical characteristics. As used herein, "potentially damaged" means that the section of the route may be damaged or at least deteriorated. The identification unit 816 may further determine whether the section of the route traversed by the vehicle is damaged by distinguishing between one or more electrical characteristics that indicate damage to the section of the route and one or more electrical characteristics that indicate an electrical short on the section of the route. The identification unit 816 can include hardware circuitry that includes and/or is connected with one or more processors, controllers, or other electronic logic-based devices.

Figure 9A:
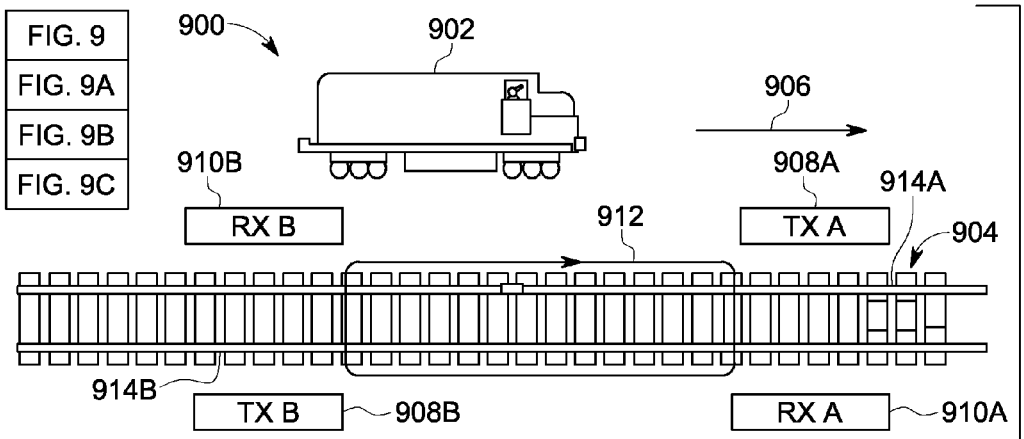
FIGS. 9A, 9B, and 9C illustrate an embodiment of an examination system on a vehicle as the vehicle travels along a route.
Figure 9B:
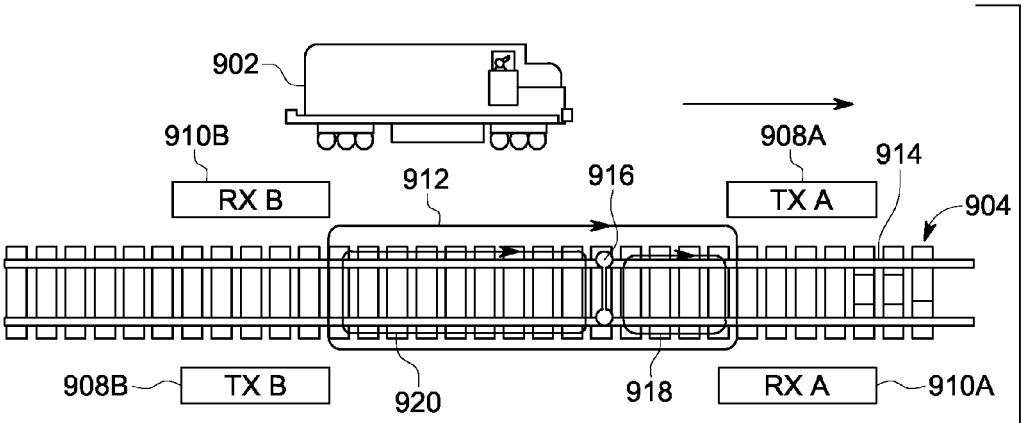
Figure 9C:
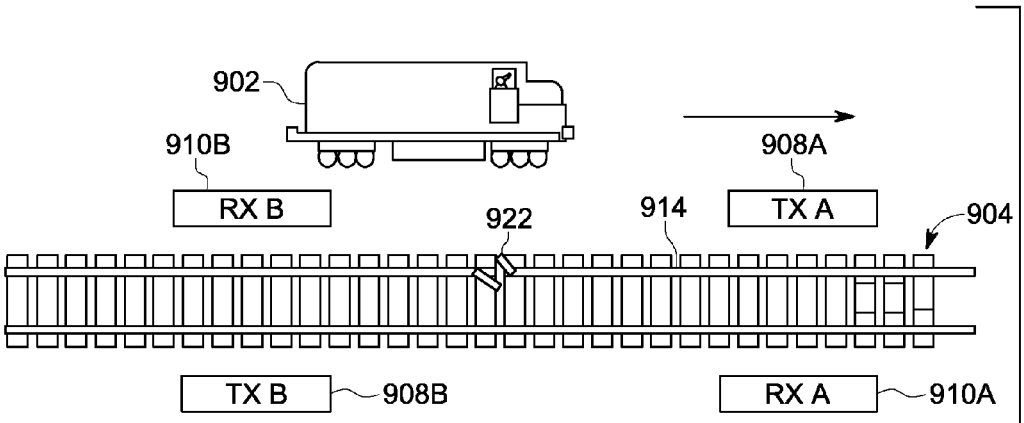

FIG. 9 (comprising parts 9A, 9B, and 9C) is a schematic illustration of an embodiment of an examination system 900 on a vehicle 902 as the vehicle 902 travels along a route 904. The examination system 900 may be the examination system 600 shown in FIG. 6 and/or the examination system 800 shown in FIG. 8. The vehicle 902 may be the vehicle 602 of FIG. 6 and/or the vehicle 802 of FIG. 8. FIGS. 9A-9C illustrate various route conditions that the vehicle 902 may encounter while traversing in a travel direction 906 along the route 904.

The vehicle 902 includes two transmitters or application units 908A and 908B, and two receivers or detection units 910A and 910B all disposed onboard the vehicle 902. The application units 908 and detection units 910 are positioned along a conductive loop 912 defined by shunts on the vehicle 902 and tracks 914 of the route 904 between the shunts. For example, the vehicle 902 may include six axles, each axle attached to two wheels in electrical contact with the tracks 914 and forming a shunt. Optionally, the conductive loop 912 may be bounded between the inner most axles (e.g., between the third and fourth axles) to reduce the amount of signal loss through the other axles and/or the vehicle frame. As such, the third and fourth axles define the ends of the conductive loop 912, and the tracks 914 define the segments of the conductive loop 912 that connect the ends. The detection units 910 can include hardware circuitry that includes and/or is connected with one or more processors, controllers, or other electronic logic-based devices.

The conductive loop 912 defines a test loop 912 (e.g., test section) for detecting faults in the route 904 and distinguishing damaged tracks 914 from short circuit false alarms. As the vehicle 902 traverses the route 904, a first examination signal is injected into a first track 914A of the route 904 from the first application unit 908A, and a second examination signal is injected into a second track 914B of the route 904 from the second application unit 908B. The first and second examination signals may be injected into the route 904 simultaneously or in a staggered sequence. The first and second examination signals each have a unique identifier to distinguish the first examination signal from the second examination signal as the signals circulate the test loop 912. The unique identifier of the first examination signal may include a frequency, a modulation, an embedded signature, and/or the like, that differs from the unique identifier of the second examination signal. For example, the first examination signal may have a higher frequency and/or a different embedded signature than the second examination signal.

In FIG. 9A, the vehicle 902 traverses over a section of the route 904 that is intact (e.g., not damaged) and does not have an electrical short. Since there is no electrical short or electrical break on the route 904 within the area of the conductive test loop 912, which is the area between two designated shunts (e.g., axles) of the vehicle 902, the first and second examination signals both circulate a full length of the test loop 912. As such, the first examination signal current transmitted by the first application device 908A is detected by both the first detection device 910A and the second detection device 910B as the first examination signal current flows around the test loop 912. Although the second examination signal is injected into the route 904 at a different location, the second examination signal current circulates the test loop 912 with the first examination signal current, and is likewise detected by both detection devices 910A, 910B. Each of the detection devices 910A, 910B may be configured to detect one or more electrical characteristics along the route 904 proximate to the respective detection device 910. Therefore, when the section of route is free of shorts and breaks, the electrical characteristics received by each of the detection devices 910 includes the unique signatures of each of the first and second examination signals.

In FIG. 9B, the vehicle 902 traverses over a section of the route 904 that includes an electrical short 916. The electrical short 916 may be a device on the route 904 or condition of the route 904 that conductively and/or inductively couples the first conductive track 914A to the second conductive track 914B. The electrical short 916 causes current injected in one track 914 to flow through the short 916 to the other track 914 instead of flowing along the full length of the conductive test loop 912 and crossing between the tracks 914 at the shunts. For example, the short 916 may be a piece of scrap metal or other extraneous conductive device positioned across the tracks 914, a non-insulated signal crossing or switch, an insulated switch or joint in the tracks 914 that is non-insulated due to wear or damage, and the like. As the vehicle 902 traverses along route 904 over the electrical short 916, such that the short 916 is at least temporarily located between the shunts within the area defined by the test loop 912, the test loop 912 may short circuit.

As the vehicle 902 traverses over the electrical short 916, the electrical short 916 diverts the current flow of the first and second examination signals that circulate the test loop 912 to additional loops. For example, the first examination signal may be diverted by the short 916 to circulate primarily along a first conductive short loop 918 that is newly-defined along a section of the route 904 between the first application device 908A and the electrical short 916. Similarly, the second examination signal may be diverted to circulate primarily along a second conductive short loop 920 that is newly-defined along a section of the route 904 between the electrical short 916 and the second application device 908B. Only the first examining signal that was transmitted by the first application device 908A significantly traverses the first short loop 918, and only the second examination signal that was transmitted by the second application device 908B significantly traverses the second short loop 920.

As a result, the one or more electrical characteristics of the route received and/or monitored by first detection unit 910A may only indicate a presence of the first examination signal. Likewise, the electrical characteristics of the route received and/or monitored by second detection unit 910B may only indicate a presence of the second examining signal. As used herein, "indicat[ing] a presence of" an examination signal means that the received electrical characteristics include more than a mere threshold signal-to-noise ratio of the unique identifier indicative of the respective examination signal that is more than electrical noise. For example, since the electrical characteristics received by the second detection unit 910B may only indicate a presence of the second examination signal, the second examination signal exceeds the threshold signal-to-noise ratio of the received electrical characteristics but the first examination signal does not exceed the threshold. The first examination signal may not be significantly received at the second detection unit 908B because the majority of the first examination signal current originating at the device 908A may get diverted along the short 916 (e.g., along the first short loop 918) before traversing the length of the test loop 912 to the second detection device 908B. As such, the electrical characteristics with the unique identifiers indicative of the first examination signal received at the second detection device 910B may be significantly diminished when the vehicle 902 traverses the electrical short 916.

The peripheral size and/or area of the first and second conductive short loops 918 and 920 may have an inverse correlation at the vehicle 902 traverses the electrical short 916. For example, the first short loop 918 increases in size while the second short loop 920 decreases in size as the test loop 912 of the vehicle 902 overcomes and passes the short 916. It is noted that the first and second short loops 916 are only formed when the short 916 is located within the boundaries or area covered by the test loop 912. Therefore, received electrical characteristics that indicate the examination signals are circulating the first and second conductive short 918, 920 loops signify that the section includes an electrical short 916 (e.g., as opposed to a section that is damaged or is fully intact without an electrical short).

In FIG. 9C, the vehicle 902 traverses over a section of the route 904 that includes an electrical break 922. The electrical break 922 may be damage to one or both tracks 914A, 914B that cuts off (e.g., or significantly reduces) the electrical conductive path along the tracks 914. The damage may be a broken track, disconnected lengths of track, and the like. As such, when a section of the route 904 includes an electrical break, the section of the route forms an open circuit, and current generally does not flow along an open circuit. In some breaks, it may be possible for inductive current to traverse slight breaks, but the amount of current would be greatly reduced as opposed to a non-broken conductive section of the route 904.

As the vehicle 902 traverses over the electrical break 922 such that the break 922 is located within the boundaries of the test loop 912 (e.g., between designated shunts of the vehicle 902 that define the ends of the test loop 912), the test loop 912 may be broken, forming an open circuit. As such, the injected first and second examination signals do not circulate the test loop 912 nor along any short loops. The first and second detection units 910A and 910B do not receive any significant electrical characteristics in response to the first and second examination signals because the signal current do not flow along the broken test loop 912. Once, the vehicle 902 passes beyond the break, subsequently injected first and second examination signals may circulate the test section 912 as shown in FIG. 9A. It is noted that the vehicle 902 may traverse an electrical break caused by damage to the route 904 without derailing. Some breaks may support vehicular traffic for an amount of time until the damage increases beyond a threshold, as is known in the art.

As shown in FIG. 9A-C, the electrical characteristics along the route 904 that are detected by the detection units 910 may differ whether the vehicle 902 traverses over a section of the route 904 having an electrical short 916 (shown in FIG. 9B), an electrical break 922 (shown in FIG. 9C), or is electrically contiguous (shown in FIG. 9A). The examination system 900 may be configured to distinguish between one or more electrical characteristics that indicate a damaged section of the route 904 and one or more electrical characteristics that indicate a non-damaged section of the route 904 having an electrical short 916, as discussed further herein.

Figure 10:
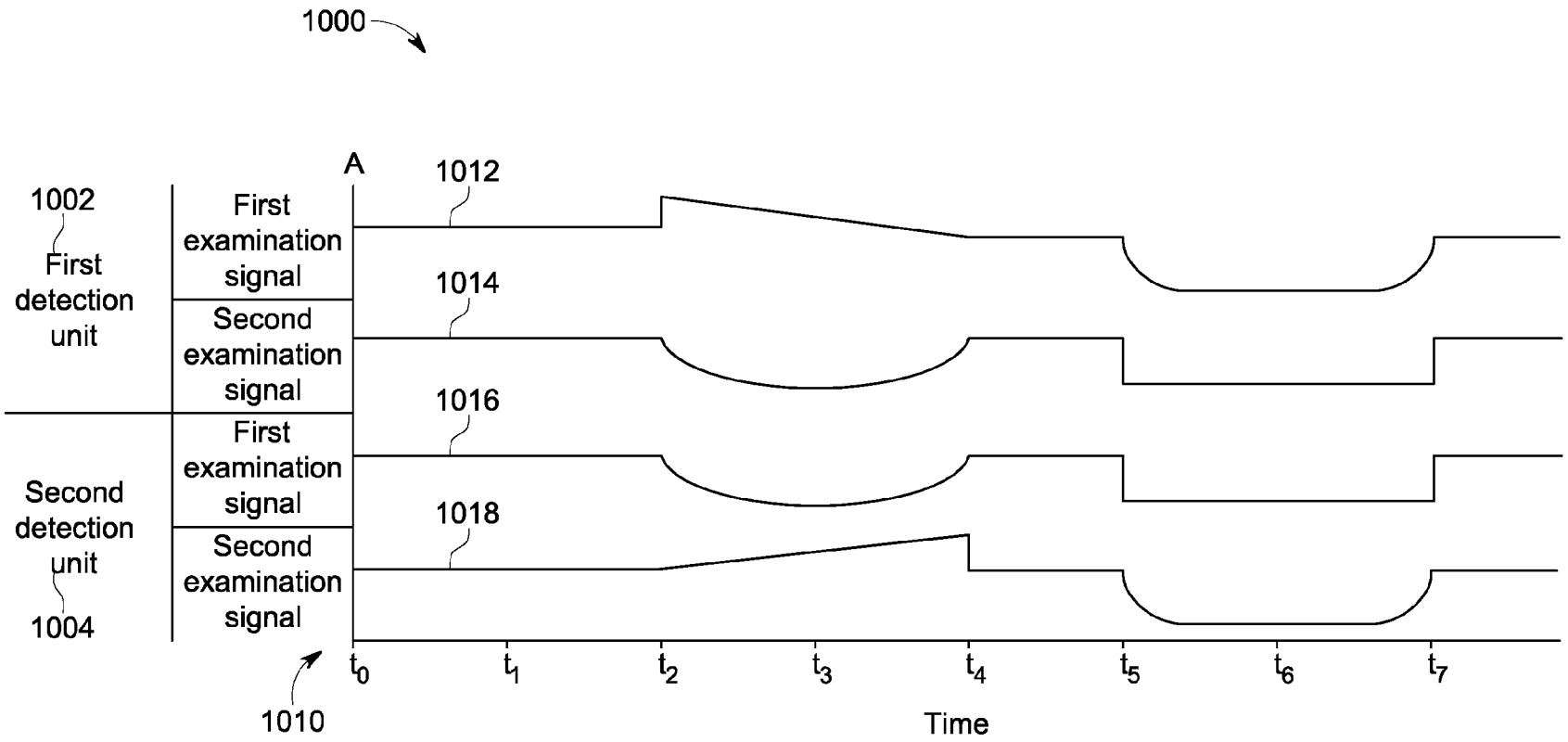
FIG. 10 illustrates electrical signals monitored by an examination system on a vehicle system as the vehicle system travels along a route.

FIG. 10 illustrates electrical signals 1000 monitored by an examination system on a vehicle system as the vehicle system travels along a route. The examination may be the examination system 900 shown in FIG. 9. The vehicle system may include vehicle 902 traveling along the route 904 (both shown in FIG. 9). The electrical signals 1000 are one or more electrical characteristics that are received by a first detection unit 1002 and a second detection unit 1004. The electrical signals 1000 are received in response to the transmission or injection of a first examination signal and a second examination signal into the route. The first and second examination signals may each include a unique identifier that allows the examination to distinguish electrical characteristics of a monitored current that are indicative of the first examination signal from electrical characteristics indicative of the second examination signal, even if an electrical current includes both examination signals. The detection units 1002, 1004 can include hardware circuitry that includes and/or is connected with one or more processors, controllers, or other electronic logic-based devices.

In FIG. 10, the electrical signals 1000 are graphically displayed on a graph 1010 plotting amplitude (A) of the signals 1000 over time (t). For example, the graph 1010 may graphically illustrate the monitored electrical characteristics in response to the first and second examination signals while the vehicle 902 travels along the route 904 and encounters the various route conditions described with reference to FIG. 9. The graph 1010 may be displayed on a display device for an operator onboard the vehicle and/or may be transmitted to an off-board location such as a dispatch or repair facility. The first electrical signal 1012 represents the electrical characteristics in response to (e.g., indicative of the first examination signal that are received by the first detection unit 1002. The second electrical signal 1014 represents the electrical characteristics in response to (e.g., indicative of the second examination signal that are received by the first detection unit 1002. The third electrical signal 1016 represents the electrical characteristics in response to (e.g., indicative of the first examination signal that are received by the second detection unit 1004. The fourth electrical signal 1018 represents the electrical characteristics in response to (e.g., indicative of) the second examination signal that are received by the second detection unit 1004.

Between times t0 and t2, the electrical signals 1000 indicate that both examination signals are being received by both detection units 1002, 1004. Therefore, the signals are circulating the length of the conductive primary test loop 912 (shown in FIGS. 9A and 9B). At a time t1, the vehicle is traversing over a section of the route that is intact and does not have an electrical short, as shown in FIG. 9A. The amplitudes of the electrical signals 1012-1018 may be relatively constant at a base line amplitude for each of the signals 1012-1018. The base line amplitudes need not be the same for each of the signals 1012-1018, such that the electrical signal 1012 may have a different base line amplitude than at least one of the other electrical signals 1014-1018.

At time t2, the vehicle traverses over an electrical short. As shown in FIG. 10, immediately after t2, the amplitude of the electrical signal 1012 indicative of the first examination signal received by the first detection unit 1002 increases by a significant gain and then gradually decreases towards the base line amplitude. The amplitude of the electrical signal 1014 indicative of the second examination signal received by the first detection unit 1002 drops below the base line amplitude for the electrical signal 1014. As such, the electrical characteristics received at the first detection unit 1002 indicate a greater significance or proportion of the first examination signal (e.g., due to the first electrical signal circulating newly-defined loop 918 in FIG. 9B), while less significance or proportion of the second examination signal than compared to the respective base line levels. At the second detection unit 1004 at time t2, the electrical signal 1016 indicative of the first examination signal drops in like manner to the electrical signal 1016 received by the first detection unit 1002. The electrical signal 1018 indicative of the second examination signal gradually increases in amplitude above the base line amplitude from time t2 to t4 as the test loop passes the electrical short.

These electrical characteristics from time t2 to t4 indicate that the electrical short defines new circuit loops within the primary test loop 912 (shown in FIGS. 9A and 9B). The amplitude of the examination signals that were injected proximate to the respective detection units 1002, 1004 increase relative to the base line amplitudes, while the amplitude of the examination signals that were injected on the other side of the test loop (and spaced apart) from the respective detection units 1002, 1004 decrease (or drop) relative to the base line amplitudes. For example the amplitude of the electrical signal 1012 increases by a step right away due to the first examination signal injected by the first application device 908A circulating the newly-defined short loop or sub-loop 918 in FIG. 9B and being received by the first detection unit 910A that is proximate to the first application device 908A. The amplitude of the electrical signal 1012 gradually decreases towards the base line amplitude as the examination moves relative to the electrical short because the electrical short gets further from the first application device 908A and the first detection unit 910A and the size of the sub-loop 918 increases. The electrical signal 1018 also increases relative to the base line amplitude due to the second examination signal injected by the second application device 908B circulating the newly-defined short loop or sub-loop 920 and being received by the second detection unit 910B that is proximate to the second application device 908A. The amplitude of the electrical signal 1018 gradually increases away from the base line amplitude (until time t4) as the examination moves relative to the electrical short because the electrical short gets closer to the second application device 908B and second detection unit 910B and the size of the sub-loop 920 decreases. The amplitude of an examination signal may be higher for a smaller circuit loop because less of the signal attenuates along the circuit before reaching the corresponding detection unit than an examination signal in a larger circuit loop. The positive slope of the electrical signal 1018 may be inverse from the negative slope of the electrical signal 1012. For example, the amplitude of the electrical signal 1012 monitored by the first detection device 1002 may be an inverse derivative of the amplitude of the electrical signal 1018 monitored by the second detection device 1004. This inverse relationship is due to the movement of the vehicle relative to the stationary electrical short along the route. Referring also to FIG. 9B, time t3 may represent the electrical signals 1012-1018 when the electrical short 916 bisects the test loop 912, and the short loops 918, 920 have the same size.

At time t4, the test section (e.g., loop) of the vehicle passes beyond the electrical short. Between times t4 and t5, the electrical signals 1000 on the graph 1010 indicate that both the first and second examination signals once again circulate the primary test loop 912, as shown in FIG. 9A.

At time t5, the vehicle traverses over an electrical break in the route. As shown in FIG. 10, immediately after t5, the amplitude of each of the electrical signals 1012-1018 decrease or drop by a significant step. Throughout the length of time for the test section to pass the electrical break in the route, represented as between times t5 and t7, all four signals 1012-1018 are at a low or at least attenuated amplitude, indicating that the first and second examination signals are not circulating the test loop due to the electrical break in the route. Time t6 may represent the location of the electrical break 922 relative to the route examination system 900 as shown in FIG. 9C.

In an embodiment, the identification unit may be configured to use the received electrical signals 1000 to determine whether a section of the route traversed by the vehicle is potentially damaged, meaning that the section may be damaged or at least deteriorated. For example, based on the recorded waveforms of the electrical signals 1000 between times t2-t4 and t5-t7, the identification unit may identify the section of the route traversed between times t2-t4 as being non-damaged but having an electrical short and the section of route traversed between times t5-t7 as being damaged. For example, it is clear in the graph 1010 that the receiver coils or detection units 1002, 1004 both lose signal when the vehicle transits the damaged section of the route between times t5-t7. However, when crossing the short on the route between times t2-t4, the first detection unit 1002 loses the second examination signal, as shown on the electrical signal 1014, and the electrical signal 1018 representing second examination signal received by the second detection unit 1004 increases in amplitude as the short is transited. Thus, there is a noticeable distinction between a break in the track versus features that short the route. Optionally, a vehicle operator may view the graph 1010 on a display and manually identify sections of the route as being damaged or non-damaged but having an electrical short based on the recorded waveforms of the electrical signals 1000.

In an embodiment, the examination may be further used to distinguish between non-damaged track features by the received electrical signals 1000. For example, wide band shunts (e.g., capacitors) may behave similar to hard wire highway crossing shunts, except an additional phase shift may be identified depending on the frequencies of the first and second examination signals. Narrow band (e.g., tuned) shunts may impact the electrical signals 1000 by exhibiting larger phase and amplitude differences responsive to the relation of the tuned shunt frequency and the frequencies of the examination signals.

The examination may also distinguish electrical circuit breaks due to damage from electrical breaks (e.g., pseudo-breaks) due to intentional track features, such as insulated joints and turnouts (e.g., track switches). In turnouts, in specific areas, only a single pair of transmit and receive coils (e.g., a single application device and detection unit located along one conductive track) may be able to inject current (e.g., an examination signal). The pair on the opposite track (e.g., rail) may be traversing a "fouling circuit," where the opposite track is electrically connected at only one end, rather than part of the circulating current loop.

With regard to insulated joints, for example, distinguishing insulated joints from broken rails may be accomplished by an extended signal absence in the primary test loop caused by the addition of a dead section loop. As is known in the art, railroad standards typically indicate the required stagger of insulated joints to be 32 in. to 56 in. In addition to the insulated joint providing a pseudo-break with an extended length, detection may be enhanced by identifying location specific signatures of signaling equipment connected to the insulated joints, such as batteries, track relays, electronic track circuitry, and the like. The location specific signatures of the signaling equipment may be received in the monitored electrical characteristics in response to the current circulating the newly-defined short loops 918, 920 (shown in FIG. 9) through the connected equipment. For example, signaling equipment that is typically found near an insulated joint may have a specific electrical signature or identifier, such as a frequency, modulation, embedded signature, and the like, that allows the examination system to identify the signaling equipment in the monitored electrical characteristics. Identifying signaling equipment typically found near an insulated joint provides an indication that the vehicle is traversing over an insulated joint in the route, and not a damaged section of the route.

In the alternative embodiment described with reference to FIG. 6 in which the examination includes at least two detection units that are spaced apart from each other but less than two application devices (such as zero or one) such that only one examination signal is injected into the route, the monitored electrical characteristics along the route by the two detection units may be shown in a graph similar to graph 1010. For example, the graph may include the plotted electrical signals 1012 and 1016, where the electrical signal 1012 represents the examination signal detected by or received at the first detection unit 1002, and the electrical signal 1016 represents the examination signal detected by or received at the second detection unit 1004. Using only the plotted amplitudes of the electrical signals 1012 and 1016 (instead of also 1014 and 1018), the identification unit may determine the status of the route. Between times t0 and t2, both signals 1012 and 1016 are constant (with a slope of zero) at base line values. Thus, the one or more electrical characteristics indicate that both detection units 1002, 1004 receive the examination signal, and the identification unit determines that the section of the route is non-damaged and does not include an electrical short. Between times t2-and t4, the first detection unit 1002 detects an increased amplitude of the examination signal above the base line (although the slope is negative), while the second detection unit 1004 detects a drop in the amplitude of the examination signal. Thus, the one or more electrical characteristics indicate that the first detection unit 1002 receives the examination signal but the second detection unit 1004 does not, and the identification unit determines that the section of the route includes an electrical short. Finally, between times t5 and t7, both the first and second detection units 1002, 1004 detect drops in the amplitude of the examination signal. Thus, the one or more electrical characteristics indicate that neither of the detection units 1002, 1004 receive the examination signal, and the identification unit determines that the section of the route is potentially damaged. Alternatively, the examination signal may be the second examination signal shown in the graph 1010 such that the electrical signals are the plotted electrical signals 1014 and 1018 instead of 1012 and 1016.

In the alternative embodiment described with reference to FIG. 6 in which the examination includes at least two application devices that are spaced apart from each other but only one detection unit, the monitored electrical characteristics along the route by the detection unit may be shown in a graph similar to graph 1010. For example, the graph may include the plotted electrical signals 1012 and 1014, where the electrical signal 1012 represents the first examination signal injected by the first application device (such as application device 606A in FIG. 6) and detected by the detection unit 1002 (such as detection unit 616A in FIG. 6), and the electrical signal 1014 represents the second examination signal injected by the second application device (such as application device 606B in FIG. 6) and detected by the same detection unit 1002. Using only the plotted amplitudes of the electrical signals 1012 and 1014 (instead of also 1016 and 1018), the identification unit may determine the status of the route. For example, between times t0 and t2, both signals 1012 and 1014 are constant at the base line values, indicating that the detection unit 1002 receives both the first and second examination signals, so the section of the route is non-damaged. Between times t2 and t4, the one or more electrical characteristics monitored by the detection unit 1002 indicate an increased amplitude of the first examination signal above the base line and a decreased amplitude of the second examination signal below the base line. Thus, during this time period the detection unit 1002 only receives the first examination signal and not the second examination signal (beyond a trace or negligible amount), which indicates that the section of the route may include an electrical short. For example, referring to FIG. 6, the first application device 606A is on the same side of the electrical short as the detection unit 616A, so the first examination signal is received by the detection unit 616A and the amplitude of the electrical signals associated with the first examination signal is increased over the base line amplitude due to the sub-loop created by the electrical short. However, the second application device 606B is on an opposite side of the electrical short from the detection unit 616A, so the second examination signal circulates a different sub-loop and is not received by the detection unit 616A, resulting in the amplitude drop in the plotted signal 1014 over this time period. Finally, between times t5 and t7, the one or more electrical characteristics monitored by the detection unit 1002 indicate drops in the amplitudes of the both the first and second examination signals, so neither of the examination signals are received by the detection unit 1002. Thus, the section of the route is potentially damaged, which causes an open circuit loop and explains the lack of receipt by the detection unit 1002 of either of the examination signals. Alternatively, the detection unit 1002 may be the detection unit 1004 shown in the graph 1010 such that the electrical signals are the plotted electrical signals 1016 and 1018 instead of 1012 and 1014.

In the alternative embodiment described with reference to FIG. 6 in which the examination includes only one application device and only one detection unit, the monitored electrical characteristics along the route by the detection unit may be shown in a graph similar to graph 1010. For example, the graph may include the plotted electrical signal 1012, where the electrical signal 1012 represents the examination signal injected by the application device (such as application device 606A shown in FIG. 6) and detected by the detection unit 1002 (such as detection unit 161A shown in FIG. 6). Using only the plotted amplitudes of the electrical signal 1012 (instead of also 1014, 1016, and 1018), the identification unit may determine the status of the route. For example, between times t0 and t2, the signal 1012 is constant at the base line value, indicating that the detection unit 1002 receives the examination signal, so the section of the route is non-damaged. Between times t2 and t4, the one or more electrical characteristics monitored by the detection unit 1002 indicate an increased amplitude of the examination signal above the base line, which further indicates that the section of the route includes an electrical short. Finally, between times t5 and t7, the one or more electrical characteristics monitored by the detection unit 1002 indicate a drop in the amplitude of the examination signal, so the examination signal is not received by the detection unit 1002. Thus, the section of the route is potentially damaged, which causes an open circuit loop. Alternatively, the detection unit may be the detection unit 1004 shown in the graph 1010 (such as the detection unit 616B shown in FIG. 6) and the electrical signal is the plotted electrical signal 1018 (injected by the application device 606B shown in FIG. 9) instead of 1012. Thus, the detection unit may be proximate to the application device in order to obtain the plotted electrical signals 1012 and 1018. For example, an application device that is spaced apart from the detection device along a length of the vehicle or vehicle system may result in the plotted electrical signals 1014 or 1016, which both show drops in amplitude when the examination traverses both a damaged section of the route and an electrical short. A spaced-apart arrangement between the detection unit and the application unit that provides one of the plotted signals 1014, 1016 is not useful in distinguishing between these two states of the route, unless the plotted signal 1014 or 1016 is interpreted in combination with other monitored electrical characteristics, such as phase or modulation, for example.

Figure 11:
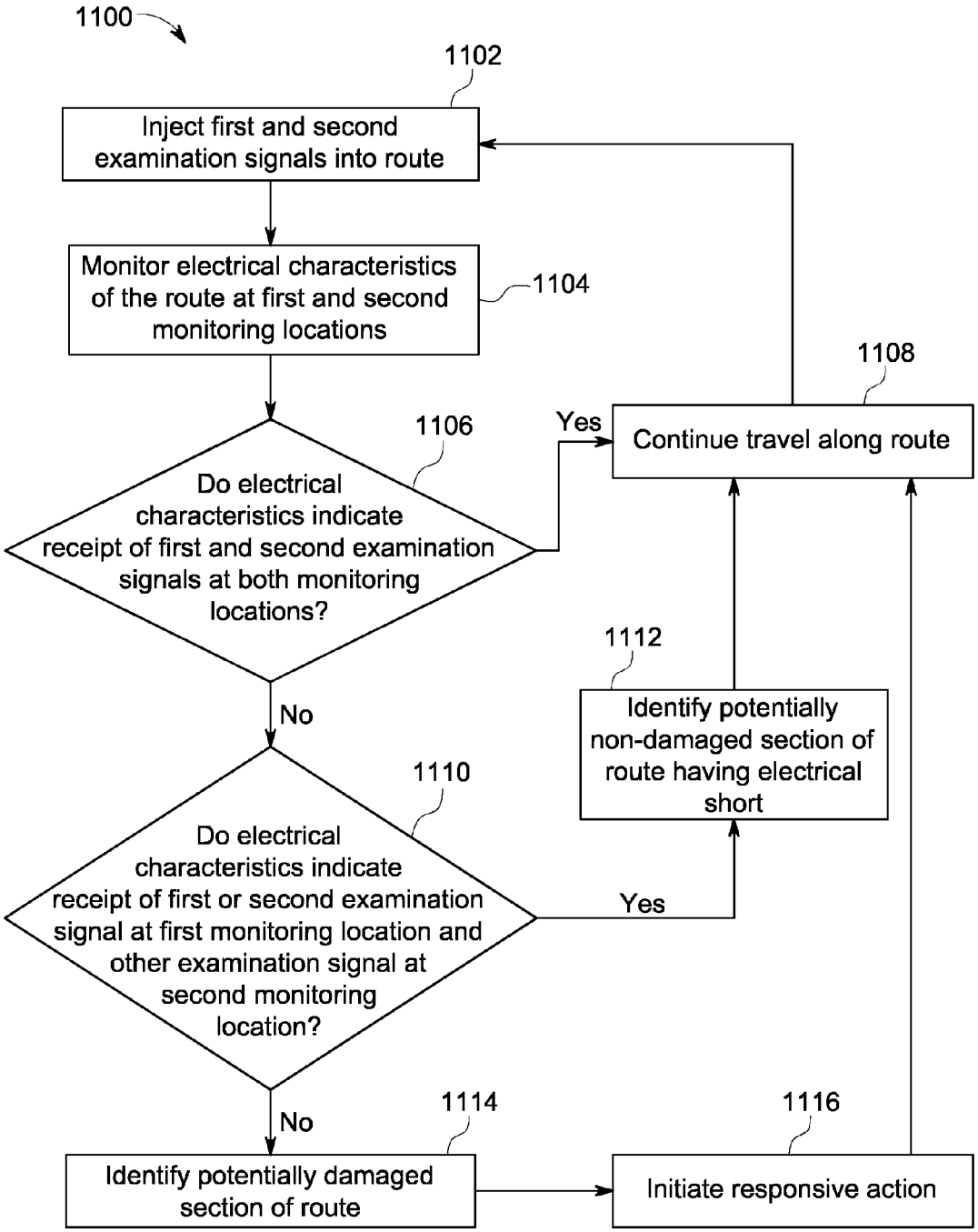
FIG. 11 is a flowchart of an embodiment of a method for examining a route being traveled by a vehicle system from onboard the vehicle system.

FIG. 11 is a flowchart of an embodiment of a method 1100 for examining a route being traveled by a vehicle system from onboard the vehicle system. The method 1100 may be used in conjunction with one or more embodiments of the vehicle systems and/or examinations described herein. Alternatively, the method 1100 may be implemented with another system.

At 1102, first and second examination signals are electrically injected into conductive tracks of the route being traveled by the vehicle system. The first examination signal may be injected using a first vehicle of the vehicle system. The second examination signal may be injected using the first vehicle at a rearward or frontward location of the first vehicle relative to where the first examination signal is injected. Optionally, the first examination signal may be injected using the first vehicle, and the second examination signal may be injected using a second vehicle in the vehicle system. Electrically injecting the first and second examination signals into the conductive tracks may include applying a designated direct current, a designated alternating current, and/or a designated radio frequency signal to at least one conductive track of the route. The first and second examination signals may be transmitted into different conductive tracks, such as opposing parallel tracks.

At 1104, one or more electrical characteristics of the route are monitored at first and second monitoring locations. The monitoring locations may be onboard the first vehicle in response to the first and second examination signals being injected into the conductive tracks. The first monitoring location may be positioned closer to the front of the first vehicle relative to the second monitoring location. Detection units may be located at the first and second monitoring locations. Electrical characteristics of the route may be monitored along one conductive track at the first monitoring location; the electrical characteristics of the route may be monitored along a different conductive track at the second monitoring location. Optionally, a notification may be communicated to the first and second monitoring locations when the first and second examination signals are injected into the route. Monitoring the electrical characteristics of the route may be performed responsive to receiving the notification.

At 1106, a determination is made as to whether one or more monitored electrical characteristics indicate receipt of both the first and second examination signals at both monitoring locations. For example, if both examination signals are monitored in the electrical characteristics at both monitoring locations, then both examination signals are circulating the conductive test loop 912 (shown in FIG. 9). As such, the circuit of the test loop is intact. But, if each of the monitoring locations monitors electrical characteristics indicating only one or none of the examination signals, then the circuit of the test loop may be affected by an electrical break or an electrical short. If the electrical characteristics do indicate receipt of both first and second examination signals at both monitoring locations, flow of the method 1100 may proceed to 1108.

At 1108, the vehicle continues to travel along the route. Flow of the method 1100 then proceeds back to 1102 where the first and second examination signals are once again injected into the conductive tracks, and the method 1100 repeats. The method 1100 may be repeated instantaneously upon proceeding to 1108, or there may be a wait period, such as 1 second, 2 seconds, or 5 seconds, before re-injecting the examination signals.

Referring back to 1106, if the electrical characteristics indicate that both examination signals are not received at both monitoring locations, then flow of the method 1100 proceeds to 1110. At 1110, a determination is made as to whether one or more monitored electrical characteristics indicate a presence of only the first or the second examination signal at the first monitoring location and a presence of only the other examination signal at the second monitoring location. For example, the electrical characteristics received at the first monitoring location may indicate a presence of only the first examination signal, and not the second examination signal. Likewise, the electrical characteristics received at the second monitoring location may indicate a presence of only the second examination signal, and not the first examination signal. As described herein, "indicat[ing] a presence of" an examination signal means that the received electrical characteristics include more than a mere threshold signal-to-noise ratio of the unique identifier indicative of the respective examination signal that is more than electrical noise.

This determination may be used to distinguish between electrical characteristics that indicate the section of the route is damaged and electrical characteristics that indicate the section of the route is not damaged but may have an electrical short. For example, since the first and second examination signals are not both received at each of the monitoring locations, the route may be identified as being potentially damaged due to a broken track that is causing an open circuit. However, an electrical short may also cause one or both monitoring locations to not receive both examination signals, potentially resulting in a false alarm. Therefore, this determination is made to distinguish an electrical short from an electrical break.

For example, if neither examination signal is received at either of the monitoring locations as the vehicle system traverses over the section of the route, the electrical characteristics may indicate that the section of the route is damaged (e.g., broken). Alternatively, the section may be not damaged but including an electrical short if the one or more electrical characteristics monitored at one of the monitoring locations indicate a presence of only one of the examination signals. This indication may be strengthened if the electrical characteristics monitored at the other monitoring location indicate a presence of only the other examination signal. Additionally, a non-damaged section of the route having an electrical short may also be indicated if an amplitude of the electrical characteristics monitored at the first monitoring location is an inverse derivative of an amplitude of the electrical characteristics monitored at the second monitoring location as the vehicle system traverses over the section of the route. If the monitored electrical characteristics indicate significant receipt of only one examination signal at the first monitoring location and only the other examination signal at the second monitoring location, then flow of the method 1100 proceeds to 1112.

At 1112, the section of the route is identified as being non-damaged but having an electrical short. In response, the notification of the identified section of the route including an electrical short may be communicated off-board and/or stored in a database onboard the vehicle system. The location of the electrical short may be determined more precisely by comparing a location of the vehicle over time to the inverse derivatives of the monitored amplitudes of the electrical characteristics monitored at the monitoring locations. For example, the electrical short may have been equidistant from the two monitoring locations when the inverse derivatives of the amplitude are monitored as being equal. Location information may be obtained from a location determining unit, such as a GPS device, located on or off-board the vehicle. After identifying the section as having an electrical short, the vehicle system continues to travel along the route at 1108.

Referring now back to 1100, if the monitored electrical characteristics do not indicate significant receipt of only one examination signal at the first monitoring location and only the other examination signal at the second monitoring location, then flow of the method 1100 proceeds to 1114. At 1114, the section of the route is identified as damaged. Since neither monitoring location receives electrical characteristics indicating at least one of the examination signals, it is likely that the vehicle is traversing over an electrical break in the route, which prevents most if not all of the conduction of the examination signals along the test loop. The damaged section of the route may be disposed between the designated axles of the first vehicle that define ends of the test loop based on the one or more electrical characteristics monitored at the first and second monitoring locations. After identifying the section of the route as being damaged, flow proceeds to 1116.

At 1116, responsive action is initiated in response to identifying that the section of the route is damaged. For example, the vehicle, such as through the control unit and/or identification unit, may be configured to automatically slow movement, automatically notify one or more other vehicle systems of the damaged section of the route, and/or automatically request inspection and/or repair of the damaged section of the route. A warning signal may be communicated to an off-board location that is configured to notify a recipient of the damaged section of the route. A repair signal to request repair of the damaged section of the route may be communicated off-board as well. The warning and/or repair signals may be communicated by at least one of the control unit or the identification unit located onboard the vehicle. Furthermore, the responsive action may include determining a location of the damaged section of the route by obtaining location information of the vehicle from a location determining unit during the time that the first and second examination signals are injected into the route. The calculated location of the electrical break in the route may be communicated to the off-board location as part of the warning and/or repair signal. Optionally, responsive actions, such as sending warning signals, repair signals, and/or changing operational settings of the vehicle, may be at least initiated manually by a vehicle operator onboard the vehicle or a dispatcher located at an off-board facility.

In one embodiment, one or more of the examination systems 102, 200, 500, 700, 800, and/or 900 may determine a location of one or more vehicles and/or which route of several different routes that the vehicle is traveling along based upon detection of a break in conductivity in a route. For example, the route may be formed from conductive segments joined together by insulated joints. The route examination system may detect the location of insulated joints in a manner similar to detecting damage and/or breaks in the route, as described above. For example, an insulated joint between two conductive segments of a rail may be detected in a manner similar to how a break in the rail is detected.

As the vehicles travel over the insulated joints in the route, the examination system can determine locations of insulated joints and/or switches, and compare the locations to known or designated locations of insulated joints and/or switches. For example, a route database may store known locations of insulated joints and/or switches in a route. The examination system can compare the detected locations of insulated joints and/or switches with the known or stored locations of the insulated joints and/or switches, and determine where the vehicle and/or vehicle system is located and/or which route is being traveled upon based on this comparison.

Figure 12:
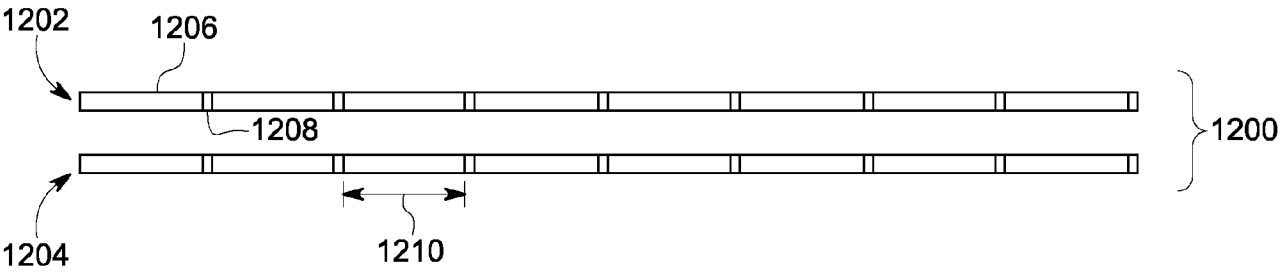
FIG. 12 illustrates a route according to one embodiment.

FIG. 12 illustrates a route 1200 according to one embodiment. The route 1200 may represent one or more of the routes 108, 604, 706, 804, and/or 904 described above. The illustrated route 1200 can represent a track for a rail vehicle, but alternatively may represent another type of route, such as a road. The route 1200 includes plural rails 1202, 1204. Alternatively, the route 1200 may include a single rail 1202 or 1204, or may include more than two rails 1202, 1204.

In the illustrated example, each rail 1202, 1204 is formed from plural conductive segments 1206 that are connected by insulated joints 1208. The insulated joints 1208 can represent dielectric, non-conductive material that interconnects adjacent or neighboring segments 1206. Additionally or alternatively, the insulated joints 1208 can represent a gap or separation between neighboring segments 1206. The insulated joints 1208 can prevent conduction of the electric examination signal described above between segments 1206.

The insulated joints 1208 may be separated from each other along the length of the rail 1202, 1204 and/or the route 1200 by a separation distance 1210. The separation distance 1210 may be a linear distance, a distance measured around a curve, a distance measured up an inclined grade, and/or a distance measured down a downhill grade. In one embodiment the separation distance 1210 is approximately 20 to 24 meters, but alternatively may be a shorter distance or a longer distance.

The geographic locations and/or the separation distances 1210 between insulated joints 1208 may be known or previously designated. For example, a route database or other memory may store designated locations of the insulated joints 1208 and/or switches between routes, and/or may store designated locations of separation distances 1210 between the insulated joints 1208 and/or the switches between the routes.

Determining locations of the insulated joints 1208, locations of switches between routes, and/or separation distances 1210 between insulated joints and/or switches may be useful in determining which route 1200 that a vehicle and/or vehicle system is currently traveling along and/or where the vehicle and/or vehicle system is located along the route 1200.

Figure 13:
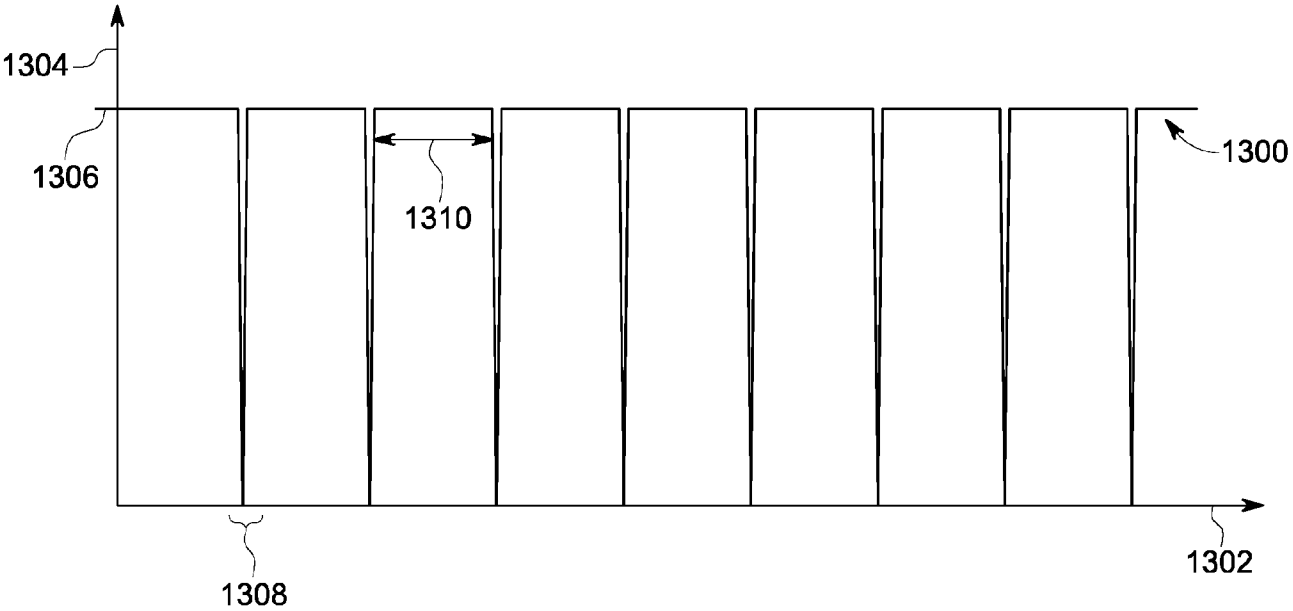
FIG. 13 illustrates electrical examination signals according to one example.

FIG. 13 illustrates an electrical characteristic 1300 of the route 1200 according to one example. The characteristic 1300 is shown alongside a horizontal axis 1302 representative of distance along the route 1200 and/or time, and also is shown alongside a vertical axis 1304 representative of a magnitude of the electrical characteristic.

The characteristic 1300 may be similar to one or more of the signals 1012, 1014, 1016, 1018 shown in FIG. 10 and described above. The characteristic 1300 may be representative of one or more electrical characteristics of the route 1200 that are measured responsive to an examination signal being injected into the route 1200. The characteristic 1300 may represent voltage, amperes, resistance, conductivity, or the like, of the route 1200. With respect to the insulated joints 1208, the examination system can analyze the characteristic 1300 to determine where the insulated joints 1208 are located as the vehicle and/or vehicle system travels along the route 1200. During travel over the conductive segments 1206 of the route 1200 that do not include breaks, the electrical characteristic 1300 may have a baseline value 1306. This baseline value 1306 can represent an average, median, moving average, moving median, or other statistical calculation of the electrical characteristic 1300. Optionally, the baseline value 1306 can represent the value of the examination signal that is injected into the route, such as the voltage, ampere, frequency, conductivity, or the like, of the examination signal.

As the examination system travels over the insulated joints 1208, the magnitude of the characteristic 1300 may change from the baseline value. As shown in FIG. 13, the characteristic 1300 includes several changing portions 1308 which represent parts of the characteristic 1300 that change from the baseline value 1306. In the illustrated example, the changing portions 1308 of the characteristic 1300 represent portions of the characteristic 1300 that decrease from the baseline value 1306. Alternatively, the changing portions 1308 may represent segments of the characteristic 1300 that increase above the baseline value 1306.

As shown in FIGS. 12 and 13, the locations of the insulated joints 1208 correspond with or match the locations of the changing portions 1308 of the characteristic 1300. The examination system can use the locations of the changing portions 1308 in the characteristic 1300 to determine locations of the insulated joints 1208 in the route 1200. In one embodiment, the examination system can determine how far the changing portions 1308 are separated from each other along the horizontal axis 1302. For example, the examination system can identify separation distances 1310 between the changing portions 1308 of the characteristic 1300. The size of the separation distances 1310 in the characteristic 1300 can correspond with or match the separation distances 1210 between the insulated joints 1208 in the route 1200. In one embodiment, the examination system can identify changes in the separation distances 1310 to determine which route that the vehicle and/or vehicle system is traveling along, and/or to determine where the vehicle and/or vehicle system is located along the route 1200.

Figure 14:
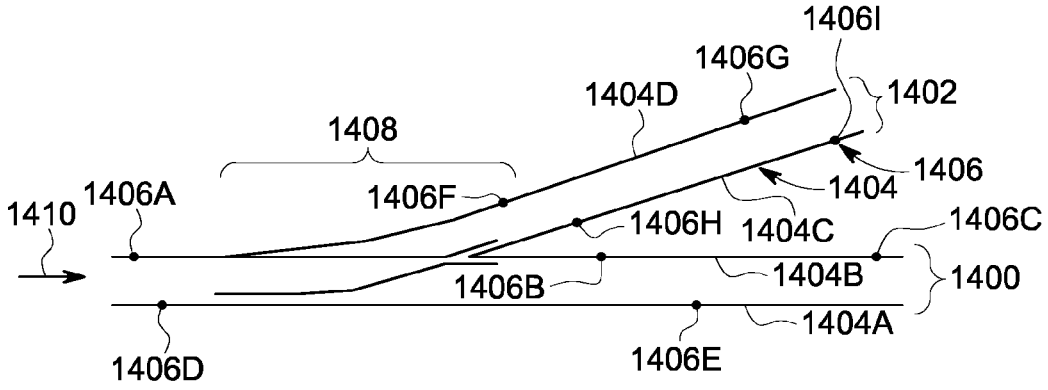
FIG. 14 illustrates routes that meet at an intersection according to one example.

FIG. 14 illustrates routes 1400, 1402 that meet at an intersection according to one example. The routes 1400, 1402 may be similar or identical to one or more of the routes 108, 604, 706, 804, 904, 1200. The route 1400 includes rails 1404 (e.g., rails 1404A, 1404B) and the route 1402 includes rails 1404 (e.g., rails 1404C, 1404D). The routes 1400, 1402 meet at an intersection that is defined by or represented by a switch 1408. Depending on the state or position of the switch 1408, a vehicle and/or vehicle system traveling in a direction of travel 1410 along the route 1400 may remain on the route 1400 after passing over or through the switch 1408, or may travel from the route 1400 to the route 1402 upon traveling through or over the switch 1408.

Several insulated joints 1208 are shown in FIG. 14 as insulated joints 1406 (e.g., insulated joints 1406A-I). As shown in FIG. 14, the insulated joints 1406 may not be evenly spaced between the rails 1404 and/or the routes 1400, 1402. The examination system can determine the locations and/or separation distances 1210 between the insulated joints 1406 and/or the switch 1408 in order to determine which route 1400, 1402 the vehicle and/or vehicle system is traveling along. Optionally, the examination system can determine the locations and/or separation distances 1210 between the insulated joints 1406 and/or the switch 1408 in order to determine where the vehicle and/or vehicle system is located along the route 1400 or 1402. Optionally, the examination system can analyze changes or variances in the separation distances between the insulated joints and/or switches in order to determine which route the vehicle and/or vehicle system is traveling along and/or where the vehicle and/or vehicle system is located on a route.

FIGS. 15 through 18 illustrate examples of electrical characteristics 1300 that may be measured by the examination system as the vehicle and/or vehicle system travels along different routes through the switch 1408. The electrical characteristics 1300 shown in FIG. 15 can represent the electrical characteristics for the rail 1406C that can be measured by the examination system as the vehicle and/or vehicle system travels along the route 1400 and remains on the route 1400 after traveling through the switch 1408 along the direction of travel 1410. The electrical characteristics 1300 shown in FIG. 16 can represent the electrical characteristics that are measured by the examination system for the rail 1404A as the vehicle and/or vehicle system travels along the route 1400 and remains on the route 1400 after traveling through the switch 1408 along the direction of travel 1410.

Figure 17:
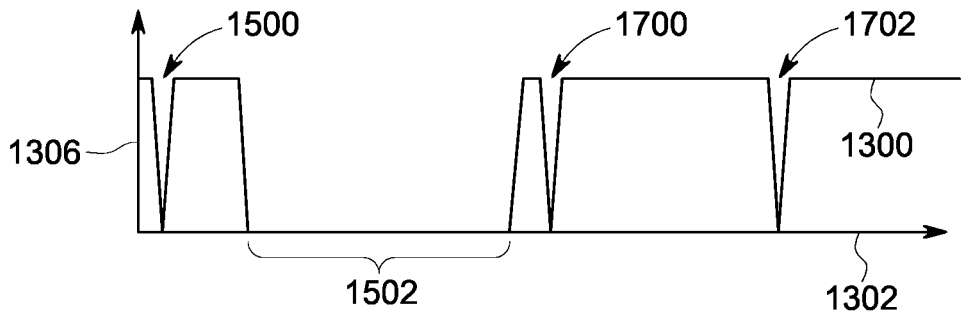
FIG. 17 illustrates an electrical characteristic of the route as measured by the examination system as the vehicle and/or vehicle system travels along different routes shown in FIG. 14 through the switch shown in FIG. 14 according to another example.

The electrical characteristics 1300 shown in FIG. 17 can represent electrical characteristics that are measured by the examination system for the rail 1406D as the vehicle and/or vehicle system travels along the route 1400 along the direction of travel 1410 and moves to the route 1402 after traveling through the switch 1408. The electrical characteristics 1300 shown in FIG. 18 can represent electrical characteristics that are measured by the examination system for the rail 1406C as the vehicle and/or vehicle system travels along the route 1400 along the direction of travel 1410 and moves to the route 1402 after traveling through the switch 1408.

Figure 15:
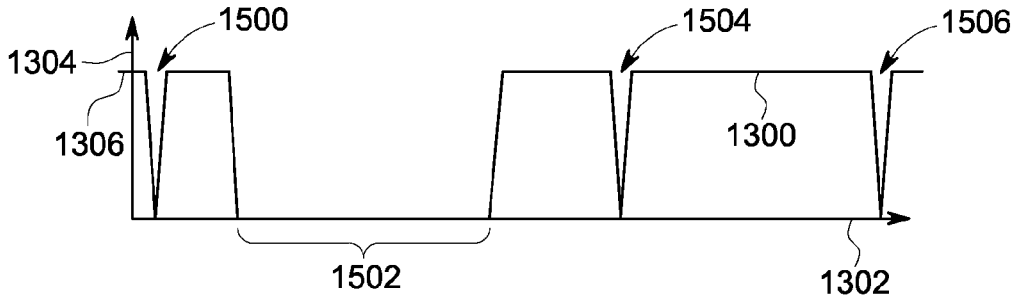
FIG. 15 illustrates an electrical characteristic of the route as measured by the examination system as the vehicle and/or vehicle system travels along different routes shown in FIG. 14 through the switch shown in FIG. 14 according to one example.

With respect the electrical characteristics 1300 shown in FIG. 15, the characteristics 1300 include four different changing portions 1500, 1502, 1504, 1506. These changing portions 1500, 5002, 1504, 1506 can represent locations where the examination system detects an open circuit or break in the conductivity of the rail 1406C. For example, the changing portion 1500 can represent a decrease in the magnitude of the voltage, amperes, or the like, of the examination signal injected into the rail 1406C as examination system travels over the insulated joint 1406A.

The changing portion 1502 can represent a decrease in the magnitude of the voltage, amperes, or the like, of the examination signal injected into the rail 1406C as the examination system travels over the switch 1408. Because the switch 1408 may include gaps, separations, or the like, between two or more of the rails 1404, passage of the vehicle and/or vehicle system with the examination system can result in the examination system detecting an open circuit or break in the conductivity of the route 1400, 1402 as the vehicle and/or vehicle system travels through or over the switch 1408.

The changing portion 1504 of the characteristics 1300 shown in FIG. 15 can represent a decrease in the magnitude of the voltage, amperes, or the like, of the examination signal injected into the rail 14 06C as the examination system travels over the insulated joint 1406B. The changing portion 1506 of the characteristics 1300 shown in FIG. 15 can represent a decrease in the magnitude of the voltage, amperes, or the like, of the examination signal injected into the rail 14 06C as examination system travels the insulated joint 14 06C.

Figure 16:
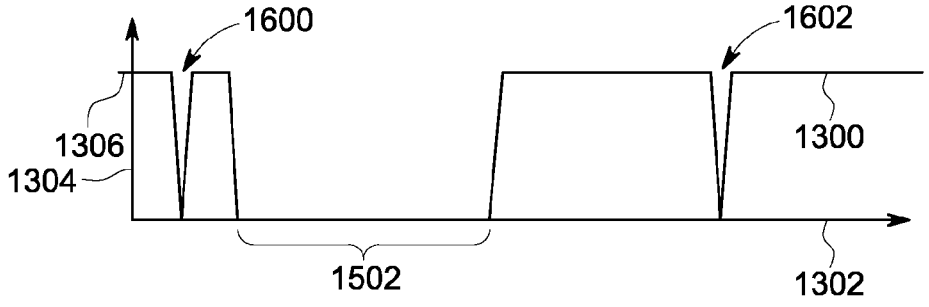
FIG. 16 illustrates an electrical characteristic of the route as measured by the examination system as the vehicle and/or vehicle system travels along different routes shown in FIG. 14 through the switch shown in FIG. 14 according to another example.

With respect to the electrical characteristics 1300 shown in FIG. 16, the characteristics 1300 include a changing portion 1600, the changing portion 1502, and a changing portion 1602. These changing portions 1600, 1502, 1602 can be caused by travel of the examination system over the rail 1404A of the route 1400. The changing portion 1600 can represent a change in the electrical characteristics 1300 caused by travel of the examination system over the insulated joint 1406D. As described above, the changing portion 1502 in the characteristics 1300 can result from travel of the examination system over or through the switch 1408. The changing portion 1602 can represent travel of the examination system over the insulated joint 1406E.

With respect to the electrical characteristics 1300 shown in FIG. 17, the characteristics 1300 include the changing portion 1500, the changing portion 1502, a changing portion 1700, and a changing portion 1702. The changing portions 1500, 1502, 1700, 1702 of the electrical characteristics 1300 shown in FIG. 17 can result from the examination system traveling over and monitoring the rail 1404B of the route 1400 up to the switch 1408, and the rail 1404D of the route 1402 subsequent to the switch 1408. As described above, the changing portion 1500 can occur from travel over the insulated joint 1406A of the rail 1404B and the changing portion 1502 can result from travel over the switch 1408. The changing portion 1700 can occur from travel over the insulated joint 1406F of the rail 1404D in the route 1402. The changing portion 1702 can result from travel over the insulated joint 1406G of the rail 1404D in the route 1402.

Figure 18:
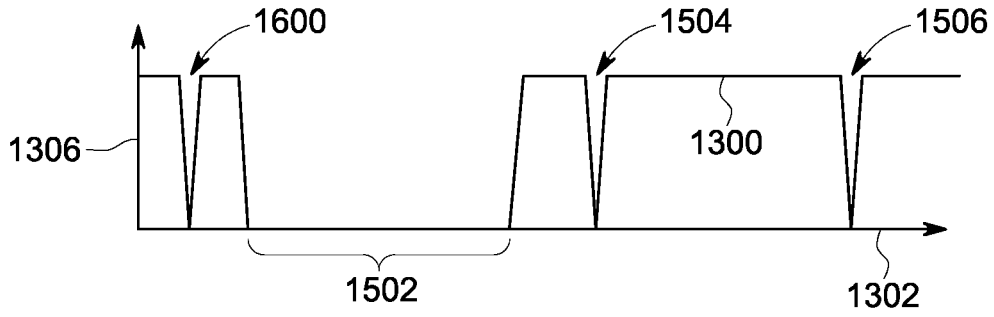
FIG. 18 illustrates an electrical characteristic of the route as measured by the examination system as the vehicle and/or vehicle system travels along different routes shown in FIG. 14 through the switch shown in FIG. 14 according to another example.

With respect to the electrical characteristics 1300 shown in FIG. 18, the characteristics include the changing portion 1600 the changing portion 1502, the changing portion 1504, and the changing portion 1506. These changing portions 1600, 1502, 1504, 1506 can be detected by the examination system during monitoring of the electrical characteristics 1300 of the rail 1404A and the route 1400 along the direction of travel 1410 up to the switch 1408, and then the electrical characteristics 1300 of the rail 1404C in the route 1402 subsequent to the switch 1408. As described above, the changing portion 1600 can be detected by the examination system due to travel over the insulated joint 1406D in the rail 1404A of the route 1400, the changing portion 1502 can be detected by the examination system to travel over, or through the switch 1408, the changing portion 1504 can result from travel of the examination system over the insulated joint 1406H, the changing portion 1506 can be detected by the examination system due to travel over the insulated joint 1406I.

The examination system can monitor the electrical characteristics of the routes being traveled upon by the vehicle and/or the vehicle system in order to determine which route 1400, 1402 that the vehicle and/or vehicle system is traveling along subsequent to traveling over the switch 1408. For example, during travel of the vehicle and/or the vehicle system in the direction of travel 1410 along the route 1400, through the switch 1408, and continuing along the route 1400, the examination system may monitor electrical characteristics 1300 of the route in order to determine whether the vehicle and/or the vehicle system is on the route 1400 or the route 1402 subsequent to traveling through the switch 1408.

If the electrical characteristics 1300 monitored by the examination system include changing portions that occur in the same locations as the examination signals 1300 shown in FIG. 15 or the electrical characteristics 1300 shown in FIG. 16, then the examination system can determine that the vehicle and/or vehicle system traveled along and remains on the route 1400 while approaching, traveling through, and subsequent to the switch 1408. On the other hand, if the electrical characteristics 1300 monitored by the examination system include changing portions that occur in the same locations as the changing portions in electrical characteristics shown in FIG. 17 or the electrical characteristics 1300 shown in FIG. 18, then the examination system may determine that the vehicle and/or vehicle system moved from the route 1400 to the route 1402 after traveling through the switch 1408.

The examination system can refer to designated locations of insulated joints 1406 of the rails 1404 of the routes 1400, 1402 and/or designated locations of switches 1408 for several different routes in order to determine which route the vehicle and/or vehicle system is traveling along and/or where the vehicle and/or vehicle system is located along the route. For example, a route database disposed onboard and/or off-board the vehicle and/or vehicle system may store designated locations of insulated joints 1406 and/or designated locations of switches 1408 for many different routes. Responsive to identifying locations of insulated joints 1406 and/or switches 1408 based on the monitoring of the electrical characteristics 1300 during movement of the vehicle and/or vehicle system, the examination system can compare these identified locations to the designated locations of the insulated joints 1406 and/or the switches 1408 stored in the route database. Different sets of the designated locations of the insulated joints 1406 and/or the designated locations of the switches 1408 can be associated with different routes.

Depending on which set of the desert locations more closely match the locations identified by the examination system, examination system may select or identify a route that the vehicle and/or vehicle system is traveling along, and/or the location of the vehicle and/or vehicle system along the route. For example, if the locations of the changing portions in the electrical characteristic being monitored by the examination system more closely match the set of designated locations of the insulated joints 1406 and/or switches 1408 associated with a first route than one or more other routes, then the examination system may determine that the vehicle and/or vehicle system is traveling along the first route and not any of the one or more other routes.

With respect to the examples of the characteristics 1300 shown in FIGS. 15 through 18, if the locations of the changing portions in the characteristics 1300 shown in FIG. 15 and/or FIG. 16 more closely match the designated locations of the insulated joints 1406 and/or the switches 1408 associated with the route 1400, the examination system may determine that the vehicle and/or vehicle system travels along and remained on the route 1400 during travel through the switch 1408. Conversely, if the locations of the changing portions in the characteristics 1300 shown in FIG. 17 and/or FIG. 18 were closely match the designated locations of insulated joints 1406 and/or the switches 1408 associated with the route 1400 prior to the switch 1408 and the route 1402 subsequent to the switch 1408, the examination system may determine that the vehicle and/or vehicle system travels along and moved from the route 1400 on to the route 1402 during travel through the switch 1408.

Figure 19:
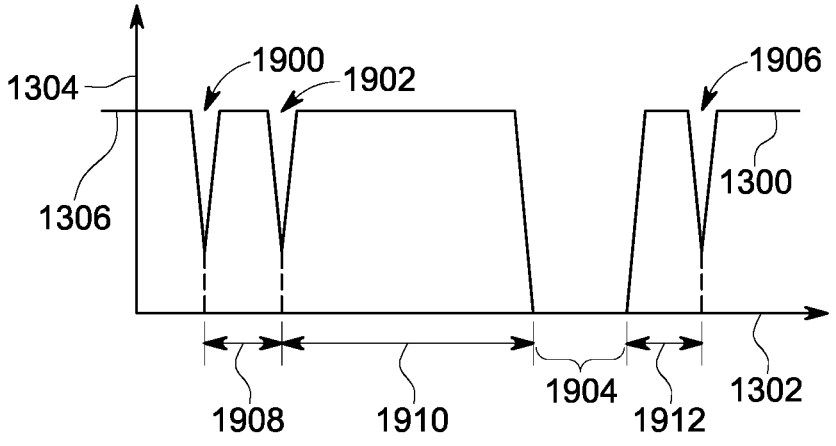
FIG. 19 illustrates another example of an electrical characteristic that may be monitored by the examination system.

FIG. 19 illustrates another example of electrical characteristics 1300 that may be monitored by the examination system. The electrical characteristics 1300 are shown alongside the horizontal axis 1302 and the vertical axis 1304 described above. Electrical characteristics 1300 include several changing portions 1900, 1902, 1904, 1906 from the baseline value 1306 described above. The examination system can analyze locations of the changing portions 1900, 1902, 1904 and/or 1906 to determine where the vehicle and/or vehicle system is located along a route. For example, a route database can store designated locations along a route with different locations of the insulated joints, regardless of whether the route includes or extends through a switch. Determining which identified locations of breaks in the conductivity of the route more closely match designated locations of the insulated joints in the route database can identify the route being traveled upon and/or where the vehicle is located along the route.

Optionally, the examination system can analyze variances in the separation distances between the changing portions in order to determine where the vehicle and/or vehicle system is located along the route. For example, the changing portions 1900, 1902 of the electrical characteristics 1300 shown in FIG. 19 are separated by a separation distance 1908. The changing portions 1902, 1904 are separated from each other by a separation distance 1910. The changing portions 1904, 1906 are separated from each other by separation distance 1912.

The examination system can compare one or more of the separation distances 1908, 1910, 1912 and/or changes in one or more of the separation distances 1908, 1910, 1912 to determine which route the vehicle is traveling along and/or where the vehicle is located along the route. For example, designated separation distances between insulated joints 1406 and/or switches 1408 can be stored in the route database. The examination system can compare the separation distances 1908, 1910, and/or 1912 identified by the examination system from analysis of the electrical characteristics 1300 with the designated separation distances and/or variances in separation distances stored in the route database and associated with different routes. Based on this comparison, the examination system may determine that the identified separation distances more closely match the designated separation distances associated with one route or a location along a route. Based on this comparison, the examination system can determine which route the vehicle is traveling along and/or where the vehicle is located along the route.

Figure 20:
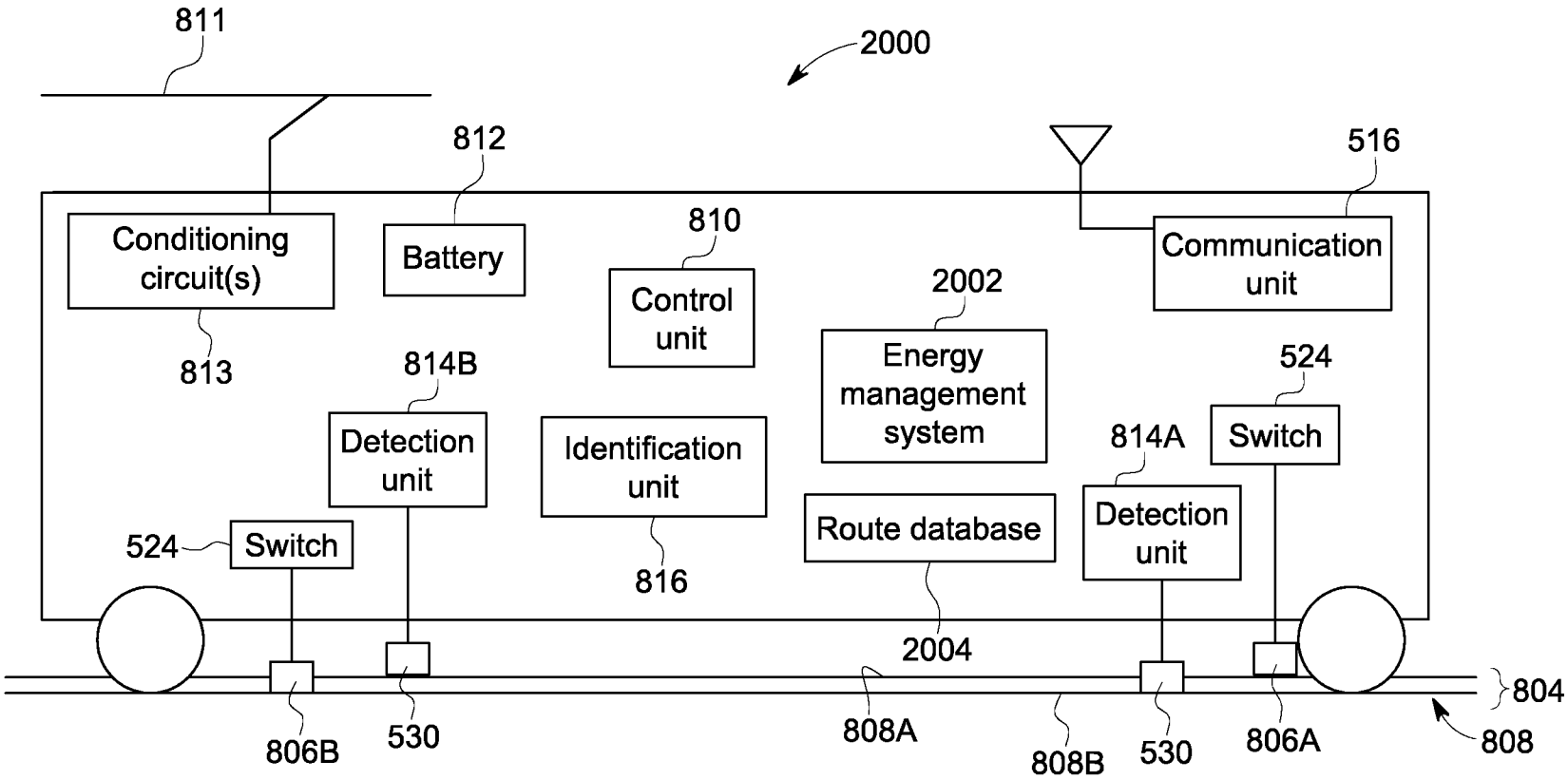
FIG. 20 illustrates another vehicle according to another embodiment.

FIG. 20 illustrates another vehicle 2000 according to another embodiment. Optionally, the vehicle 2000 may be referred to as a vehicle system. The vehicle 2000 includes several components previously described in connection with the vehicle 802 shown in FIG. 8. For example, similar to the vehicle 802 shown in FIG. 8, the vehicle 2000 can include the energy storage device 812, the control unit 810, one or more conditioning circuits 813, the communication unit 516, the switches 524, the detection units 814A, 814 B, the identification unit 816, and/or the detection devices 530. Alternatively, the vehicle 2000 may not include one or more of the components of the vehicle 802 shown in FIG. 8.

The vehicle 2000 optionally can include an energy management system 2002 and/or a route database 2004. The route database 2004 can include or represent one or more memories, such as a computer hard drive, a flash drive, an optical drive, or other computer-readable storage medium. The route database 2004 may store different sets of designated locations of insulated joints and/or switches, designated separation distances between insulated joints and/or switches, designated changes in the separation distances, etc. As described above, these different sets of designated locations may be associated with different routes and/or different locations along the routes. The examination system may compare the identified locations of the changing portions in the electrical characteristics of a route during travel of the vehicle 2000 with a designated locations in order to determine which route the vehicle 2000 is traveling along and/or where the vehicle is located along the route.

The energy management system 2002 can include or represent hardware circuits or circuitry that include and/or are connected with one or more processors (e.g., one or more controllers, computer processors, or the low or other logic-based devices). The energy management system 2002 can create a trip plan that designates operational settings of the vehicle 2000 for a trip of the vehicle. The trip plan can designate operational settings as a function of time and/or distance along one or more routes. For example, the trip plan can designate throttle settings, brake settings, speeds, accelerations, horsepower, or the like, as a function of time and/or distance for a trip. Operational settings may be designated by the energy management system 2002 in order to reduce fuel consumed by the vehicle and/or vehicle system, emissions generated by the vehicle and/or vehicle system, or the like. As a result, the control unit 810 can automatically control actual operations of the vehicle 2000 and/or the vehicle system according to the designated operational settings of the trip plan in order to reduce fuel consumed and/or emissions generated relative to traveling along the same trip using different operational settings. Optionally, the energy management system 2002 and/or the control unit 810 may notify or coach an operator of the vehicle 2000 and/or vehicle system of the operational settings designated by the trip plan. The operator that may then manually implement these operational settings of the trip plan by manually controlling the vehicle or vehicle system.

Figure 21:
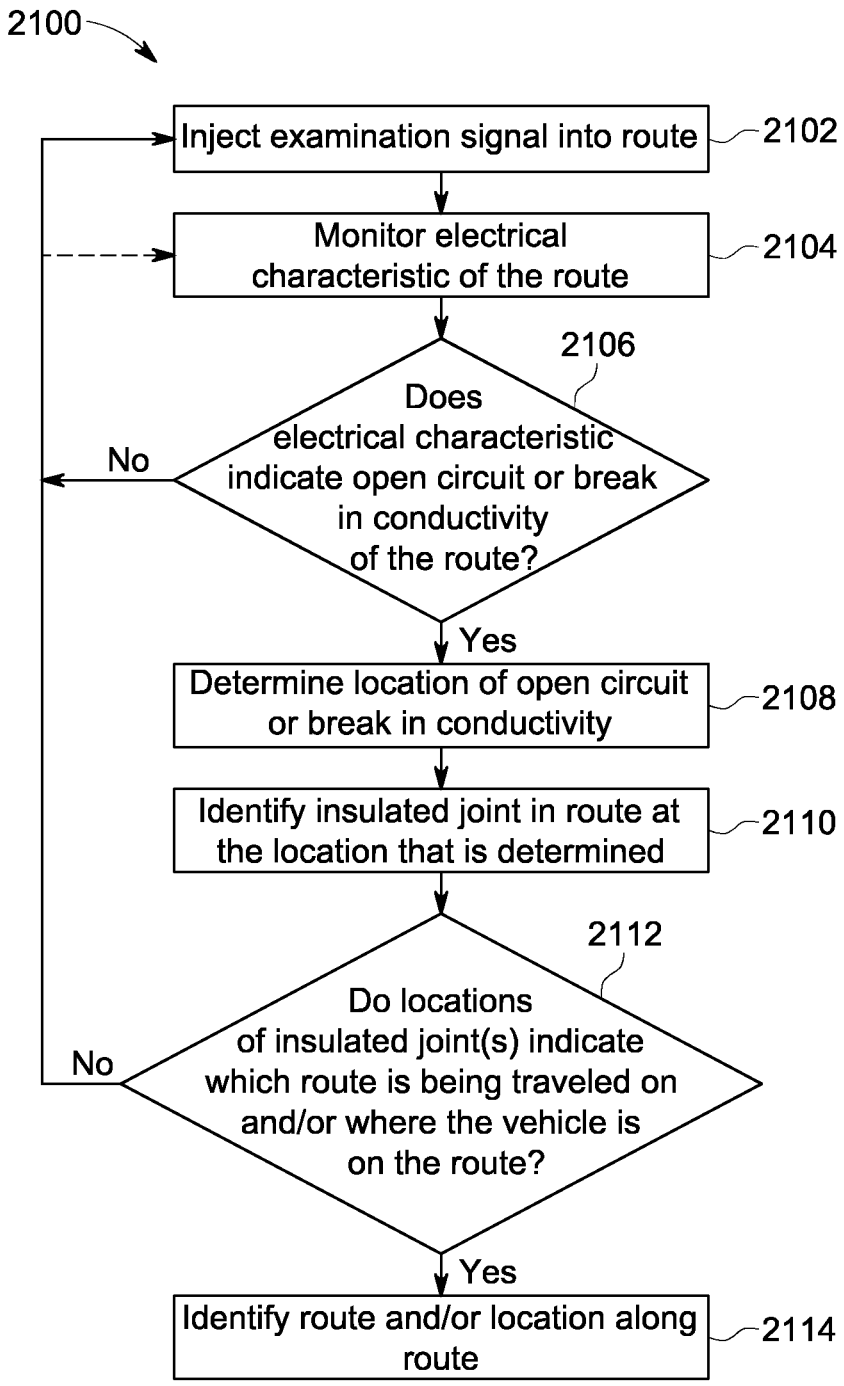
FIG. 21 illustrates a flowchart of a method for determining which route a vehicle and/or vehicle system is traveling along, and/or where the vehicle and/or vehicle system is located along the route according to one embodiment.

FIG. 21 illustrates a flowchart of a method 2100 for determining which route a vehicle and/or vehicle system is traveling along, and/or where the vehicle and/or vehicle system is located along the route according to one embodiment. The method 2100 may be implemented or performed by one or more embodiments of the examination systems described herein.

At 2102, an examination signal is electrically injected into a route being traveled by a vehicle and/or vehicle system. As described above, this examination signal can be injected into the route to determine if the examination signal is successfully conducted along a closed loop formed at least in part by one or more conductive segments of the route.

At 2104, one or more electrical characteristics of the route are monitored responsive to injection of the examination signal into the route. The one or more electrical characteristics that are monitored can include, for example, voltage, amperes, conductivity, resistance, or the like, of the route. Depending on whether the route is damaged, includes insulated joints, and/or includes a switch, the electrical characteristics that are monitored may change. For example, a break in the route, an insulated joint, and/or a switch in the route can cause the voltage and/or amperes of the examination signal injected into the route to decrease or be eliminated. As another example, a break in the route, an insulated joint, and/or a switch in the route can cause the conductivity of the route to decrease or be eliminated, and/or can cause the resistance of the route to increase.

At 2106, a determination is made as to whether or not the one or more electrical characteristics being monitored indicate an open circuit or break in the conductivity of the route. If the one or more electrical characteristics being monitored change, such as by varying from a baseline value of the electrical characteristics by more than a designated threshold (e.g., changes by more than 1%, 3%, 5%, 10%, 20%, or the like), then the one or more electrical characteristics may indicate an open circuit or break in the conductivity of the route.

The baseline value of the electrical characteristics can be an average, median, moving average, moving median, or the like a previously monitored electrical characteristics. Optionally, the baseline value of the electrical characteristics can be based on or equivalent to the magnitude of similar electrical characteristics of the examination signal that is injected into the route. For example, the baseline value may be a voltage that is the same as the voltage of the examination signal, the baseline value may be an amount of and peers that the same as the amperes of the examination signal, or the like.

If the one or more electrical characteristics being monitored do indicate an open circuit or break in the conductivity of the route, then damage to the route, an insulated joint, and/or a switch may have been identified. As a result, flow of the method 2100 can continue to 2108. On the other hand, if the one or more electrical characteristics being monitored do not indicate an open circuit or break in the conductivity of the route, then flow of the method may return to 2102 for the injection of one or more additional examination signals into the route. Optionally, if the one or more electrical characteristics being monitored do not indicate an open circuit or break in the conductivity of the route, then flow of the method 2100 can return to 2104, so that one or more additional electric characteristics of the route may be monitored responsive to injection of a previous examination signal into the route.

At 2108, the location of where the open circuit or break in the conductivity the route was identified is determined. For example, the geographic location of the vehicle and/or vehicle system may be determined by one or more of the control units, communication units, or the like, described herein. The location of the vehicle and/or vehicle system when the open circuit or break in the conductivity of the route is detected may be identified as location of the open circuit or break in the conductivity of the route.

At 2110, an insulated joint in the route is identified as location where the open circuit or break in the conductivity of the route is identified. Optionally, a switch in the route is identified in the location where the open circuit or break in the conductivity of the route was identified. In one aspect, the open circuit or break in the conductivity the route may be identified as insulated joint or a switch depending on a distance and/or time period that the changing portion of the electrical characteristic extended. For example, an electrical characteristic may decrease or increase relative to baseline value over a longer distance and/or time during travel over a switch then during travel over an insulated joint. Depending on the size of the changing portion, the changing portion may be representative of a switch or an insulated joint.

At 2112 a determination is made as to whether locations of one or more insulated joints and or switches indicate which route is being traveled on by the vehicle and/or vehicle system, and/or where the vehicle and/or vehicle system is located along the route. For example locations of insulated joints and/or switches that were determined based on changes in the electrical characteristics of the route may be compared to different sets of designated locations of insulated joints and/or switches for different routes. Depending on which set of designated locations more closely matched identified locations of insulated joints and/or switches, a determination may be made as to which route is being traveled upon and/or where the vehicle and/or vehicle system is located along the route.

If locations of insulated joints and/or switches as identified based on examination of the one or more electrical characteristics of the route more closely match a first designated set of locations of the insulated joints and/or switches than one or more other designated sets, then the locations that were identified may indicate that the vehicle and/or vehicle system is traveling along the route associated with the first designated set. Optionally, if locations of insulated joints and/or switches as identified based on examination of the one or more electrical characteristics of the route more closely match a designated location along a route than one or more other locations along the route, the locations that were identified may indicate where the vehicle and/or vehicle system is located along the route. As a result, flow of the method 2100 can continue to 2114.

On the other hand, if the identified locations of the insulated joints and/or switches do not match one or more of the designated sets of insulated joints and/or switches, then the identify locations of the insulated joints and/or switches may not indicate which route as being traveled upon and/or where the vehicles located on the route. As a result flow of the method 2100 may return 2 2102. Optionally, flow of the method 2100 may return to 2104.

At 2114, the route associated with the designated set of locations of the insulated joints and/or switches joints and/or switches that more closely matches the identified locations of the insulated joints and 4/or switches may be identified as the route being traveled upon by the vehicle and/or vehicle system. Optionally, the location along the route that is associated with the designated set of locations of insulated joints and/or switches that more closely matches the identified locations of the insulated joints and/or switches may be identified as the location of the vehicle and/or vehicle system. The method 2100 may terminate or optionally may repeat one or more additional times during travel of the vehicle and/or vehicle system.

In one embodiment, a method (e.g., for examining a route) includes automatically detecting (with an identification unit onboard a vehicle having one or more processors) a location of a break in conductivity of a first route during movement of the vehicle along the first route and identifying (with the identification unit) one or more of a location of the vehicle on the first route or the first route from among several different routes based at least in part on the location of the break in the conductivity of the first route that is detected.

In one aspect, detecting the location of the break in the conductivity of the first route can include detecting the location of one or more insulated joints in one or more conductive rails of the first route.

In one aspect, detecting the location of the break in the conductivity of the first route can include detecting the location of one or more switches at one or more intersections between the first route and one or more second routes.

In one aspect, detecting the location of the break in the conductivity of the first route can include injecting an electric examination signal into a conductive segment of the first route and monitoring an electrical characteristic of the first route responsive to injecting the electric examination signal into the conductive segment of the first route.

In one aspect, identifying the one or more of the location of the vehicle or the first route from among the several different routes can include comparing the location of the break in the conductivity of the first route that is identified with a designated set of one or more locations of the break in the conductivity of the route.

In one aspect, identifying the one or more of the location of the vehicle or the first route from among the several different routes can include determining a separation distance between two or more of the breaks in the conductivity of the route that are detected.

In one aspect, identifying the one or more of the location of the vehicle or the first route from among the several different routes can include comparing the separation distance to one or more designated separation distances associated with one or more different locations or the several different routes.

In another aspect, the method further includes controlling (e.g., automatically controlling with a control unit having at least one processor) the vehicle for movement based at least in part on the identified location of the vehicle on the first route or the identified first route from among the several different routes.

In another embodiment, a system (e.g., a route examination system) includes an identification unit having one or more processors configured to detect a location of a break in conductivity of a first route from onboard a vehicle during movement of the vehicle along the first route. The identification unit also is configured to identify one or more of a location of the vehicle on the first route or the first route from among several different routes based at least in part on the location of the break in the conductivity of the first route that is detected.

In one aspect, the identification unit can be configured to detect the location of the break in the conductivity of the first route by detecting the location of one or more insulated joints in one or more conductive rails of the first route.

In one aspect, the identification unit can be configured to detect the location of the break in the conductivity of the first route by detecting the location of one or more switches at one or more intersections between the first route and one or more second routes.

In one aspect, the system also can include a control unit configured to inject an electric examination signal into a conductive segment of the first route and a detection unit configured to monitor an electrical characteristic of the first route responsive to injecting the electric examination signal into the conductive segment of the first route. The identification unit can be configured to detect the location of the break in conductivity of the first route based at least in part on the electrical characteristic.

In one aspect, the identification unit can be configured to identify the one or more of the location of the vehicle or the first route from among the several different routes by comparing the location of the break in the conductivity of the first route that is identified with a designated set of one or more locations of the break in the conductivity of the route.

In one aspect, the identification unit can be configured to identify the one or more of the location of the vehicle or the first route from among the several different routes by determining a separation distance between two or more of the breaks in the conductivity of the route that are detected.

In one aspect, the identification unit can be configured to identify the one or more of the location of the vehicle or the first route from among the several different routes by comparing the separation distance to one or more designated separation distances associated with one or more different locations or the several different routes.

In another embodiment, a system (e.g., a route examination system) includes a detection unit and an identification unit. The detection unit can be configured to be disposed onboard a vehicle system and to detect a change in an electrical characteristic of a first route being traveled upon by the vehicle system. The identification unit can be configured to be disposed onboard the vehicle system and to identify one or more of the first route from among several different routes or where the vehicle system is located along the first route based at least in part on the change in the electrical characteristic that is detected.

In one aspect, the detection unit can be configured to detect the change in the electrical characteristic as an opening in a circuit that is formed at least in part by the first route.

In one aspect, the identification unit can be configured to identify the change in the electrical characteristic of the first route as a location of an insulated joint in the first route.

In one aspect, the identification unit can be configured to identify the one or more of the first route or where the vehicle is located by comparing the location of the insulated joint with a designated location of one or more insulated joints stored in a route database.

In one aspect, the identification unit can be configured to identify the one or more of the first route or where the vehicle is located by comparing a separation distance between the location of the insulated joint and another location of another insulated joint with a designated separation distance between two or more insulated joints stored in a route database.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the Figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A method comprising: electrically detecting, with one or more processors disposed onboard a vehicle, plural locations beneath the vehicle of breaks in electrical conductivity in one or more conductive rails of a route during movement of the vehicle along the route; comparing, with the one or more processors, the locations of the breaks in the electrical conductivity with designated locations of non-conductive areas in one or more routes, the one or more routes including the route traveled by the vehicle; determining, with the one or more processors, one or more of a location of the vehicle along the route or an identification of the route among the one or more routes based on the comparison of the locations of the breaks with the designated locations of the nonconductive areas; wherein electrically detecting the locations of one or more the breaks in the electrical conductivity in the one or more conductive rails of the route beneath the vehicle includes determining one or more separation distances between successive locations of the breaks in the electrical conductivity in the one or more conductive rails along the route; and controlling the movement of the vehicle responsive to determining the one or more of the location of the vehicle along the route or the identification of the route.

2. The method of claim 1, wherein electrically detecting the locations of the breaks in the electrical conductivity in the one or more conductive rails of the route beneath the vehicle includes electrically detecting locations of two or more insulated joints in the route, the designated locations of the non-conductive areas representing designated locations of the insulated joints in the one or more routes.

3. The method of claim 1, wherein electrically detecting the locations of the breaks in the electrical conductivity in the one or more conductive rails of the route beneath the vehicle includes electrically detecting locations of two or more switches in the route, the designated locations of the non-conductive areas representing designated locations of the switches in the one or more routes.

4. The method of claim 1, wherein electrically detecting the locations of the breaks in the electrical conductivity in the one or more conductive rails of the route beneath the vehicle includes injecting, beneath the vehicle, an electric examination signal into at least one of the one or more conductive rails of the route and monitoring an electrical characteristic of the one or more conductive rails beneath the vehicle responsive to injecting the electric examination signal, the breaks in the electrical conductivity detected based on changes in the electrical characteristic relative to a baseline value of the electrical characteristic.

5. The method of claim 1, wherein comparing the locations of the breaks in the electrical conductivity with the designated locations of the non-conductive areas in the one or more routes includes comparing the one or more separation distances to one or more designated separation distances in the one or more routes, the one or more designated separation distances defined between the designated locations of the non-conductive areas in the one or more routes.

6. The method of claim 1, further comprising electrically injecting an examination signal into a circuit formed by a first set of wheels and axles of the vehicle, a second set of wheels and axles of the vehicle, and a length of the one or more conductive rails of the route that extends from the wheels in the first set that contact the one or more conductive rails to the wheels in the second set that contact the one or more conductive rails, wherein the locations beneath of the vehicle of the breaks in the electrical conductivity are electrically detected within the circuit.

7. The system of claim 1, wherein the one or more routes includes multiple routes and the designated locations of the non-conductive areas in the one or more routes include different sets of designated locations of the non-conductive areas associated with different routes, wherein determining one or more of the location of the vehicle along the route or the identification of the route traveled by the vehicle among the multiple routes includes determining which of the different sets of the designated locations of the non-conductive areas most closely matches the detected locations of the breaks in the electrical conductivity in the one or more conductive rails of the route.

8. The system of claim 1, wherein the designated locations of the non-conductive areas in the one or more routes are stored in a route database onboard the vehicle, the one or more processors configured to access the route database to compare the detected locations of the breaks in the electrical conductivity in the one or more conductive rails of the route to the designated locations of the non-conductive areas.

9. A system comprising: one or more processors disposed onboard a vehicle and configured to electrically detect a plural locations beneath the vehicle of breaks in electrical conductivity in one or more conductive rails of a route from onboard a vehicle during movement of the vehicle along the route, the one or more processors also configured to compare the locations of the breaks in the electrical conductivity with designated locations of nonconductive areas in one or more routes that include the route traveled by the vehicle, the one or more processors configured to determine one or more of a location of the vehicle along the route or an identification of the route among the one or more routes based on the comparison of the locations of the breaks with the designated locations, wherein the one or more processors are configured to electrically detect the locations of the breaks in the electrical conductivity in the one or more conductive rails of the route by determining one or more separation distances between the successive locations of the breaks in the electrical conductivity in the one or more conductive rails along the route, the one or more separation distances representing one or more separation distances between successive non-conductive areas along the route, wherein the one or more processors also are configured to control movement of the vehicle responsive to determining the one or more of the location of the vehicle along the route or the identification of the route.

10. The system of claim 9, wherein the locations of the breaks in the electrical conductivity represent the locations of two or more insulated joints beneath the vehicle in the route, the designated locations of the non-conductive areas representing designated locations of the insulated joints in the one or more routes.

11. The system of claim 9, wherein the locations of the breaks in the electrical conductivity represent the locations of two or more switches beneath the vehicle in the route, the designated locations of the non-conductive areas representing designated locations of the switches in the one or more routes.

12. The system of claim 9, wherein the one or more processors also are configured to control injection, beneath the vehicle, of an electric examination signal into at least one of the one or more conductive rails of the route, the one or more processors also configured to monitor an electrical characteristic of the one or more conductive rails responsive to injecting the electric examination signal, wherein the one or more processors are configured to electrically detect the locations of the breaks in the electrical conductivity based on changes in the electrical characteristic relative to a baseline value of the electrical characteristic.

13. The system of claim 9, wherein the one or more processors are configured to compare the locations of the breaks in the electrical conductivity with the designated locations of the non-conductive areas in the one or more routes by comparing the one or more separation distances to one or more designated separation distances in the one or more routes, the one or more designated separation distances defined between the designated locations of the non-conductive areas in the one or more routes.

14. The system of claim 9, wherein the one or more processors are configured to electrically detect the locations beneath the vehicle of the breaks in the electrical conductivity of the one or more conductive rails inside a circuit formed by a first set of wheels and axles of the vehicle, a second set of wheels and axles of the vehicle, and a length of the one or more conductive rails of the route that extends from the wheels in the first set that contact the one or more conductive rails to the wheels in the second set that contact the one or more conductive rails.

15. A system comprising: one or more processors configured to be disposed onboard a vehicle system and to detect changes in an electrical characteristic of one or more conductive rails in a route being traveled upon by the vehicle system, the changes in the electrical characteristic detected beneath the vehicle during movement of the vehicle system along the route, the one or more processors also configured to determine locations of breaks in electrical conductivity in the route based on the changes in the electrical characteristic that are detected relative to a baseline value of the electrical characteristic, wherein the one or more processors also are configured to compare the locations of the breaks in the electrical conductivity with designated locations of the non-conductive areas in one or more routes stored in a route database to determine one or more of a location of the vehicle system along the route, an identification of the route among the one or more routes, a direction of travel of the vehicle system, or a speed of the vehicle system based at least in part on the changes in the electrical characteristic that are detected, wherein the one or more processors are configured to compare the locations of the breaks in the electrical conductivity with the designated locations of the non-conductive areas stored in the route database by comparing one or more separation distances between successive locations of the breaks with one or more designated separation distance stored in the route database, the one or more designated separation distances defined between the designated locations of the nonconductive areas, wherein the one or more processors are configured to control the movement of the vehicle system responsive to determining the one or more of the location of the vehicle along the route, the identification of the route, the direction of travel of the vehicle system, or the speed of the vehicle system.

16. The system of claim 15, wherein the one or more processors are configured to detect the changes in the electrical characteristic as openings in one or more circuits that are formed at least in part by segments of the one or more conductive rails in the route that are beneath the vehicle system.

17. The system of claim 15, wherein the one or more processors are configured to identify the changes in the electrical characteristic of the one or more conductive rails in the route as locations of insulated joints in the route.

18. The system of claim 17, wherein the one or more processors are configured to determine the one or more of the location of the vehicle system along the route, the identification of the route, the direction of travel of the vehicle system, or the speed of the vehicle system by comparing the locations of the insulated joints with the designated locations of the non-conductive areas stored in the route database.

19. The system of claim 15, wherein the one or more processors are configured to electrically detect the changes in the electrical characteristic within a circuit beneath the vehicle, the circuit formed by a first set of wheels and axles of the vehicle, a second set of wheels and axles of the vehicle, and a length of the one or more conductive rails of the route that extends from the wheels in the first set that contact the one or more conductive rails to the wheels in the second set that contact the one or more conductive rails.

* * * * *